US009746816B2

(12) United States Patent
Mizushima et al.

(10) Patent No.: US 9,746,816 B2
(45) Date of Patent: Aug. 29, 2017

(54) IMAGE FORMING APPARATUS AND ELECTROPHOTOGRAPHIC CARTRIDGE

(75) Inventors: Tadashi Mizushima, Kanagawa (JP); Akiteru Fujii, Kanagawa (JP); Takayuki Shoda, Kanagawa (JP)

(73) Assignee: MITSUBISHI CHEMICAL CORPORATION, Tokyo (JP)

( * ) Notice: Subject to any disclaimer, the term of this patent is extended or adjusted under 35 U.S.C. 154(b) by 198 days.

(21) Appl. No.: 13/033,338

(22) Filed: Feb. 23, 2011

(65) Prior Publication Data

US 2011/0206411 A1 Aug. 25, 2011

(30) Foreign Application Priority Data

Feb. 24, 2010 (JP) ..... 2010-038121

(51) Int. Cl.

| | |
|---|---|
| ***G03G 21/00*** | (2006.01) |
| ***G03G 5/06*** | (2006.01) |
| ***G03G 5/05*** | (2006.01) |
| ***G03G 5/04*** | (2006.01) |
| ***G03G 5/043*** | (2006.01) |
| ***G03G 5/147*** | (2006.01) |
| ***G03G 9/08*** | (2006.01) |
| ***G03G 9/09*** | (2006.01) |

(52) U.S. Cl.

CPC ..... *G03G 21/0005* (2013.01); *G03G 5/04* (2013.01); *G03G 5/043* (2013.01); *G03G 5/056* (2013.01); *G03G 5/0525* (2013.01); *G03G 5/0542* (2013.01); *G03G 5/0567* (2013.01); *G03G 5/0629* (2013.01); *G03G 5/1473* (2013.01); *G03G 9/0819* (2013.01); *G03G 9/0827* (2013.01); *G03G 9/0906* (2013.01); *G03G 9/0926* (2013.01); *G03G 21/0011* (2013.01); *G03G 2215/00957* (2013.01); *G03G 2215/0604* (2013.01)

(58) Field of Classification Search

CPC ... G03G 21/0011; G03G 5/056; G03G 5/0629
USPC ..... 399/159, 350, 346; 430/58.85, 119.82, 430/123.41
See application file for complete search history.

(56) References Cited

U.S. PATENT DOCUMENTS

| | | | | |
|---|---|---|---|---|
| 4,572,884 | A * | 2/1986 | Sasaki | G03G 5/0668 430/72 |
| 4,985,327 | A | 1/1991 | Sakashita et al. | |
| 5,009,973 | A | 4/1991 | Yoshida et al. | |
| 5,137,796 | A | 8/1992 | Takiguchi et al. | |
| 5,141,831 | A | 8/1992 | Itoh et al. | |
| 5,262,267 | A | 11/1993 | Takiguchi et al. | |
| 5,965,312 | A * | 10/1999 | Nakazawa et al. | 430/108.6 |
| 5,995,785 | A * | 11/1999 | Kato et al. | 399/127 |
| 6,077,635 | A | 6/2000 | Okado et al. | |
| 6,205,301 | B1 * | 3/2001 | Shigeta et al. | 399/66 |
| 6,444,384 | B2 * | 9/2002 | Kawamorita | G03G 5/05 430/132 |
| 7,169,525 | B2 * | 1/2007 | Sugiura et al. | 430/108.4 |
| 7,177,570 | B2 * | 2/2007 | Nagame et al. | 399/159 |
| 2001/0033983 | A1 * | 10/2001 | Ohno et al. | 430/110.3 |
| 2003/0082470 | A1 * | 5/2003 | Asano et al. | 430/60 |
| 2003/0190539 | A1 * | 10/2003 | Niimi | 430/58.7 |
| 2004/0146309 | A1 * | 7/2004 | Shu et al. | 399/27 |
| 2005/0058924 | A1 * | 3/2005 | Miyakawa | 430/108.6 |
| 2005/0084787 | A1 | 4/2005 | Kobayashi et al. | |
| 2006/0204290 | A1 * | 9/2006 | Omata | 399/309 |
| 2007/0134577 | A1 * | 6/2007 | Tong et al. | 430/108.1 |
| 2007/0217820 | A1 | 9/2007 | Shigemori et al. | |

(Continued)

FOREIGN PATENT DOCUMENTS

| | | | |
|---|---|---|---|
| EP | 0918259 A2 * | 5/1999 | G03G 5/0517 |
| JP | 1-221755 | 9/1989 | |

(Continued)

OTHER PUBLICATIONS

English language machine translation of JP 2002-107970 (Apr. 2002).*
English language machine translation of JP 2010-185955 (Aug. 2010).*
Office Action in corresponding Japanese application No. 2011-034968 dated Jul. 8, 2014.
Information Offer Form in corresponding Japanese Application No. JP2011-034968, dated Feb. 12, 2014. (w/English translation).

*Primary Examiner* — Christopher Rodee

(74) *Attorney, Agent, or Firm* — Oblon, McClelland, Maier & Neustadt, L.L.P.

(57) ABSTRACT

The invention is to provide an image forming apparatus and an electrophotographic cartridge, which are free from problems of cleaning failure, filming, soiling, residual images (ghosts), fogging, density reduction, noise and the like and which can provide high-definition images even when a toner having a small particle size and having a high degree of circularity is used and even when a photoreceptor having a small outer diameter is used. An image forming apparatus comprising: an electrophotographic photoreceptor containing a conductive support and a photosensitive layer on the conductive support, a charging unit for charging the electrophotographic photoreceptor, an imagewise exposing unit for imagewise exposing the charged electrophotographic photoreceptor to form an electrostatic latent image thereon, a developing unit for developing the electrostatic latent image with a toner, and a transferring unit for transferring the toner from the electrophotographic photoreceptor to a receiving unit, wherein the outer diameter of the electrophotographic photoreceptor is 20 mm or less, the photosensitive layer contains a polyarylate resin, and the toner satisfies the specific requirements (1) and (2).

11 Claims, 3 Drawing Sheets

(56) References Cited

U.S. PATENT DOCUMENTS

| | | | | |
|---|---|---|---|---|
| 2008/0131797 | A1* | 6/2008 | Ishikawa et al. | 430/48 |
| 2008/0187847 | A1* | 8/2008 | Hamasaki et al. | 430/56 |
| 2009/0232551 | A1 | 9/2009 | Nagao et al. | |
| 2010/0150608 | A1 | 6/2010 | Mitsumori et al. | |
| 2010/0183332 | A1* | 7/2010 | Zhao et al. | 399/159 |
| 2011/0038650 | A1 | 2/2011 | Kaneko et al. | |

FOREIGN PATENT DOCUMENTS

| | | | |
|---|---|---|---|
| JP | 2-000877 | | 1/1990 |
| JP | 2-284158 | | 11/1990 |
| JP | 3-075660 | | 3/1991 |
| JP | 5-119530 | | 5/1993 |
| JP | 6-289648 | | 10/1994 |
| JP | 06348045 | A * | 12/1994 |
| JP | 08-166755 | | 6/1996 |
| JP | 09-127838 | | 5/1997 |
| JP | 09-179467 | | 7/1997 |
| JP | 10-186686 | | 7/1998 |
| JP | 11-174731 | | 7/1999 |
| JP | 2001-134005 | | 5/2001 |
| JP | 2001-175024 | | 6/2001 |
| JP | 2002107970 | A * | 4/2002 |
| JP | 2002-323780 | | 11/2002 |
| JP | 2002-323785 | | 11/2002 |
| JP | 2003-202684 | | 7/2003 |
| JP | 2003-255567 | | 9/2003 |
| JP | 2004-045948 | | 2/2004 |
| JP | 2005-215042 | | 8/2005 |
| JP | 2007-108300 | | 4/2007 |
| JP | 2007-122036 | | 5/2007 |
| JP | 2007-213050 | | 8/2007 |
| JP | 2008-026578 | | 2/2008 |
| JP | 2008-304727 | | 12/2008 |
| JP | 2009-37229 | | 2/2009 |
| JP | 2009-104126 | | 5/2009 |
| JP | 2010185955 | A * | 8/2010 |
| WO | WO 2004/088431 | | 10/2004 |
| WO | WO 2005/119373 | A1 | 12/2005 |
| WO | WO 2008153084 | A1 * | 12/2008 |

* cited by examiner

IMAGE FORMING APPARATUS AND ELECTROPHOTOGRAPHIC CARTRIDGE

FIELD OF THE INVENTION

The present invention relates to an image forming apparatus and an electrophotographic cartridge for use in copying machines, printers, etc.

BACKGROUND OF THE INVENTION

In recent years, applications of image forming apparatus such as electrophotographic copying machines and others have been expanding, and there has been an increasing demand in the market for a higher level of image quality. Particularly, with respect to office documents and others, in addition to the development of image copying techniques and latent image-forming techniques at the time of inputting, also at the time of outputting, the types of hieroglyphic characters have become richer and more refined, and due to dissemination and development of presentation software, reproducibility of latent images of extremely high quality is desired so that there will be few defects or unsharpness in printed images. Particularly, as the developer to be used in a case where latent images on a latent image substrate constituting an image forming apparatus are line images of 100 μm or less (about 300 dpi or more), a conventional toner having a large particle size is usually poor in reproducibility of such fine lines, whereby the sharpness of line images has not yet been sufficient.

For improving image quality, it is effective to reduce the particle size of toner, and a chemical toner is suitable for this technique, and various types of toners have been developed (Patent References 1 to 12). In particular, chemical toners having a narrow particle size distribution can be produced and their charging properties can be homogenized, and therefore, chemical toners are advantageous for electrophotographic process.

DOCUMENT LIST

[Patent Reference 1] JP-A 2-284158
[Patent Reference 2] JP-A 5-119530
[Patent Reference 3] JP-A 1-221755
[Patent Reference 4] JP-A 6-289648
[Patent Reference 5] JP-A 2001-134005
[Patent Reference 6] JP-A 11-174731
[Patent Reference 7] JP-A 11-362389
[Patent Reference 8] JP-A 2-000877
[Patent Reference 9] JP-A 2004-045948
[Patent Reference 10] JP-A 2003-255567
[Patent Reference 11] WO2004-088431
[Patent Reference 12] JP-A 3-75660

Recently, use of electrophotographic printers and MFP has become toward SOHO use and domestic use; and with the increase in the demand for downsizing the appliances more than before, the stream of downsizing of printers is being accelerated. When the outer diameter of appliances is reduced, then cleaning them with a cleaning blade would become difficult therefore bringing about troubles of cleaning failure, filming, etc. In particular, this tendency is remarkable in appliances having an outer diameter of 20 mm or less. In addition, reduction in the particle size of toner wound promote the tendency, and therefore, mismatching between toner and photoreceptor is an important subject.

Further, in a case where a linear pressure of a cleaning blade is increased for bettering the cleaning capability thereof, there may occur a problem in that the printer may produce an unpleasant noise and abnormal noise.

SUMMARY OF THE INVENTION

The present invention has been made in consideration of the above background art, and its object is to provide an image forming apparatus and an electrophotographic cartridge, which are free from problems of cleaning failure, filming, soiling, residual images (ghosts), fogging, density reduction, noise and the like and which can therefore provide high-definition images even when a toner having a small particle size and having a high degree of circularity is used and even when a photoreceptor having a small outer diameter is used.

The present inventors have made assiduous studies in consideration of the current situation as above and, as a result, have found that, when an electrophotographic photoreceptor having an outer diameter of 20 mm or less and a toner having a small particle size and having a high degree of circularity are used, and when a polyarylate resin is used as the surface layer of the electrophotographic photoreceptor, then high-definition images with no problem can be formed.

Specifically, the inventors have found that the above problems can be solved by the following constitutions <1> to <12>:

<1> An image forming apparatus comprising:

an electrophotographic photoreceptor containing a conductive support and a photosensitive layer on the conductive support, a charging unit for charging the electrophotographic photoreceptor, an imagewise exposing unit for imagewise exposing the charged electrophotographic photoreceptor to form an electrostatic latent image thereon, a developing unit for developing the electrostatic latent image with a toner, and a transferring unit for transferring the toner from the electrophotographic photoreceptor to a receiving unit, wherein:

the outer diameter of the electrophotographic photoreceptor is 20 mm or less, the photosensitive layer contains a polyarylate resin, and the toner satisfies the following (1) and (2):

(1) the volume median diameter (Dv50)(Dv50) thereof is from 4.0 μm to 7.0 μm, and (2) the average degree of circularity thereof is 0.93 or more.

<2> The image forming apparatus as described in the item <1>, wherein the electrophotographic photoreceptor is brought into contact with a cleaning blade in a counter-abutting system, in which a lubricant is applied to the site of the cleaning blade to be brought into contact with the electrophotographic photoreceptor.

<3> The image forming apparatus as described in the item <1> or <2>, wherein the photosensitive layer contains a charge-transporting substance having a molecular weight of 460 or less.

<4> The image forming apparatus as described in any one of the items <1> to <3>, wherein the photosensitive layer contains a charge transporting substance having an energy level of a highest occupied molecular orbital (HOMO), E_homo, of −4.67 eV or more, as obtained as a result of geometry optimization calculation by a density functional calculation B3LYP/6-31G(d,p).

<5> The image forming apparatus as described in any one of the items <1> to <4>, wherein the polyarylate resin has a repeating structure of the following formula (1):

(1)

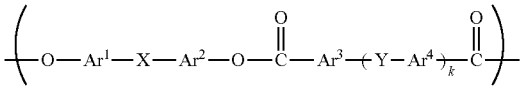

wherein $Ar^1$ and $Ar^2$ each independently represent an arylene group optionally having a substituent; $Ar^3$ and $Ar^4$ each independently represents an arylene group optionally having a substituent; X and Y each independently represent a single bond or a divalent linking group; k indicates an integer of 0 or more.

<6> The image forming apparatus as described in the item <5>, wherein in the formula (1), Y is an oxygen atom and k=1.

<7> An electrophotographic cartridge comprising: an electrophotographic photoreceptor containing a conductive support and a photosensitive layer on the conductive support; and at least any of a charging unit for charging the electrophotographic photoreceptor, an imagewise exposing unit for imagewise exposing the charged electrophotographic photoreceptor to form an electrostatic latent image thereon and a developing unit for developing the electrostatic latent image with a toner, wherein:

the outer diameter of the electrophotographic photoreceptor is 20 mm or less, the photosensitive layer contains a polyarylate resin, and the toner satisfies the following (1) and (2):

(1) the volume median diameter (Dv50)(Dv50) thereof is from 4.0 μm to 7.0 μm, and (2) the average degree of circularity thereof is 0.93 or more.

<8> The electrophotographic cartridge as described in the item <7>, wherein the electrophotographic photoreceptor is brought into contact with a cleaning blade in a counter-abutting system, in which a lubricant is applied to the site of the cleaning blade to be brought into contact with the electrophotographic photoreceptor.

<9> The electrophotographic cartridge as described in the item <7> or <8> claimed in claim 7, wherein the photosensitive layer contains a charge-transporting substance having a molecular weight of 460 or less.

<10> The electrophotographic cartridge as described in any one of the items <7> to <9>, wherein the photosensitive layer contains a charge-transporting substance having an energy level of a highest occupied molecular orbital (HOMO), E_homo, of −4.67 eV or more, as obtained as a result of geometry optimization calculation by a density functional calculation B3LYP/6-31G(d,p).

<11> The electrophotographic cartridge as described in any one of the items <7> to <10>, wherein the polyarylate resin has a repeating structure of the following formula (1):

(1)

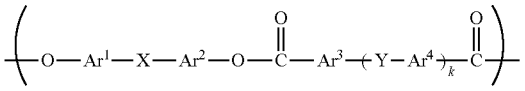

wherein $Ar^1$ and $Ar^2$ each independently represent an arylene group optionally having a substituent; $Ar^3$ and $Ar^4$ each independently represents an arylene group optionally having a substituent; X and Y each independently represent a single bond or a divalent linking group; k indicates an integer of 0 or more.

<12> The electrophotographic cartridge as described in the item <11>, wherein in the formula (1), Y is an oxygen atom and k=1.

According to the invention, an electrophotographic photoreceptor having an outer diameter of 20 mm or less is used and a toner having a small particle size and a high degree of circularity is used, and in addition, a polyarylate resin is used in the photosensitive layer of the electrophotographic photoreceptor; and accordingly, the invention provides high-definition images without problems of cleaning failure, filming, soiling, residual images (ghosts), fogging, density reduction and noise generation.

DESCRIPTION OF THE REFERENCE NUMERALS AND SIGNS

Figure 1:
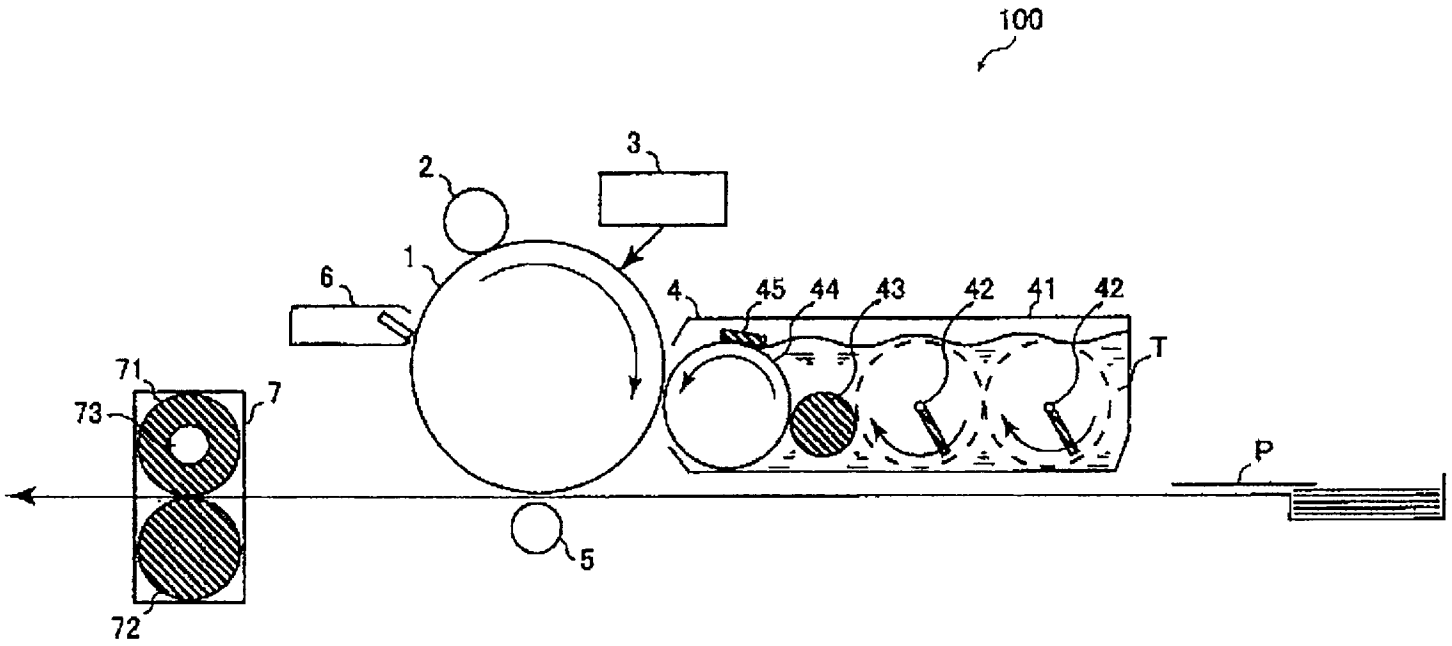
FIG. 1 is a schematic view showing the essential constitution of an embodiment of the image forming apparatus of the invention.

1 Photoreceptor
2 Charging Device (charging roller)
3 Exposure Device
4 Development Device
5 Transfer Device
6 Cleaning Device
7 Fixation Device
41 Development Tank
42 Agitator
43 Feed Roller
44 Development Roller
45 Control Member
71 Upper Fixation Member (pressure roller)
72 Lower Fixation Member (fixation roller)
73 Heating Device
100 Image Forming Apparatus
T Toner
P Recording Paper

DETAILED DESCRIPTION OF THE INVENTION

The invention is described hereinunder; however, the invention is not limited to the embodiments shown below. Not overstepping the spirit and the scope thereof, the invention may be changed and modified in any desired manner.

The image forming apparatus of the invention comprises an electrophotographic photoreceptor, a charging unit for charging the electrophotographic photoreceptor, an imagewise exposing unit for imagewise exposing the charged electrophotographic photoreceptor to form an electrostatic latent image thereon, a developing unit for developing the electrostatic latent image with a toner, and a transferring unit for transferring the toner from the electrophotographic photoreceptor to a receiving unit. The electrophotographic photoreceptor has an outer diameter of 20 mm or less and contains a polyarylate resin in the photosensitive layer thereof, and the toner satisfies predetermined requirements.

The toner and the electrophotographic photoreceptor for use in the invention are described in detail.

<Toner (Toner for Development of Statically Charged Image)>

The toner for development of statically charged image (hereinafter this may be abbreviated as "toner") for use in the image forming apparatus of the invention satisfies the following (1) and (2). Preferably, in addition, the toner satisfies the following (3) and (4).

(1) The volume median diameter (Dv50)(Dv50) thereof is from 4.0 μm to 7.0 μm.

(2) The average degree of circularity thereof is 0.93 or more.

(3) The relationship between the volume median diameter (Dv50) of the toner and the percentage by number (Dns) of toner particles having a particle diameter of from 2.00 μm to 3.56 μm satisfies Dns≤0.233EXP(17.3/Dv50).

(4) The number variation coefficient is 24% or less.

The requirements (1) to (4) are described in detail hereinunder.

<Regarding (1)>

The volume median diameter (Dv50) of the toner in the invention is generally from 4.0 μm to 7.0 μm. Within the range, the toner may be enough to provide high-quality images. For providing high-quality images, the toner having Dv50 of 6.8 μm or less could exhibit a more remarkable effect. From the viewpoint of reducing the generation of fine powder, Dv50 is preferably 4.5 μm or more, more preferably 5.0 μm or more, even more preferably 5.4 μm or more.

The volume median diameter (Dv50) of the toner may be measured according to the method described in the section of Examples, and is defined as one measured in that manner. In case where an external additive is fixed or adhered to the surface of the matrix particles of the toner in the invention, the toner with the additive as such it taken as the sample for analysis.

Also for the average degree of circularity, the percentage by number (Dns) of toner particles having a particle diameter of from 2.00 μm to 3.56 μm, and the number variation coefficient, in case where an external additive is fixed or adhered to the surface of the matrix particles of the toner for use in the invention, the toner with the additive as such it taken as the sample for analysis.

<Regarding (2)>

The average degree of circularity of the toner in the invention is generally 0.93 or more, preferably 0.94 or more. The average degree of circularity of the toner may be measured according to the method described in the section of Examples, and is defined as one measured in that manner.

In general, a toner having a higher degree of circularity could secure improvement in the transfer efficiency of the toner. Spherical toner particles having a high degree of circularity could be hung up little between them or on various members, and therefore their mechanical shear on a charging roller is small and they deform slightly on their surfaces. In addition, since the flowability of the toner matrix itself is high, the flowability of the toner hardly varies even when the amount of the inorganic powder externally added thereto changes.

To that effect, the spherical toner has a morphology factor of little toner degradation. Further, since the spherical toner is excellent in releasability from a photosensitive drum, it is excellent in transfer efficiency is enough to secure image density, and in addition, the residual toner after transfer may be reduced. For these reasons, as the toner for use in a high-speed printer, preferred is a toner having a high degree of circularity.

On the other hand, in a toner having a high degree of average circularity, the percentage of weakly charged toner WST [%], as measured with an E-SPART analyzer, tends to increase and the toner of the type may undesirably scatter. Further, when the residual toner after transfer is scraped away with a cleaning blade, the toner may readily pass through the cleaning blade and may therefore soil images. In high-speed printing, the phenomenon would be more remarkable. Accordingly, the average degree of circularity of the toner in the invention is preferably 0.98 or less, more preferably 0.96 or less.

In addition, a toner having a small particle size and a high degree of circularity would be difficult to scrape with a cleaning blade and the toner may readily pass through a cleaning blade, and therefore, the particle size distribution of the toner must be controlled in accordance with the degree of circularity thereof.

<Regarding (3)>

Preferably, the relationship between the volume median diameter (Dv50) of the toner and the percentage by number (Dns) of toner particles having a particle diameter of from 2.00 μm to 3.56 μm satisfies:

$$Dns \leq 0.233\mathrm{EXP}(17.3/Dv50).$$

In the invention "EXP" means "exponential". In other words, it is the base of natural logarithm, and the right hand is the index. This formula may be referred to as "formula of the requirement (3)". The percentage by number (Dns) is measured according to the method described in the section of Examples, and is defined as one measured in that manner.

As the meaning thereof, the relational formula (formula of the requirement (3)) indicates that the amount of fine powder increases with the reduction in the volume median diameter (Dv) of toner; and in a region where Dv is 4.5 μm or less, the value of Dv comes near to a particle diameter region of from 2.00 μm to 3.56 μm, and therefore the value of Dns exponentially increases. The region of from 2.00 μm to 3.56 μm is a region expressed by the channel defined by Coulter Counter's Multisizer III.

The particles falling within a particle diameter range of from 2.00 μm to 3.56 μm are those to be specifically excluded from the region of the volume median diameter, from 4.0 to 7.0 μm of the toner particles in the invention, and the grounds follow experimental results.

The toner satisfying the above particle size distribution requirement (3) gives high-quality images and, in addition, even when used in a high-speed printer, the toner soils little and retards residual images (ghosts) and blurring (solid-image follow-up ability) and has excellent cleaning properties. In addition, since the particle size distribution of the toner is sharp, the electrostatic charge distribution thereof is also sharp, and therefore, the particles having a small electrostatic charge do not soil the white part of images and do not scatter to soil the inside of the apparatus. Further, the particles having a large electrostatic charge do not adhere to the members of layer-regulating blades, rollers and others, as kept unused for development, and do not cause image defects such as streaks, blurring, etc.

Specifically, based on the boundary of the above requirement (3), the amount of fine powder has an influence on mage. In case where the value of Dns is more than the right-hand member, fine powder causes image defects. For example, fine powder would deposit on a cleaning blade, therefore causing image defects of residual images, blurring, soiling, etc.

The image forming apparatus is specifically so designed that particles having a specific electrostatic charge could be transferred, and therefore, in electrostatic development, the particles having such a specific electrostatic charge are preferentially transferred onto OPC. Particles having an electrostatic charge more than a specific level may adhere to and soil machine parts and others, and may worsen the flowability of the toner. On the other hand, particles having an electrostatic charge less than a specific level would remain in a cartridge to soil machine parts and others.

The electrostatic charge of toner has a correlation with the toner particle sizes when the toner composition is the same. In general, a toner having a smaller particle size may have a higher electrostatic charge per unit weight, but a toner having a larger particle size may have a lower electrostatic charge per unit weight. Specifically, presence of many toner particles having a small particle size results in too much increase in the electrostatic charge, therefore causing toner adhesion to machine parts and others and worsening toner flowability. Use of the toner in the invention prevents the above-mentioned "selective development". In the invention, the toner is defined to have a particle size of 3.56 μm or less. The value 3.56 μm is defined for the channels of the particle sizer. On the other hand, the lowermost limit is defined as 2.00 μm for the reason of the detection limit of the particle sizer.

For the percentage by number (Dns) of toner particles, the particle diameter is defined to be from 2.00 μm to 3.56 μm , and the reason is as follows. The lowermost limit is the detection limit of the particle sizer used in measuring the toner particle size in the invention; and the uppermost limit is the critical value of the effect obtained from the results in Examples. Specifically, when the percentage by number of toner particles having a particle size larger than 3.56 μm is employed, then the toner capable of exhibiting the effect of the invention could not be clearly differentiated from the other toner not exhibiting the effect.

Regarding the relationship between Dv50 and Dns, preferably, the toner satisfies Dns≤0.110EXP(19.9/Dv50) from the viewpoint of the above-mentioned effect of the invention.

On the other hand, from the viewpoint of securing good producibility with good production yield, the relationship between Dv50 and Dns satisfies the following:

$$0.0517\mathrm{EXP}(22.4/Dv50) \leq Dns \quad (3')$$

Preferably, the toner for use in the invention has Dns of 6% or less by number, as capable of providing better-quality images not soiling the image forming apparatus. Regarding the combination of the preferred particle size region of Dv50, for example, "Dv50 of 4.5 μm or more" and the condition of "Dns of 6% or less by number", more preferably, both the two are satisfied simultaneously. Within the range, the toner can provide high-quality images not detracting from the production yield from the viewpoint of the producibility, and does not soil the image forming apparatus; and accordingly, there may be provided a toner that hardly brings about "selective development".

<Regarding (4)>

The number variation coefficient of the toner in the invention is 24.0% or less, preferably 22.0% or less, more preferably 20.0% or less, even more preferably 19.0% or less. In general, a higher number variation coefficient means a broader electrostatic charge distribution, therefore as the case may be, causing image defects owing to charging failure. In addition, the toner of the type may adhere to and soil toner-related members and may scatter and soil them. Accordingly, the number variation coefficient is preferably smaller. On the other hand, from the industrial viewpoint, the number variation coefficient is preferably larger than 0%, more preferably 5% or more.

The number variation coefficient (%) is measured according to the method described in the section of Examples, and is defined as one measured in that manner.

The toner in the invention must indispensably satisfy the above (1) and (2). In addition, preferably, the toner satisfies (3) and (4). Conventional toners do not satisfy any of (1) to (4). The reason is because of the following relationship. Specifically, when the fine powder is reduced as much as possible (or that is, when (3) is to be satisfied), then a coarse powder would increase and the number variation coefficient increases (or that is, (4) is not satisfied).

When the toner is intended to be rounded by physical impact (or that is, when (2) is to be satisfied), then fine powder generation would be promoted (or that is, (3) is not satisfied). Further, when the toner is intended to be rounded by thermal fusion (or that is, when (2) is to be satisfied), then toner particles would fuse together to cause coarse powder generation (or that is, (4) is not satisfied).

<Electrostatic Charge Distribution>

As compared with conventional toner, the toner in the invention has an extremely sharp electrostatic charge distribution. As described above, the electrostatic charge distribution has a correlation with the particle size distribution of toner. A case having a broad particle size distribution like a conventional toner has a broad electrostatic charge distribution. When a toner has a broad electrostatic charge distribution, the percentage of poorly charging particles or highly charging particles that could not be controlled under the developing condition of the toner-using apparatus may increase, therefore causing various image defects. For example, particles having a small electrostatic charge would cause soiling in the white part of images, or would scatter inside the apparatus to cause soiling; while particles having a large electrostatic charge may adhere to the members of layer-regulating blades, rollers and others in the development tank, as kept unused for development, and may fuse to cause image defects such as streaks, blurring, etc.

In general, in planning a development process in an image forming apparatus, the development process condition is defined so as to adapt to the mean value of the toner electrostatic charge; and the toner of which the electrostatic charge greatly oversteps from the mean value may scatter or may cause image defects such as streaks, blurring and the like in the image forming apparatus, or that is, there may be produced a situation where the toner and the apparatus do not well match with each other. On the other hand, when the electrostatic charge distribution is sharp as in the invention, the developability may be controlled by bias regulation or the like, and sharp images could be formed without soiling the parts of the image forming apparatus.

"Standard deviation of electrostatic charge" that is one numerical parameter to indicate the "electrostatic charge distribution" of the toner in the invention is preferably from 1.0 to 2.0, more preferably 1.8 or less, even more preferably 1.5 or less. When more than the uppermost limit, the toner may adhere to layer-regulatory blades and could not be transferred, and the adhered toner would block the other toner being transferred, therefore as the case may be, the members inside the image forming apparatus would be thereby soiled. When less than the lowermost limit, it would be unfavorable from the viewpoint of the industrial standpoint. The lowermost limit is more preferably 1.3 or more.

Since the toner in the invention has a sharp electrostatic charge distribution, there is little soiling in the inside of the image forming apparatus (toner scattering in the apparatus) owing to charging-failed toner therein. The effect is especially remarkable in a high-speed image forming apparatus where the development process speed to the electrostatic latent image carrier therein is 100 mm/sec or more.

In addition, since the toner in the invention has a sharp electrostatic charge distribution, its developability is extremely good, and there are few toner particles to deposit inside the apparatus, without used for development. This effect is especially remarkable in an image forming apparatus where the toner consumptions peed is high. Concretely, the toner is used for the image forming apparatus satisfying the following formula (G) for sufficiently exhibiting the above-mentioned effect of the invention.

Number of copying sheets for guaranteed life of the developing machine to be filled with the developer×print ratio≥400 (sheets) (G)

In the formula (G), "print ratio" is represented by the value computed by dividing the sum total of the printed part area by the total area of the print medium of the printed matter for determining the number of copying sheets for guaranteed life that indicates the performance of the image forming apparatus. For example, the "print ratio" in terms of the percentage by print of "5%" is "0.05".

In addition, since the particle size distribution of the toner in the invention is extremely sharp, the reproducibility thereof on a latent image is extremely good. Accordingly, in particular, in case where the toner is used in an image forming apparatus of which the resolution on the electrostatic latent image carrier is 600 dpi or more, the effect of the invention can be sufficiently exhibited. "Resolution on electrostatic latent image carrier" has the same meaning as that of "resolution of apparatus".

In the image forming apparatus of the invention, the toner satisfying all the above-mentioned (1) to (4) is used. Using the toner of the type, the apparatus can provide high-resolution images.

<Toner Constitution>

The materials constituting the above-mentioned toner are described in detail hereinunder.

The toner for use in the image forming apparatus of the invention comprises a binder resin, a colorant, a wax, an external additive and the like as suitably selected and mixed.

The binder resin may be any one suitably selected from those known as usable in toner. For example, it includes styrenic resins, vinyl chloride resins, rosin-modified maleic acid resins, phenolic resins, epoxy resins, saturated or unsaturated polyester resins, polyethylene resins, polypropylene resins, ionomer resins, polyurethane resins, silicone resins, ketone resins, ethylene/acrylate copolymers, xylene resins, polyvinyl butyral resins, styrene/alkyl acrylate copolymers, styrene/alkyl methacrylate copolymers, styrene/acrylonitrile copolymers, styrene/butadiene copolymers, styrene/maleic anhydride copolymers, etc. One or more those resins may be used here either singly or as combined.

<Colorant>

The colorant to constitute the toner for use in the image forming apparatus of the invention any one suitably selected from those known as usable in toner. For example, it includes yellow pigments, magenta pigments and cyan pigments mentioned below. As the black pigment for the colorant, the yellow pigment/magenta pigment/cyan pigment mentioned below may be mixed to be black.

Of t hose, carbon black as a black pigment exist as aggregates of extremely fine primary particles; and when it is dispersed as a pigment dispersion, the particles may readily re-aggregate to form coarse particles. The degree of re-aggregation of carbon black particles has some correlation with the amount of the impurities (the amount of the undecomposed remaining organic matter); and when the amount of the impurities is large, then the dispersed colorant tends to greatly re-aggregate after dispersion to form many coarse particles. Regarding the quantitative evaluation of the amount of the impurities, the UV absorbance of the toluene extract of carbon black, as measured according to the method mentioned below, is preferably 0.05 or less, more preferably 0.03 or less. In general, carbon black prepared according to a channel method tends to have a large amount of impurities, and therefore, for use in the invention, carbon black prepared according to a furnace method is preferred.

The UV absorbance ($\lambda c$) of carbon black is determined according to the following method. First, 3 g of carbon black is fully dispersed in 30 mL of toluene, and subsequently, the mixture is filtered through No. 5 C filter paper. Next, the filtrate is put into a quartz cell of which the light absorbing part is 1 cm square, and its absorbance ($\lambda s$) at a wavelength of 336 nm is measured with a commercially-available UV spectrophotometer. In the same manner, the absorbance ($\lambda o$) of toluene alone is measured as a reference. The UV absorbance of the carbon black is $\lambda c=\lambda s-\lambda o$. As the commercially-available spectrophotometer, for example, used is Shimadzu's UV Spectrophotometer (UV-3100PC), etc.

As the yellow pigment, usable are compounds such as typically condensed azo compounds, isoindolinone compounds, etc. Concretely, preferred are C.I. Pigment Yellow 12, 13, 14, 15, 17, 62, 74, 83, 93, 94, 95, 109, 110, 111, 128, 129, 147, 150, 155, 168, 180, 194, etc.

As the magenta pigment, usable here are condensed azo compounds, diketopyrrolopyrrole compounds, anthraquinones, quinacridone compounds, base dye lake compounds, naphthol compounds, benzimidazolone compounds, thioindigo compounds, perylene compounds. Concretely, preferred are C.I. Pigment Red 2, 3, 5, 6, 7, 23, 48:2, 48:3, 48:4, 57:1, 81:1, 122, 144, 146, 166, 169, 173, 184, 185, 202, 206, 207, 209, 220, 221, 238, 254, C.I. Pigment Violet 19, etc. Above all, more preferred are quinacridone pigments of C.I. Pigment Red 122, 202, 207, 209, and Pigment Violet 19. Of those quinacridone pigments, even more preferred is a compound of C.I. Pigment Red 122.

As the cyan pigment, usable here are copper phthalocyanine compounds and their derivatives, anthraquinone compounds, base dye lake compounds, etc. Concretely, preferred are C.I. Pigment Blue 1, 15, 15:1, 15:2, 15:3, 15:4, 60, 62, 66, etc.; and C.I. Pigment Green 7, 36, etc.

<Wax>

Preferably, wax is incorporated in the toner for use in the image forming apparatus of the invention for making the toner lubricative. Wax may be added to polymer primary particles or resin fine particles to be mentioned below. Not specifically defined, wax may be any one having lubricity. Concretely, there may be mentioned olefinic waxes such as low-molecular-weight polyethylene, low-molecular-weight polypropylene, polyethylene copolymer, etc.; paraffin wax;

long-chain aliphatic group-having ester waxes, such as behenyl behenate, montanates, stearyl stearate, etc.; vegetable waxes such as hydrogenated castor oil, carnauba wax, etc.; long-chain alkyl group-having ketones such as distearyl ketone, etc.; alkyl group-having silicones; higher fatty acids such as stearic acid, etc.; long-chain aliphatic alcohols such as eicosanol, etc.; polyalcohol carboxylates or partial carboxylates obtained from polyalcohols such as glycerin, pentaerythritol or the like and ling-chain fatty acids; high fatty acid amides such as oleamide, stearamide, etc.; low-molecular-weight polyesters, etc.

Of those waxes, preferred are the waxes having a melting point of not lower than 30° C. from the viewpoint of improving the toner fixability, more preferred are those having a melting point of not lower than 40° C., even more preferred are those having a melting point of not lower than 50° C. Also preferred are those having a melting point of not higher than 100° C., more preferably not higher than 90° C., even more preferably not higher than 80° C. When the melting point thereof is too low, then the wax may bleed out on the surface to be sticky after toner fixation; but when the melting point thereof is too high, the low temperature toner fixability may be poor. Regarding the compound type of waxes, preferred are ester waxes produced from aliphatic carboxylic acids and monoalcohols or polyalcohols; and more preferred are such ester waxes having a carbon number of from 20 to 100.

One or more those waxes may be used here either singly or as combined. Depending on the toner fixation temperature, the melting point of the wax compound may be suitably selected. The amount of wax to be used is preferably from 4 to 20 parts by weight relative to 100 parts by weight of the toner, more preferably from 6 to 18 parts by weight, even more preferably from 8 to 15 parts by weight. In general, with the increase in the amount of wax to be used, the aggregation control of the toner may worsen and the toner particle size distribution tends to be broad. In case where the volume medium diameter (Dv50) of the toner is 7 μm or less, or that is, in case where the toner has a small particle size, and when the amount of wax to be used increases, then the wax may greatly bleed out on the toner surface and the toner storage stability may worsen. The toner for use in the image forming apparatus of the invention is a small-size toner having a sharp particle size distribution so as not to cause degradation of the toner properties, as compared with conventional toners.

<External Additives>

Any known external additive may be added to and incorporated in the surfaces of the toner matrix particles, for controlling the flowability and the developability of the toner for use in the invention. The external additive includes metal oxides and hydroxides such as alumina, silica, titania, zinc oxide, zirconium oxide, cerium oxide, talc, hydrotalcite, etc.; metal titanates such as calcium titanate, strontium titanate, barium titanate, etc.; nitrides such as titanium nitride, silicon nitride, etc.; carbides such as titanium carbide, silicon carbide, etc.; organic particles such as acrylic resin, melamine resin, etc. Different types of these may be combined. Above all, preferred are silica, titania, alumina; and for example, more preferred are those surface-treated with a silane coupling agent, a silicone oil or the like. Preferably, the particles have a mean primary particle diameter falling within a range of from 1 to 500 nm, more preferably within a range of from 5 to 100 nm. Within the above-mentioned particle diameter range, small-size particles and large-size particles may be combined preferably.

The total amount of the external additive to be incorporated is preferably within a range of from 0.05 to 10 parts by weight relative to 100 parts by weight of the toner matrix particles, more preferably from 0.1 to 5 parts by weight.

<Toner Production Method>

The toner production method in the invention is not specifically defined. Briefly, the toner may be produced according to a pulverizing method or a method of forming particles in a water-base medium (this may be hereinafter abbreviated as "wet method"). As the wet method, preferred is a radical polymerization method in a water-base medium, such as a suspension polymerization method, an emulsion polymerization aggregation method or the like (hereinafter this may be abbreviated as "polymerization method"; and the obtained toner may be abbreviated as "polymerization toner"), or a chemical pulverizing method such as typically a melt suspension method, etc. The method of defining the particle size of the toner to fall within the specific range in the invention is not specifically defined. For example, in the suspension polymerization method, a high shearing force may be given to the system in the step of forming polymerizing monomer drops, or the amount of the dispersion stabilizer or the like to be added may be increased.

In case where the toner is produced according to a pulverizing method, in general, fine powder may form, and therefore, the method requires a classification step. In particular, in order to satisfy the requirement for the toner particle size in the invention, some superfluous classification operation may be necessary, by which the production yield would be greatly lowered; and therefore, from industrial viewpoint, the operation is unfavorable. However, the toner for use in the image forming apparatus of the invention does not exclude the pulverized toner.

On the other hand, from the viewpoint that the classification step of forming fine powder is not indispensable, the toner for use in the invention is preferably produced according to a wet method of forming toner particles in a water-base medium.

As the method of producing the toner having the specific particle size range for use in the invention, usable is any production method of a pulverizing method, a polymerization method such as a suspension polymerization method or an emulsion polymerization aggregation method, or a chemical pulverizing method such as typically a melt suspension method or the like. In the "pulverizing method", the "suspension polymerization method" or the "chemical pulverizing method such as typically melt suspension method", when the mean particle size of the produced toner particles is reduced for the purpose of controlling large-size toner matrix particles to small-size ones, then the proportion of small-size particles tends to increase; and therefore in the method, excessive load must be forcedly given to the system in the classification step. As opposed to this, the emulsion polymerization aggregation method may produce a toner having a regulated particle size distribution and having a relatively sharp particle size distribution, not requiring any additional step such as a classification step or the like for the purpose of controlling small-size toner matrix particles to large-size ones. Accordingly, for the above-mentioned reasons, the emulsion polymerization aggregation method is especially preferred for producing the toner for use in the invention.

<Toner Production Method (Emulsion Polymerization Aggregation Method)>

For forming particles in a water-base medium, preferred is a method of producing particles through polymerization in a water-base medium, from the viewpoint of producing little fine powder; and more preferred is an emulsion polymerization aggregation method for producing particles. The method is described below in detail.

In case where a toner is produced according to an emulsion polymerization aggregation method, in general, the method comprises a polymerization step, an aggregation step, a ripening step, and a washing/drying step. Briefly, in general, a dispersion of a colorant, a charge control agent, a wax and the like is mixed in a dispersion that contains polymer primary particles obtained through emulsion polymerization whereby the primary particles in the dispersion are aggregated to give core particles, and if desired, a resin fine particles or the like are fixed or adhered thereto, the thus-fused particles are washed and dried to give toner matrix particles.

The materials to be used in the steps of the emulsion polymerization aggregation method are described in detail.

(Monomer)

For the binder resin to constitute the polymer primary particles for use in the emulsion polymerization aggregation method, one or more polymerizing monomers capable of polymerizing in an emulsion polymerization method may be suitably used. The polymerizing monomer includes, for example, "polar group-having polymerizing monomer" such as "acid group-having polymerizing monomer" (this may be simply referred to as "acid monomer"), "basic group-having polymerizing monomer" (this may be simply referred to as "basic monomer"), and the like (this may be simply referred to as "polar monomer"), and "polymerizing monomer having none of an acid group and a basic group" (hereinafter this may be referred to as "other monomer"); and preferably, any of these is used as the polymerizing monomer for the material.

In this case, the polymerizing monomers may be added to the reaction system separately; or different types of polymerizing monomers may be previously mixed and they may be added thereto simultaneously. Further, during the addition of polymerizing monomer, the polymerizing monomer composition may be varied. The polymerizing monomer may be added directly as it is; or may be previously mixed with water, an emulsifier or the like, and the thus-prepared emulsion may be added to the system.

The "acid monomer" includes carboxyl group-having polymerizing monomers such as acrylic acid, methacrylic acid, itaconic acid, maleic acid, fumaric acid, cinnamic acid, etc.; sulfonic acid group-having polymerizing monomers such as sulfonated styrene, etc.; sulfonamide group-having polymerizing monomers such as vinylbenzene-sulfonamide, etc. The "basic monomer" includes amino group-having aromatic vinyl compounds such as aminostyrene, etc.; nitrogen-containing hetero ring-having polymerizing monomers such as vinylpyridine, vinylpyrrolidone, etc.

One or more those polar monomers may be used here either singly or as combined; and the monomer may exist as a salt accompanied by a pair ion. Of those, preferred for use herein are acid monomers; and more preferred is (meth) acrylic acid. The proportion of the total of the polar monomers to all the polymerizing monomers, 100% by mass, constituting the binder resin as polymer primary particles is preferably 0.05% or more by mass, more preferably 0.3% or more by mass, even more preferably 0.5% or more by mass, still more preferably 1% or more by mass. The uppermost limit is preferably 10% or less by mass, more preferably 5% or less by mass, even more preferably 2% or less by mass. Within the above range, the dispersion stability of the obtained polymer primary particles is improved and the particle morphology and the particle size are easy to control in the aggregation step to be mentioned below.

"Other monomer" includes styrenes such as styrene, methylstyrene, chlorostyrene, dichlorostyrene, p-tert-butylstyrene, p-n-butylstyrene, p-n-nonylstyrene, etc.; acrylates such as methyl acrylate, ethyl acrylate, propyl acrylate, n-butyl acrylate, isobutyl acrylate, hydroxyethyl acrylate, ethylhexyl acrylate, etc.; methacrylates such as methyl methacrylate, ethyl methacrylate, propyl methacrylate, n-butyl methacrylate, isobutyl methacrylate, hydroxyethyl methacrylate, ethylhexyl methacrylate, etc.; acrylamides such as acrylamide, N-propylacrylamide, N,N-dimethylacrylamide, N,N-dipropylacrylamide, N,N-dibutylacrylamide, etc. One or more those polymerizing monomers may be used here either singly or as combined.

In the invention, a preferred embodiment of the combination of the above-mentioned polymerizing monomers is a combination of an acid monomer and an other monomer. More preferably, (meth)acrylic acid is used as the acid monomer and a polymerizing monomer selected from styrenes and (meth)acrylates is used as the other monomer; even more preferably, (meth)acrylic acid is used as the acid monomer, and a combination of styrene and (meth)acrylate is used as the other monomer; still more preferably, (meth) acrylic acid is used as the acid monomer, and a combination of styrene and n-butyl acrylate is used as the other monomer.

Further, a crosslinked resin is also preferred for the binder resin to constitute the polymer primary particles. In this case, the crosslinking agent to be used as combined with the above-mentioned polymerizing monomer may be a radical-polymerizing polyfunctional monomer. The polyfunctional monomer includes, for example, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate, diallyl phthalate, etc. As the crosslinking agent, also usable is a polymerizing monomer having a reactive group as the pendant group, for example, glycidyl methacrylate, methylolacrylamide, acrolein, etc. Above all, preferred is a radical-polymerizing bifunctional monomer, and more preferred are divinylbenzene, hexanediol diacrylate.

One or more these crosslinking agents such as polyfunctional monomers may be used here either singly or as combined. In case where the crosslinked resin is used as the binder resin to constitute the polymer primary particles in the invention, the blend ratio of the crosslinking agent such as polyfunctional monomer or the like in all the polymerizing monomers constituting the resin is preferably 0.005% or more by mass, more preferably 0.1% or more by mass, even more preferably 0.3% or more by mass; and preferably the ratio is 5% or less by mass, more preferably 3% or less by mass, even more preferably 1% or less by mass.

(Emulsifier)

Any known emulsifier is usable in the emulsion polymerization in the invention, and one or more selected from cationic surfactants, anionic surfactants and nonionic surfactants may be used here either singly or as combined.

The cationic surfactant includes, for example, dodecylammonium chloride, dodecylammonium bromide, dodecyltrimethylammonium bromide, dodecylpyridinium chloride, dodecylpyridinium bromide, hexadecyltrimethylammonium bromide, etc.

The anionic surfactant includes, for example, fatty acid soaps such as sodium stearate, sodium decanoate; and sodium dodecylsulfate, sodium dodecylbenzenesulfonate, sodium laurylsulfate, etc.

The nonionic surfactant includes, for example, polyoxyethylene dodecyl ether, polyoxyethylene hexadecyl ether, polyoxyethylene nonylphenyl ether, polyoxyethylene lauryl ether, polyoxyethylene sorbitan monooleate ether, monodecanoyl sucrose, etc.

The amount of the emulsifier to be used may be generally from 1 to 10 parts by weight relative to 100 parts by weight of the polymerizing monomer. If desired, the emulsifier may be combined with, for example, one or more of polyvinyl alcohols such as partially or completely saponified polyvinyl alcohol, or cellulose derivatives such as hydroxyethyl cellulose serving as a protective colloid.

(Polymerization Initiator)

As the polymerization initiator, herein usable are, for example, hydrogen peroxide; persulfate salts such as potassium persulfate, etc.; organic peroxides such as benzoyl peroxide, lauroyl peroxide, etc.; azo compounds such as 2,2'-azobisisobutyronitrile, 2,2'-azobis(2,4-dimethylvaleronitrile), etc.; redox initiators, etc. One or more such polymerization initiators may be used here; and in general, the initiator is used in an amount of from 0.1 to 3 parts by weight or so relative to 100 parts by weight of the polymerizing monomer. Above all, at least a part or all of the initiators are hydrogen peroxide or organic peroxides.

The polymerization initiator may be added to the polymerization system in any time before addition of polymerizing monomer, or simultaneously with the addition, or after the addition; and if desired, the addition methods may be combined.

(Chain Transfer Agent)

In the emulsion polymerization, if desired, any known chain transfer may be used. Specific examples of the chain transfer agent include t-dodecylmercaptan, 2-mercaptoethanol, diisopropyl xanthate, carbon tetrachloride, trichlorobromomethane, etc. One or more chain transfers may be used here either singly or as combined; and the amount of the chain transfer may be generally within a range of 5% or less by mass of all the polymerizing monomers.

Further, a pH regulator, a polymerization degree regulator, a defoaming agent and the like may be optionally added to the reaction system.

(Colorant)

Not specifically defined, any ordinary colorant may be used here. For example, the colorant includes the above-mentioned pigments, carbon blacks such as furnace black, lamp black, etc.; magnetic colorants, etc.

The content of the colorant may be enough to make the toner form a visible image through development therewith, and for example, it may fall within a range of from 1 to 25 parts by weight relative to 100 parts by weight of the toner, more preferably from 1 to 15 parts by weight, even more preferably from 3 to 12 parts by weight.

The colorant may be magnetic; and the magnetic colorant is, for example, a strongly magnetic substance that exhibits ferrimagnetism or ferromagnetism in a service environment temperature range for printers, copying machines and others, from 0 to 60° C. or so (hereinafter this may be optionally referred to as "magnetic powder"). Concretely, it includes, for example, magnetite ($Fe_3O_4$), maghematite ($\gamma$-$Fe_2O_3$), intermediates or mixtures of magnetite and hematite, spinel ferrites of $M_xFe_{3-x}O_4$ where M is Mg, Mn, Fe, Co, Ni, Cu, Zn, Cd or the like, hexagonal ferrites such as $BaO.6Fe_2O_3$, $SrO.6Fe_2O_3$, etc., garnet-type oxides such as $Y_2Fe_5O_{12}$, $Sm_3Fe_5O_{12}$, etc., rutile-type oxides such as $CrO_2$, etc., metals such as Cr, Mn, Fe, Co, Ni and the like or their ferromagnetic alloys that exhibit magnetism at from 0 to 60° C. or so. Above all, preferred are magnetite, maghematite, or intermediates of magnetite and maghematite.

In case where the toner is made to have the properties of a nonmagnetic toner and from the viewpoint of scattering prevention and charging control, the content of the magnetic powder in the toner is preferably from 0.2 to 10% by mass, more preferably from 0.5 to 8% by mass, even more preferably from 1 to 5% by mass.

In case where the toner is used as a magnetic toner, the content of the magnetic powder in the toner may be generally 15% or more by mass, more preferably 20% or more by mass, and generally 70% or less by mass, preferably 60% or less by mass. When the content of the magnetic powder is less than the above range, then the magnetic toner could not have the necessary magnetic force; but when more than the range, it may cause toner fixation failure.

For incorporating the colorant in the toner in an emulsion polymerization aggregation method, in general, a polymer primary particle dispersion and a colorant dispersion are first mixed to give a mixture dispersion, and this is processed for aggregation to give particle aggregates.

Preferably, the colorant is emulsified in the presence of an emulsifier according to a mechanical means with a sand mill, a bead mill or the like. In preparing the colorant dispersion, from 10 to 30 parts by weight of the colorant may be added to 100 parts by weight of water, and from 1 to 15 parts by weight of an emulsifier is added thereto. During the dispersion process, preferably, the colorant dispersion is monitored to measure the particle size of the colorant therein so that finally the volume-average diameter (Mv) thereof is good to be controlled to fall within a range of from 0.01 to 3 μm, more preferably from 0.05 to 0.5 μm. The colorant dispersion may be incorporated during the emulsion aggregation as so computed that the amount of the colorant could be in the finally-aggregated toner matrix particles in an amount of from 2 to 10% by mass.

(Wax)

For improving the toner fixability, wax is preferably used. Wax may be incorporated in the polymer primary particles, or may be incorporated in the resin fine particles to be mentioned below. However, in general, with the increase in the amount of wax used, the aggregation controllability may worsen and the particle size distribution of the formed particles tends to be broad. Regarding the method of adding wax in the emulsion polymerization aggregation method, preferably, wax may be added in the aggregation step, or a wax dispersion previously prepared by dispersing and emulsifying wax in water to have a volume-average diameter (Mv) of from 0.01 to 2.0 μm, more preferably from 0.01 to 0.5 μm may be added during emulsion polymerization.

For dispersing wax in the toner to have a preferred dispersion particle size therein, preferably, wax is added as a seed during emulsion polymerization. Seed addition gives polymer primary particles with wax included therein, in which, therefore, a large quantity of wax does not exist in the surface of the toner particle, and the toner chargeability and heat resistance could be prevented from worsening. The wax content in the polymer primary particles is preferably so computed as to be from 4 to 30% by mass, more preferably from 5 to 20% by mass, even more preferably from 7 to 15% by mass.

Wax may be incorporated in the resin fine particles to be mentioned below; and also in this case, preferably, wax is added as a seed during emulsion polymerization, like in the case of producing polymer primary particles. The wax content in all the resin fine particles is preferably smaller than the wax content in all the polymer primary particles.

In general, in case where wax is incorporated in resin fine particles, the toner fixability may better, but on the contrary, the generation of fine powder tends to increase. The reason is first the fixability could better since the wax moving speed into the toner surface may increase when heated. On the other hand, when wax is incorporated in resin fine particles, then the particle size distribution of the resin fine particles may broaden and the aggregation control may be difficult and, as a result, the fine powder generation would increase.

(Charge Control Agent)

A charge control agent may be incorporated in the toner for use in the invention, for controlling the charge amount and for securing the charge stability of the toner. As the charge control agent, any ordinary known compounds may be used. For example, there are mentioned metal complexes of hydroxycarboxylic acids, metal complexes of azo compounds, naphthol compounds, metal compounds of naphthol compounds, nigrosine dyes, quaternary ammonium salts, and their mixtures. The amount of the charge control agent to be incorporated is preferably from 0.1 to 5 parts by weight relative to 100 parts by weight of the toner resin.

In case where a charge control agent is incorporated in the toner according to an emulsion polymerization aggregation method, the charge control agent may be added to the system along with the polymerizing monomer and others thereto during emulsion polymerization, or the agent may be added thereto along with polymer primary particles and colorant and others in the aggregation step, or the agent may be added thereto after the polymer primary particles and the colorant and others have been aggregated to give particles having a suitable particle size as toner. Of those methods, preferred is the method of emulsifying and dispersing the charge control agent in water in the presence of an emulsifier to give an emulsion dispersion having a volume-average diameter (Mv) of from 0.01 μm to 3 μm, and adding the resulting dispersion to the system. The charge control agent dispersion is added during emulsion aggregation as so computed that the amount thereof in the aggregated final toner matrix particles could be from 0.1 to 5% by mass.

(Resin Fine Particles)

Resin fine particles may be produced according to the same method as that for polymer primary particles to be mentioned below, and the constitution thereof is not specifically defined. For these, the above-mentioned monomers may be used.

The proportion of the total polar monomer content in 100% by mass of all the polymerizing monomers to constitute the binder resin for the resin fine particles is preferably 0.05% or more by mass, more preferably 0.1% or more by mass, even more preferably 0.2% or more by mass. The uppermost limit is preferably 3% or less by mass, more preferably 1.5% or less by mass. Within the above range, the dispersion stability of the obtained resin fine particles could better, and the particle morphology and the particle size would be easy to control in the aggregation step.

Preferably, the proportion of the total polar monomer content in 100% by mass of all the polymerizing monomers to constitute the binder resin for the resin fine particles is smaller than the proportion of the total polar monomer content in 100% by mass of all the polymerizing monomers to constitute the binder resin for the polymer primary particles, as the particle morphology and the particle size would be easy to control in the aggregation step, and the fine powder generation could be prevented and the toner produced could have excellent charging characteristics.

Also preferably, Tg of the binder resin for the resin fine particles is higher than Tg of the binder resin for the polymer primary particles, from the viewpoint of the storage stability of the toner.

The volume-average diameter (Mv) of the polymer primary particles, the resin fine particles, the colorant particles, the wax particles, the charge control agent particles and others in the dispersion can be measured using Nanotrac particle sizer according to the method described in the section of Examples; and is defined as the found data.

<Polymerization Step>

The steps of constituting the emulsion polymerization aggregation method are described in detail hereinunder.

The polymerization step is a step of producing a dispersion containing polymer primary particles through emulsion polymerization.

The monomer, the emulsifier and other materials to be used in the polymerization step are described above.

In a mode of emulsion polymerization, the above-mentioned polymerizing monomer is polymerized in the presence of a polymerization initiator; and the polymerization temperature is generally from 50 to 120° C., preferably from 60 to 100° C., more preferably from 70 to 90° C.

(Polymer Primary Particles)

The volume-average diameter (Mv) of the polymer primary particles produced through emulsion polymerization is generally 0.02 μm or more, preferably 0.05 μm or more, more preferably 0.1 μm or more, and is generally 3 μm or less, preferably 2 μm or less, more preferably 1 μm or less. When the particle size is less than the above range, then the aggregation speed would be difficult to control in the aggregation step to be mentioned below; but when more than the range, the particle size of the toner to be obtained through aggregation in the aggregation step to be mentioned below would be too large and the toner having the intended particle size would be difficult to obtain.

Tg, as measured through DSC, of the binder resin for the polymer primary particles in the invention is preferably from 40 to 80° C., more preferably from 55 to 65° C. Within the range, the storability of the toner may be good and the aggregation property thereof would not worsen. When Tg is too high, then the aggregation of the particles may be poor, and if so, the aggregating agent must be added excessively or the aggregation temperature must be elevated; however, in such a case, fine powder will be easy to form. In case where Tg of the binder resin could not be clearly read, as overlapping with the heat quantity change based on the other ingredients, for example, as overlapping with melting peak of polylactone or wax, then the temperature means Tg of the toner as measured in producing it not containing those other ingredients.

In the invention, the acid value of the binder resin to constitute the polymer primary particles is measured according to the method of JISK-0070, and is preferably from 3 to 50 mg-KOH/g, more preferably from 5 to 30 mg-KOH/g.

The solid concentration of the polymer primary particles in the "polymer primary particle dispersion" for use in the invention is 14% or more by mass as the lowermost value thereof, more preferably 21% or more by mass; while the uppermost value thereof is preferably 30% or less by mass, more preferably 25% or less by mass. Within the range, the aggregation speed of the polymer primary particles is easy to control in the aggregation step as a rule of thumb, and as a result, the particle size, the particle morphology and the particle size distribution of the core particles are easy to control within a desired range.

<Aggregation Step>

The aggregation step is a step of mixing the polymer primary particles produced in the above polymerization step, a colorant and optionally a charge control agent, wax and other ingredients for aggregation. In the aggregation step, the mixture is aggregated to nearly the size of toner particles prior to the ripening step to be mentioned below.

The colorant, the charge control agent, wax and others to be used here are described above.

In the aggregation step, the above-mentioned polymer primary particles, resin fine particles, colorant particles and optionally charge control agent, wax and other additive ingredients are mixed simultaneously or successively. From the viewpoint of the toner composition homogeneousness and the particle size uniformity, preferably, dispersions of the respective ingredients, or that is, a polymer primary particle dispersion, a resin fine particle dispersion, a colorant particle dispersion, a charge control agent dispersion, and a wax fine particle dispersion are previously prepared, and these are mixed for aggregation.

In case where such different types of dispersions are mixed, the aggregation speed of the ingredients in the individual dispersion may differ. Accordingly, from the viewpoint of uniformly attaining the aggregation, preferably, the dispersions are continuously or intermittently added to and mixed with each other, taking time in some degree. The preferred time to be taken for the addition will vary depending on the amount and the solid concentration of the dispersions to be mixed, and preferably, therefore, the time is suitably controlled. For example, in case where a polymer primary particle dispersion is mixed with a colorant particle dispersion, preferably, the two are added to and mixed with each other taking 3 minutes or more. Also in case where core particles are mixed with a resin fine particle dispersion, preferably, they are added to and mixed with each other taking 3 minutes or more.

The aggregation method includes a method of heating in an ordinary stirring tank, a method of adding an electrolyte, a method of reducing the concentration of the emulsifier in the system, and a method of combining them. In case where polymer primary particles are aggregated with stirring to give particle aggregates having a size almost near to that of the intended toner, the particle size of the particle aggregates is controlled based on the balance between the aggregation force of the particles and the shearing force by stirring them; and according to the above-mentioned method, the aggregation force may be enlarged.

An electrolyte may be added in aggregation, and as the electrolyte, any of organic salts or inorganic salts is usable. Concretely, there are mentioned inorganic salts having a monovalent metal cation such as NaCl, KCl, LiCl, $Na_2SO_4$, $K_2SO_4$, $Li_2SO_4$, $CH_3COONa$, $C_6H_5SO_3Na$, etc.; inorganic salts having a divalent metal cation such as $MgCl_2$, $CaCl_2$, $MgSO_4$, $CaSO_4$, $ZnSO_4$, etc.; inorganic salts having a trivalent metal cation such as $Al_2(SO_4)_3$, $Fe_2(SO_4)_3$, etc. Of those, use of an inorganic salt having a divalent or more polyvalent metal cation is preferred as the aggregation speed could be high to increase the producibility; but on the other hand, the amount of the polymer primary particles not taken in the core particles would increase and, as a result, fine powder not reaching the desired particle size would form. Accordingly, use of an inorganic salt having a monovalent metal cation, of which the aggregation potency is not so high, is preferred as suppressing the generation of fine powder.

The amount of the electrolyte to be used may vary depending on the type of the electrolyte and the intended particle size, but is generally from 0.05 to 25 parts by weight relative to 100 parts by weight of the solid content of the mixed dispersion, preferably from 0.1 to 15 parts by weight, more preferably from 0. to 10 parts by weight. When the amount is less than the range, the aggregation reaction speed may be low, and there may occur some problems in that, after the aggregation reaction, fine powder of 1 μm or less may remain, and the mean particle size of the formed particle aggregates could not reach the desired level. On the other hand, when the amount is more than the range, the aggregation may go on too rapidly and there may occur some problems in that and particle size would be difficult to control and the formed core particles may contain crude particles or amorphous powder.

Preferably, the electrolyte is added not at once but intermittently or continuously taking time in some degree. The addition time varies depending on the amount to be used, but is preferably 0.5 minutes or more. In general, in a moment after addition of electrolyte, rapid aggregation suddenly starts, and therefore many polymer primary particles and colorant particles left as such without being aggregates or their aggregates tend to remain in the system. These are considered to be a cause of fine powder generation. According to the above-mentioned operation, uniform aggregation can be attained with no rapid aggregation, and therefore fine powder generation can be prevented.

The final temperature in the aggregation step where an electrolyte is added to the system is preferably from 20 to 70° C., more preferably from 30 to 60° C. Controlling the temperature before the aggregation step is one method of controlling the particle size to fall within the specific range defined in the invention. Some colorants to be added in the aggregation step may induce aggregation like the above-mentioned electrolyte, and therefore the system could undergo aggregation even though an electrolyte is not added thereto. Accordingly, in mixing the colorant dispersion, the polymer primary particle dispersion may be previously cooled to prevent the aggregation. The aggregation would be a cause of fine powder generation. In the invention, preferably, the polymer primary particle dispersion is previously cooled within a range of from 0 to 15° C., more preferably from 0 to 12° C., even more preferably from 2 to 10° C. The method is effective not only in the case of aggregation with electrolyte addition but also employable in the case of aggregation by pH control or with addition of a polar organic solvent such as alcohol without electrolyte addition, and the mode of the aggregation method is not specifically defined.

The final temperature in the aggregation step where the aggregation is attained by heating may be generally within a range of from (Tg-20° C.) to Tg of the polymer primary particles, preferably within a range of from (Tg-10° C.) to (Tg-5° C.).

As the method of preventing rapid aggregation for the purpose of preventing fine powder generation, there may be mentioned a method of adding desalting water or the like. In the method of adding desalting water or the like, the aggregation effect is not so strong like in the method of adding electrolyte, and therefore the method is not explicitly employed in view of the production efficiency, but is rather unfavorable since a large amount of a filtrate would be formed in the subsequent filtration step. However, in the case where delicate aggregation control is desired like in the invention, the method is extremely effective. In the invention, in addition, the method is preferably combined with the above-mentioned heating method or the method of adding electrolyte. In this case, the method of adding desalting water after addition of electrolyte is especially preferred as the aggregation is easy to control.

The time necessary for aggregation is optimized by the apparatus configuration or the process scale. In order to make the particle size of the toner matrix particles reach the intended level, preferably, the time from the temperature lower by 8° C. than the temperature for the operation to terminate the aggregation step, for example, the temperature for the operation to stop the growth of the core grains by emulsifier addition or pH control (hereinafter this may be abbreviated as "final aggregation temperature") to the final aggregation temperature is 30 minutes or more, more preferably 1 hour or more. By prolonging the time, the remaining polymer primary particles and colorant particles and their aggregates could be taken in the intended core particles without being left remaining in the system, and they may aggregate together to be the intended core particles.

For obtaining the toner that satisfies all the above requirements (1) to (4), preferably, an operation for which the aggregation speed is not so high as compared with the operation generally taken in an ordinary aggregation step is employed. For the operation for which the aggregation speed is not high is, for example, the dispersion to be used is previously cooled, or the dispersion is added taking a long time, or an electrolyte not having a high aggregation potency is used, or the electrolyte is added continuously or intermittently, or the heating speed is lowered, or the aggregation time is prolonged.

In the ripening step to be mentioned below, preferably employed is an operation by which the aggregated particles are hardly redispersed. The operation by which the aggregated particles are hardly redispersed includes, for example, lowering the stirring rotation number, adding a dispersion stabilizer continuously or intermittently, previously mixing a dispersion stabilizer with water, and the like. Preferably, the toner satisfying the above formula (1) is obtained not via the step of processing the finally obtained toner or toner matrix particles through classification or the like to remove therefrom a part of the particles not reaching the level of the volume median diameter (Dv50) thereof.

<Shell Coating Step>

In the invention, preferably, the toner matrix particles are produced by washing and drying the particles that are prepared by fusion after the shell coating step of fixing or adhering resin fine particles and the like to the core particles prepared through aggregation of polymer primary particles in the above-mentioned aggregation step.

The shell coating step is an optional step and is attained if desired. The resin fine particles to be used in the step are described in the above.

The proportion of the resin fine particles to be fixed or adhered is preferably from 0.5 to 30 parts by weight relative to 100 parts by weight of the core particles, more preferably from 5 to 20 parts by weight.

In the invention, if desired, resin fine particles may be applied (adhered or fixed) to the surfaces of the core particles to form the toner matrix particles. The volume-average diameter (Mv) of the resin fine particles is preferably from 0.02 μm to 3 μm, more preferably from 0.05 μm to 1.5 μm. In general, use of the resin fine particles promotes the generation of fine powder not reaching the level of the predetermined toner particle size. Accordingly, toner coated with conventional resin fine particles would contain a large amount of fine powder not reaching the level of the predetermined toner particle size.

In the invention, in case where the amount of wax to be incorporated is increased, then the high-temperature fixability of the toner may better, but the wax may bleed out on the toner surface and therefore the chargeability and the heat resistance of the toner may worsen. Accordingly, by coating the surfaces of the core particles with wax-free resin fine particles, the property of the coated toner particles may be prevented from worsening.

However, in case where wax is incorporated in the resin fine particles for the purpose of enhancing the high-temperature fixability of the toner, the resin fine particles once having adhered to the surfaces of the core particles would readily peel off. The reason is because the particle size distribution of the above-mentioned resin fine particles may broaden and the resin fine particles may contain large-size particles having a low adhesion power. Accordingly, to reduce the peeling, preferably, the dispersion of the particles with the resin fine particles adhering to their surfaces is heated while an aqueous solution previously prepared by mixing a dispersion stabilizer and water is added thereto.

In case where the conventional method including the "step of initiating the heating after addition of emulsifier" is employed, or that is, when the ripening step is carried out after the aggregation force has been suddenly lowered, then the resin fine particles having once adhered to the particles may be readily peeled off owing to the sudden reduction in the aggregation force. Accordingly, preferably, the resin fine particles are, after adhered, fused with suppressing the size growth of the particles.

<Ripening Step>

The emulsion polymerization aggregation method preferably includes a ripening step for increasing the stability of the particle aggregates obtained through aggregation, in which an emulsifier or a pH regulator is added as the dispersion stabilizer to lower the aggregation force between the particles to thereby stop the growth of the toner matrix particles, and then the aggregated particles are fused.

Not specifically defined, the amount of the emulsifier to be added, if any, for preventing the aggregation of particles may be preferably 0.1 parts or more by weight relative to 100 parts by weight of the solid content of the mixed dispersion, more preferably 1 part or more by weight, even more preferably 3 parts or more by weight, and is preferably 20 parts or less by weight, more preferably 15 parts or less by weight, even more preferably 10 parts or less by weight. The emulsifier may be added after the aggregation step but before the completion of the ripening step, or the pH value of the aggregation liquid may be increased, whereby the aggregation of the particle aggregates having aggregated in the aggregation step may be prevented from further aggregating together, and the formation of coarse particles in the toner after the ripening step may be thereby prevented.

Regarding the small-size toner for use in the image forming apparatus of the invention, as the method for controlling the toner to have a particle size falling within a specific range that means the particle size distribution sharpness, there may be mentioned a method of lowering the stirring rotation number before the step of adding an emulsifier or a pH controller, or that is, lowering the shearing force by stirring. The method is preferably employed in the case where the system has been transferred to a system having a weak aggregation potency, for example, to a rapidly stabilized system where an emulsifier or a pH controller has been added at a time. As described above, in the case where a method of heating the system with adding thereto an aqueous solution previously prepared by mixing a dispersion stabilizer and water is employed, and when the stirring rotation number is lowered, then the system may be too much inclined to aggregation and therefore the particle size may too much grow large.

According to the above-mentioned methods, a toner having a specific particle size distribution, or that is, a toner satisfying all the above requirements (1) to (4) for use in the image forming apparatus of the invention may be obtained; and describing it more, when the rotation number is lowered, the content of fine powder particles in the toner may be controlled. For example, when the stirring rotation number is lowered from 250 rpm to 150 rpm, then a small-size toner having a sharper particle size distribution than that of known toners may be given, and the toner having the specific particle size distribution for use in the image forming apparatus of the invention may be obtained. Naturally, however, the value shall vary depending on the following conditions (a) to (e).

(a) Diameter of stirring chamber (as an ordinary cylindrical chamber) and the maximum diameter of stirring blade (and the relative ratio thereof).

(b) Height of stirring chamber.

(c) Peripheral speed of the tip of stirring blade.

(d) Shape of stirring blade (e) Position of blade in stirring chamber.

In particular, (c) is preferably from 1.0 to 2.5 m/sec, more preferably from 1.2 to 2.3 m/sec, even more preferably from 1.5 to 2.2 m/sec. Within the above range, a preferred shearing speed may be given to the particles not accompanied by peeling or excessive growth.

The temperature in the ripening step is preferably not lower than Tg of he binder resin as the polymer primary particles, more preferably not lower than the temperature higher by 5° C. than Tg, and is preferably not higher than the temperature higher by 80° C. than Tg, more preferably not higher than the temperature higher by 50° C. than Tg.

The time for the ripening step varies depending on the morphology of the intended toner, but is preferably such that, after the system has reached a temperature not lower than the glass transition temperature of the polymer constituting the polymer primary particles, it is kept at the temperature generally for from 0.1 to 5 hours, preferably for from 1 to 3 hours.

As a result of the heat treatment, the polymer primary particles in the aggregates are fused and integrated to give nearly spherical toner matrix particles as aggregates. The article aggregates before the ripening step are considered to be aggregates attained by electrostatic aggregation or physical aggregation of polymer primary particles. After the ripening step, he polymer primary particles to constitute the particle aggregates are fused to each other, whereby the morphology of the toner matrix particles could be nearly spherical. According to the ripening step, various types of toner particles such as grape bunch-like aggregates of polymer primary particles, potato-like aggregates of advanced fusion thereof, spherical aggregates of further advanced fusion thereof and others can be produced by controlling the temperature and the time of the ripening step.

In the invention, the average degree of circularity of the toner must be indispensably 0.93 or more.

<Washing/Drying Step>

The particle aggregates produced through the above-mentioned steps may be processed for solid/liquid separation according to a known method to collect the particle aggregates, and then these may be optionally washed and dried to give the toner matrix particles.

If desired, the surface of the particles thus produced according to the above-mentioned emulsion polymerization aggregation method may be coated with an outer layer of resin fine particles comprising a polymer as the main ingredient, for example, according to a spray-drying method, an in-situ method, an in-liquid particles coating method or the like, preferably to have a thickness of from 0.01 to 0.5 μm, thereby giving encapsulated toner matrix particles.

<External Addition Step>

The toner of the invention may be the toner matrix particles as such that have been produced according to the above-mentioned process, but for controlling the flowability and the developability thereof, any known external additive may be added to the toner matrix particles.

As the external additive, those mentioned in the above may be used.

As the method of adding an external additive to the surface of the toner matrix particles, for example, the particles and the additive may be uniformly stirred and mixed in a high-speed fluid mixing machine such as Henschel mixer (by Mitsui Mining) or the like by suitably selecting and controlling the blade shape, the rotation number, the time, the drive-stop frequency, etc. If desired, an apparatus capable of giving compression shear stress may be used for additive fixation.

According to the above-mentioned production method, toner matrix particles satisfying all the requirements (1) to (4) can be produced, and then through the external addition treatment, the toner satisfying all the requirements (1) to (4) can be produced.

<Toner>

The toner produced according to the above-mentioned emulsion polymerization aggregation method has an average degree of circularity, as measured by the use of a flow particle sizer FPIA-2100, of 0.93 or more, preferably 0.94 or more. It is considered that the toner particles nearer to spheres would hardly involve localization of the electrostatic charge in the particles and their developability could be more uniform. On the other hand, completely spherical toner particles would worsen the cleanability, and therefore the average degree of circularity of the toner particles is preferably 0.98 or less, more preferably 0.97 or less.

Preferably, at least one peak molecular weight in gel permeation chromatography (hereinafter this may be abbreviated as "GPC") of the soluble fraction of the toner in tetrahydrofuran (hereinafter this may be abbreviated as "THF") is 30,000 or more, more preferably 40,000 or more, even more preferably 50,000 or more, and is preferably 200,000 or less, more preferably 150,000 or less, even more preferably 100,000 or less. In case where all the peak molecular weights are lower than the above range, the mechanical durability of the toner in a nonmagnetic one-component development system would be poor. In case where all the peak molecular weight are higher than the above range, the low-temperature fixability and the fixation intensity of the toner may be low.

The charging property of the toner produced according to the emulsion polymerization aggregation method may be positive-charge or negative-charge, but preferably, the toner is a negatively-charging toner. The charging property of the toner may be controlled by suitably selecting and controlling the charge control agent and its amount and the external agent and its amount.

<Pulverized Toner>

A pulverized toner having a particle size distribution to fall within a specific range may be uses in the image forming apparatus of the invention, and the method for producing the pulverized toner of the type is not specifically defined. For this, for example, employable is a method of excessive classification.

The materials for use in production of the pulverized toner are described in detail.

(Resin)

The resin for use in producing the pulverized toner may be suitably selected from those known usable for toner. For example, usable are styrenic resins, vinyl chloride resins, rosin-modified maleic acid resins, phenolic resins, epoxy resins, saturated or unsaturated polyester resins, ionomer resins, polyurethane resins, silicone resins, ketone resins, ethylene/acrylate copolymers, xylene resins, polyvinyl butyral resins, etc. One or more those resins may be used here either singly or as combined.

The polyester resin may be produced through polymerization of a polymerizing monomer composition comprising a polyalcohol and a polybasic acid, in which at least any one of the polyalcohol and the polybasic acid optionally contains a trifunctional or more polyfunctional ingredient (crosslinking ingredient). The dialcohol for use in production of the polyester resin includes, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, etc.; bisphenol A, hydrogenated bisphenol A, bisphenol A alkylene oxide adducts such as polyoxyethylene bisphenol A, polyoxypropylene bisphenol A, etc. Of those monomers, bisphenol A alkylene oxide adducts are especially preferred as the main ingredient monomer; and more preferred are those adducts where the mean addition number of alkylene oxides per one molecule is from 2 to 7.

The tri or more polyalcohol participating in crosslinking of polyester includes, for example, sorbitol, 1,2,3,6-hexanetetraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, etc.

On the other hand, the polybasic acid includes, for example, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, their acid anhydrides and lower alkyl esters, as well as alkenylsuccinic acids pr alkylsuccinic acids such as n-dodecenylsuccinic acid, n-dodecylsuccinic acid, etc.; and other divalent organic acids.

The tri or more polybasic participating in crosslinking of polyester includes, for example, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and their anhydrides, etc.

These polyester resins may be produced in an ordinary method. Concretely, conditions of a reaction temperature (170 to 250° C.), a reaction pressure (5 mmHg to normal pressure) and others are determined depending on the reactivity of the monomers, and at the time when the product could have desired physical properties, the reaction is stopped.

Sp (softening point) of the polyester resin for use in the invention is preferably from 90 to 135° C., more preferably from 95 to 133° C. Regarding the range of Tg, when the softening point is 90° C., Tg may be from 50 to 65° C., and when the softening point is 135° C., Tg may be from 60 to 75° C. In this case, when Sp is lower than the above range, an offset phenomenon may readily occur in toner fixation, but when higher than the range, the fixation energy may increase and the glossiness and the transparency of color toner may worsen; and therefore such is unfavorable. When Tg is lower than the above range, the toner may readily form aggregates and may cake, but when higher than the range the fixation intensity in thermal fixation may lower; and therefore such is unfavorable.

Sp could be controlled mainly by the molecular weight of the resin. Preferably, the tetrahydrofuran soluble ingredient of the resin, as measured through GPC, has a number-average molecular weight o from 2000 to 20000, more preferably from 3000 to 12000. Tg may be controlled mainly by selecting the monomer ingredients constituting the resin. Concretely, when an aromatic polybasic acid is selected as the main ingredient of the acid component, Tg of the resin may be elevated. Specifically, of the above-mentioned polybasic acids, preferred for use as the main constitutive ingredient are phthalic acid, isophthalic acid, terephthalic acid, 1,2,4-benzenetricarboxylic acid, 1,2,5-benzenetricarboxylic acid and their anhydrides or lower alkyl esters.

In the invention, Sp is defined as a value measured with a flow tester according to JIS K7210 and K6719. Concretely, using a flow tester (CFT-500, by Shimadzu), about 1 g of a sample is preheated at 50° C. for 5 minutes, then while heated at a heating speed of 3° C./min, it is given a load of 30 kg/cm$^2$ by a plunger having an area of 1 cm$^2$, and extruded out through a die having a hole diameter of 1 mm and a length of 10 mm. With that, the plunger stroke-temperature curve is drawn, and the height of the S-shaped curve is represented by h. The temperature corresponding to h/2 is defined as the softening point of the sample. Tg is defined as one measured with a differential scanning calorimeter (Perkin Elmer's DSC7 or Seiko Instruments' DSC120) in an ordinary manner.

In general, in case where the acid value of polyester resin is too high, a stable high electrostatic charge is difficult to obtain, and the charging stability at high temperature and high humidity tends to worsen. Therefore, in the invention, the acid value of the polyester resin is preferably 50 KOH-mg/g or less, more preferably 30 KOH-mg/g or less, most preferably from 3 to 15 KOH mg/g. As the method for controlling the acid value to fall within the above range, there may be mentioned a method of controlling the blend ratio of the alcohol monomer and the acid monomer for use in the resin production. Other methods are also employable. For example, there may be mentioned a method where the acid monomer component to be used is previously esterified into its lower alkyl ester through transesterification; and a method of incorporating a basic component such as an amino group-containing glycol or the like to thereby neutralize the remaining acid residue. Needless-to-say, however, the invention is not limited to these methods but may employ all known methods. In the invention, the acid value of the polyester resin my be measured according to the method of JIS K0070. However, when the resin is hardly soluble in the solvent, then a good solvent such as dioxane or the like is used.

When the physical data of a polyester resin are plotted on an X-Y coordinate where the glass transition temperature (Tg) thereof is the variable on the X-axis and the softening point (Sp) thereof is the variable on the Y-axis, preferably, the polyester resin for use in the invention falls within the range surrounded by the linear lines of the following formulae (a) to (d). The unit of Tg and Sp is "° C.".

$$Sp=4\times Tg-110 \quad (a)$$

$$Sp=4\times Tg-170 \quad (b)$$

$$Sp=90 \quad (c)$$

$$Sp=135 \quad (d)$$

In case where the polyester resin having the physical properties surrounded by the lines of the formulae (a) to (d) is used in the pulverized toner, the pulverized toner may have extremely high-level resistance to mechanical stress. Further, the toner is neither aggregated nor caked by the friction heat to be generated in continuous use, and therefore can secure suitable chargeability for a long period of time.

(Colorant)

Not specifically defined, the colorant for use in the pulverized toner may be any ordinary colorant. For example, the colorant used in the above-mentioned polymerization toner may be used.

The content of the colorant may be enough for the toner to form a visible image by development, and for example, like in the polymerization toner, the colorant content is preferably from 1 to 25 parts by weight relative to 100 parts by weight of the toner, more preferably from 1 to 15 parts by weight, even more preferably from 3 to 12 parts by weight.

(Other Materials)

The pulverized toner may contain any other constitutive materials.

As the charge control agent in the toner, any known one is usable. For example, as a positive charge control agent, known are nigrosine dyes, amino group-containing vinyl copolymers, quaternary ammonium salt compounds, polyamine resins, etc.; and as a negative charge control agent, known are metal-containing azo dyes containing a metal such as chromium, zinc, iron, cobalt, aluminium or the like, metal salts or metal complexes of salicylic acid or alkylsalicylic acid with the above-mentioned salt, etc. The amount of the agent to be used is preferably from 0.1 to 25 parts by mass relative to 100 parts by mass of the resin constituting the toner, more preferably from 1 to 15 parts by mass. In this case, the charge control agent may be incorporated in the resin, or may be adhered to the surfaces of the toner matrix particles.

Of those charge control agents, preferred are amino group-containing vinyl copolymers and/or quaternary ammonium salts as the positive charge control agent, and metal salts or metal complexes of salicylic acid or alkylsalicylic acid with chromium, zinc, aluminium, boron or the like as the negative charge control agent, in consideration of the charge impartation potency thereof to toner and of the compatibility thereof with color toner (in that the charge control agent itself is colorless or light-colored and gives no color interference to toner).

Of those, the amino group-containing vinyl copolymers include, for example, copolymer resins of aminoacrylates such as N,N-dimethylaminomethyl acrylate, N,N-diethylaminomethyl acrylate or the like and styrene, methyl methacrylate or the like. The quaternary ammonium salt compounds include, for example, salt-forming compounds of tetraethylammonium chloride or benzyltributylammonium chloride and naphtholsulfonic acid, etc. In the positive charge toner, one or more of amino group-containing vinyl copolymers and quaternary ammonium salt compounds may be incorporated either singly or as combined.

Various substances are known as metal salts and metal complexes of salicylic acid or alkylsalicylic acid; and of those, especially preferred for use here is chromium, zinc or boron complex of 3,5-di-tertiary butyl-salicylic acid.

For bettering the dispersibility and compatibility thereof in toner, the above colorant and charge control agent may be processed for pre-dispersion treatment of previously kneading them with resin to prepare a master batch.

The pulverized toner may contain, as other constitutive ingredients, any known substances, for example, low-melting-point lubricants such as low-molecular-weight polyalkylene, paraffin wax, ester wax, etc.

<Production Method>

The production method for the pulverized toner having a specific particle size distribution for use in the invention is not specifically defined. One example of the method is mentioned below.

1. A resin, a charge control agent, a colorant and optionally other additives are uniformly dispersed in a Henschel mixer or the like.

2. The dispersed mixture is melt-kneaded in a kneader, an extruder, a roll mill or the like.

3. The kneaded mixture is roughly milled with a hammer mill, a cutter mill or the like, and then finely milled with a jet mill, an I-mode mill or the like.

4. The powdered mixture is classified with a dispersion classifier, a zigzag classifier or the like.

5. An external additive such as silica or the like is dispersed in the classified fraction with a Henschel mixer or the like.

In particular, through the above operation (4), the mixture is classified to give a fraction having a specific particle size distribution as defined in the invention, whereby the toner for electrostatic charge development for use in the image forming apparatus of the invention can be produced according to the pulverizing method.

<Suspension Polymerization Method>

The toner having a specific particle size distribution for use in the invention may be produced according to a suspension polymerization method, and the method is not specifically defined. For example, the chemical structure such as the number of the polar groups in the binder polymer, the molecular weight distribution thereof, the type and the amount of the additive for bettering the suspension condition (dispersion stabilizer, etc.), the stirring intensity in suspension polymerization, the addition method for the polymerizing monomer, the type and the amount of the polymerization initiator and the chain transfer agent, the polymerization temperature, the degree of classification and others may be controlled to produce the intended toner. In one preferred method, a high shearing force is given to the system or the amount of the dispersion stabilizer is increased in the step of forming polymerizing monomer drops.

The resins and other materials for use in producing the suspension polymerization toner may be the same as those described in the section of the emulsion polymerization aggregation method.

<Chemical Pulverizing Method, Such as Typically Melt Suspension Method>

The toner having a specific particle size distribution for use in the invention may be produced according to a chemical pulverizing method such as typically a melt suspension method, and the method is not specifically defined. For example, the type, the chemical structure, the molecular weight distribution and others of the binder polymer; the type and the amount of the in-water additive for bettering the suspension condition; the stirring intensity, the addition method, the temperature and others in adding the polymer solution; and optionally the degree of classification and others may be controlled to produce the intended toner.

The resins for use in producing the toner according to the chemical pulverizing method such as melt suspension method are the same as those described in the section of the pulverizing method. The other materials are the same as those described in the section of the emulsion polymerization aggregation method.

The toner for use in the image forming apparatus of the invention may be used in any of a two-component developer that separately comprises a carrier for transporting the toner to the electrostatic latent image area in the image forming apparatus, or a magnetic one-component developer where a magnetic powder is added to the toner, or a nonmagnetic one-component developer where the developing agent does not contain a magnetic powder. For significantly expressing the effect of the invention, the toner is preferably used as a developer in a nonmagnetic one-component development system.

In case where the toner is used in the two-component developer, the carrier to be combined with the toner to form the developing agent may be any of known magnetic substances such as iron powders, ferrite or magnetite carriers, etc.; or those prepared by coating the surfaces of the magnetic substances with resin; or magnetic resin carriers. As the carrier coating resin, usable are any known styrene resins, acrylic resins, styrene-acryl copolymer resins, silicone resins, modified silicone resins, fluororesins, etc.; however, the resin is not limited to these. The mean particle size of the carrier is not specifically defined. Preferred are those having a mean particle size of from 10 to 200 μm. Preferably, the carrier is used in an amount of from 5 to 100 parts by weight relative to 1 part by weight of the toner.

<Electrophotographic Photoreceptor>

[1. Electrophotographic Photoreceptor]

The electrophotographic photoreceptor in the invention has an outer diameter of 20 mm or less, in which the photosensitive layer formed on the conductive support thereof contains at least a polyarylate resin.

[1-1. Conductive Support]

As the conductive support for the photoreceptor for use in the invention, usable is the conductive support described in US 2009/0053634 A1, paragraphs [0154] to [0164]. As the conductive support, also usable is the metal material such as aluminium alloy or the like coated with an anodic oxide film as described in paragraphs [0155] to [0160] of US 2009/0053634 A1.

[1-2. Undercoat Layer]

An undercoat layer may be provided between the conductive support and the photosensitive layer to be mentioned below for the purpose of improving the contact efficiency, the blocking resistance, etc. As the undercoat layer, for example, usable is a resin or a dispersion of metal oxide particles or the like in a resin. The undercoat layer may be a single layer or a multilayer.

As the undercoat layer, herein usable is the undercoat layer described in US 2009/0053634 A1, paragraphs [0165] to [0217]; and the undercoat layer may be formed on the conductive support according to the undercoat layer forming method described in US 2009/0053634 A1, paragraphs [0218] to [0222].

[1-3. Photosensitive Layer]

As the constitution of the photosensitive layer, herein usable is any one generally applicable to known electrophotographic photoreceptors. Concretely, there may be mentioned a so-called single-layer photoreceptor having a photosensitive layer of a single layer of a photoconductive material dissolved or dispersed in a binder resin (that is, single-layer photosensitive layer), and a so-called laminate photoreceptor having a multilayer photosensitive layer comprising, as laminated, a charge generation layer containing a charge-generating substance and a charge transport layer containing a charge-transporting substance (that is, multilayer photosensitive layer). In general, it is known that a photoconductive material may function on the same level both in a single-layer configuration and in a multilayer configuration.

The photosensitive layer that the electrophotographic photoreceptor for use in the invention has may have any known configuration; however, in comprehensive consideration of the mechanical properties, the electric properties, the production stability and others of the electrophotographic photoreceptor, preferred here is a multilayer electrophotographic photoreceptor. In particular, more preferred is a regular laminate photoreceptor comprising a charge generation layer and a charge transport layer laminated in that order on the conductive support thereof.

The photosensitive layer of the electrophotographic photoreceptor for use in the invention contains at least a polyarylate resin.

[1-3-1. Polyarylate Resin]

The photosensitive layer of the electrophotographic photoreceptor in the invention contains a polyarylate resin. Containing a polyarylate resin, the layer secures effective toner cleaning. In particular, the effect is remarkable for the toner having a high degree of circularity. Though not clear, the reason would be because the contact between the layer and the blade may be good therefore to prevent the toner from leaking through therebetween.

As the polyarylate resin, herein usable is any known one. Above all, preferred is one having a repeating structure represented by the following formula (1) (hereinafter this may be referred to as "polyarylate resin (1)"). One or more different types of polyarylate resins may be used here either singly or as combined.

[Formula 3]

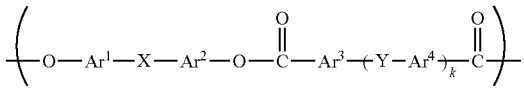

(1)

In formula (1), $Ar^1$ to $Ar^4$ each independently represent an arylene group optionally having a substituent; $X^1$ and $Y^1$ each independently represent a single bond or a divalent linking group; k indicates an integer of 0 or more.

<A. Structure>

In formula (1), $Ar^1$ to $Ar^4$ each independently represent an arylene group optionally having a substituent. Not significantly detracting from the effect of the invention, the arylene group may be any arbitrary one. The number of carbon atoms that the arylene group has is generally 6 or more, and its uppermost limit is generally 20 or less, preferably 10 or less. When the carbon number is too large, then the electric properties of the layer may worsen.

Specific examples of the arylene group include a 1,2-phenylene group, a 1,3-phenylene group, a 1,4-phenylene group, a naphthylene group, an anthrylene group, a phenanthrylene group, etc. Above all, the arylene group is preferably a 1,4-phenylene group from the viewpoint of the electric properties. One or more such arylene groups may be employed here either singly or as combined in any desired manner and in any desired ratio.

$Ar^1$ to $Ar^4$ each independently optionally have a substituent. Specific examples of the substituent include an alkyl group, an aryl group, a halogen atom, an alkoxy group, etc. Above all, in consideration of the mechanical properties of the binder resin in the photosensitive layer and of the solubility thereof in the photosensitive layer-forming coating liquid, a methyl group, an ethyl group, a propyl group and an isopropyl group are preferred as the alkyl group; a phenyl group and a naphthyl group are preferred as the aryl group; a fluorine atom, a chlorine atom, a bromine atom and an iodine atom are preferred as the halogen atom; and a methoxy group, an ethoxy group, a propoxy group and a butoxy group are preferred as the methoxy group.

In case where the substituent is an alkyl group, the carbon number of the alkyl group is generally 1 or more, and is generally 10 or less, but is preferably 8 or less, more preferably 2 or less.

Each independently and preferably, the number of the substituents in $Ar^1$ and $Ar^2$ is from 0 to 2; and from the viewpoint of the contact efficiency and the cleanability and more preferably, $Ar^1$ and $Ar^2$ have a substituent. In particular, from the viewpoint of the abrasion resistance, the number of the substituent is more preferably one. As the substituent, preferred is an alkyl group, and more preferred is a methyl group.

From the above-mentioned viewpoint, preferably, at least one of $Ar^1$ and $Ar^2$ is an arylene group having a substituent.

On the other hand, each independently and preferably, the number of the substituents in $Ar^3$ and $Ar^4$ is from 0 to 2; and from the viewpoint of the abrasion resistance and preferably, $Ar^3$ and $Ar^4$ do not have a substituent.

In formula (1), $X^1$ and $Y^1$ each independently represent a single bond or a divalent linking group. Preferably, $X^1$ and $Y^1$ include a sulfur atom, an oxygen atom, a sulfonyl group, a cycloalkylidene group such as cyclopentylidene, cyclohexylidene, and —$CR^aR^b$—.

$R^a$ and $R^b$ each independently represent a hydrogen atom, an alkyl group, an aryl group, a halogen atom, or an alkoxy group. For $R^a$ and $R^b$, in consideration of the mechanical properties of the binder resin for the photosensitive layer and of the solubility thereof in a photosensitive layer-forming coating liquid, the alkyl group is preferably a methyl group, an ethyl group, a propyl group or an isopropyl group, the aryl group is preferably a phenyl group or a naphthyl group, the halogen atom is preferably a fluorine atom, a chlorine atom, a bromine atom or an iodine atom, and the alkoxy group is preferably a methoxy group, an ethoxy group, a propoxy group or a butoxy group.

When $R^a$ and $R^b$ each are an alkyl group, the carbon number of the alkyl group is generally 1 or more, and is generally 10 or less, but is preferably 8 or less, more preferably 2 or less.

In consideration of the convenience in producing the dihydroxy compound generally used in producing the polyarylate resin (1), $X^1$ is preferably a sulfur atom, an oxygen atom, cyclohexylidene or —$CR^aR^b$—. More preferably, $X^1$ is —$CR^aR^b$—, in which, even more preferably, $R^a$ and $R^b$ each are a hydrogen atom or an alkyl group such as a methyl group. From the viewpoint of the abrasion resistance, especially preferably, at least one of $R^a$ and $R^b$ is a hydrogen atom.

On the other hand, in consideration of the convenience in producing the dihydroxy compound generally used in producing the polyarylate resin (1), $Y^1$ is preferably a single bond, or a divalent linking group having 3 atoms or less, such as an oxygen atom, a sulfur atom, a methylene group or the like; and from the viewpoint of the abrasion resistance and the cleanability, $Y^1$ is more preferably a divalent linking group having 3 atoms or less, and even more preferably an oxygen atom.

k is an integer of 0 or more. Above all, in consideration of the convenience in producing the polyarylate resin (1), k is preferably 0 or 1; and from the viewpoint of the abrasion resistance, k is more preferably 1.

In formula (1), preferably, $Y^1$ is an oxygen atom and k=1.

Preferred examples of the repeating structure that the polyarylate resin (1) has are mentioned below. However, the repeating structures that the polyarylate resin (1) can have are not limited to those mentioned below. The resin may contain one or more different types of the following structures either singly or as combined in any desired manner and in any desired ratio.

Repeating structures where k is 0:

[Formula 4]

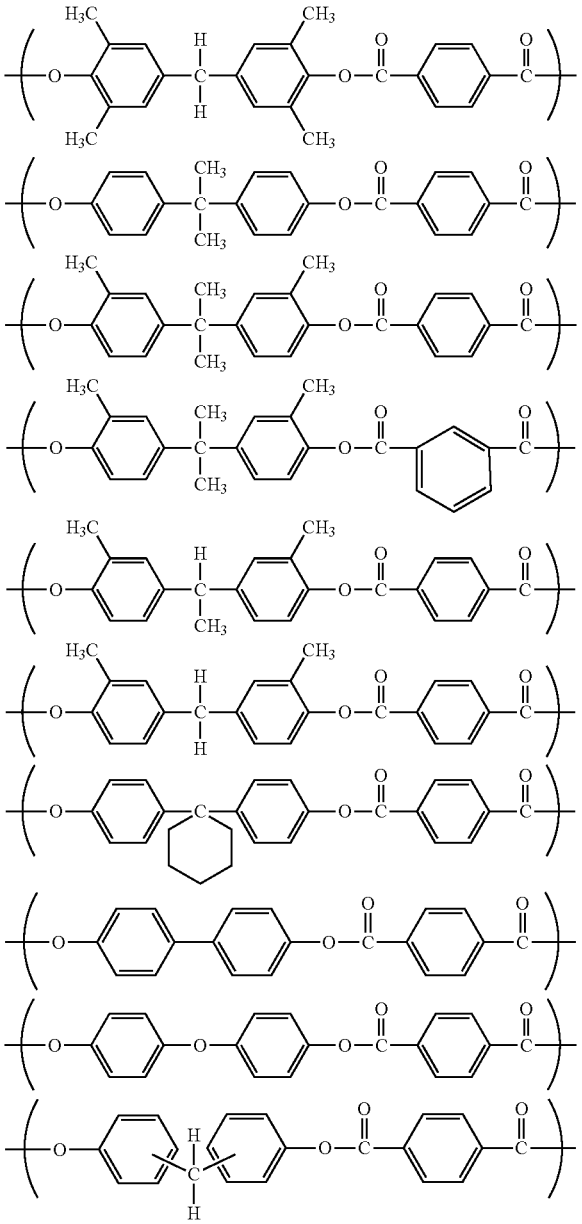

Repeating structures where k is 1:
[Formula 5]
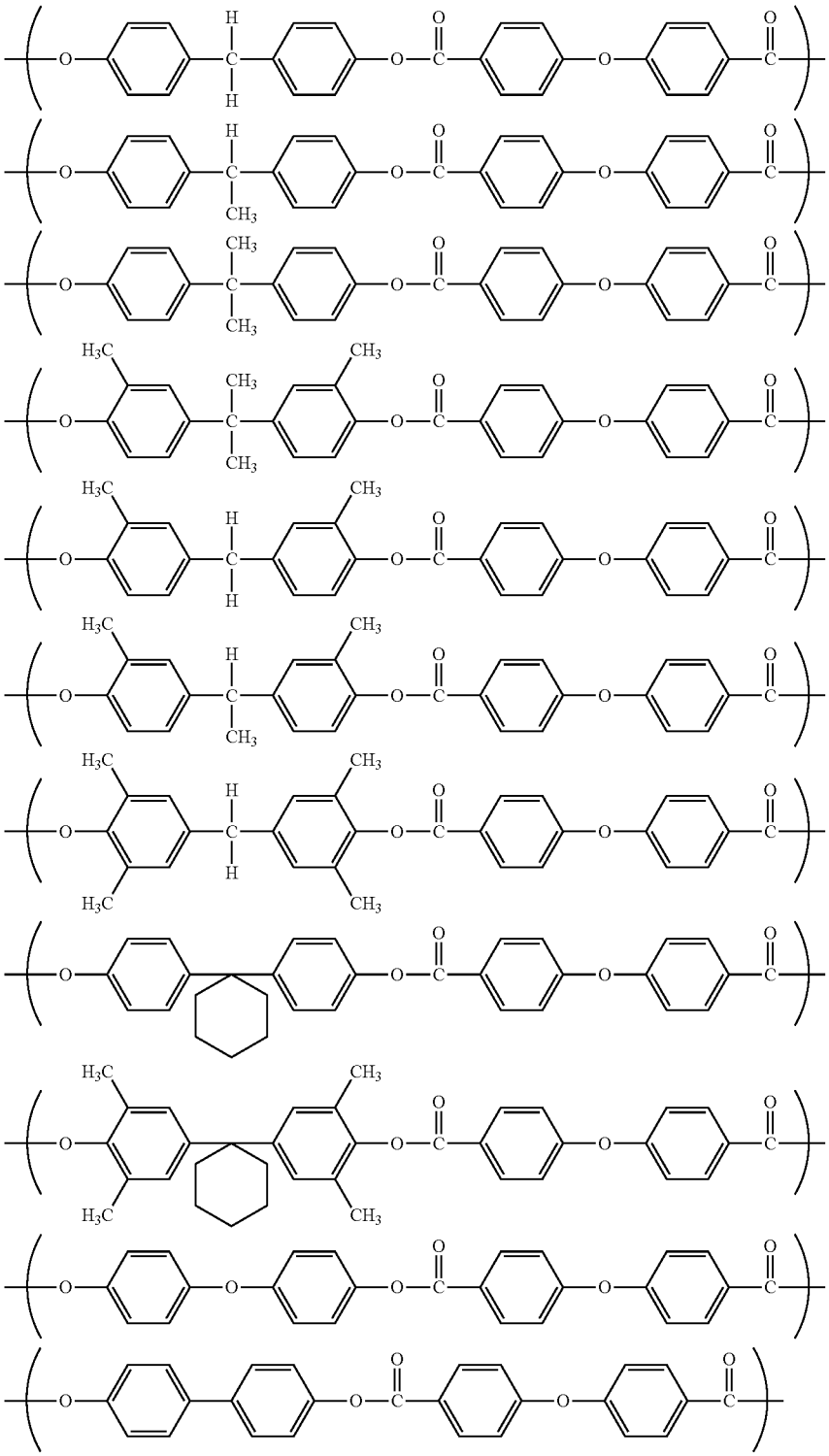
[Formula 6]
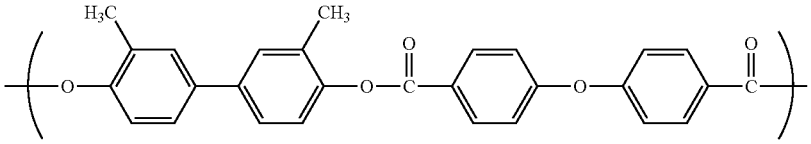

-continued

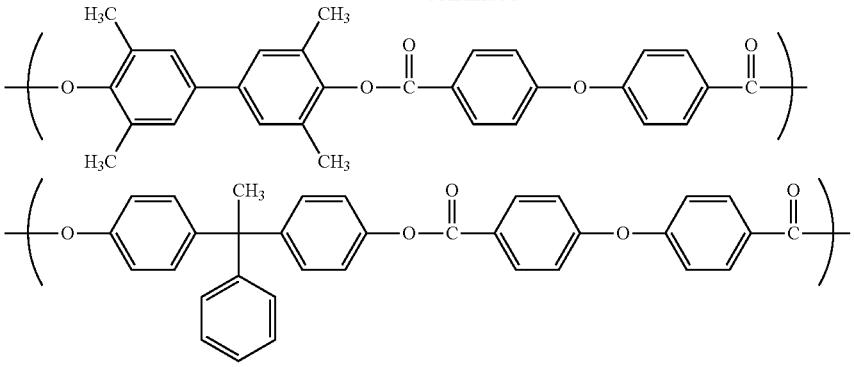

Not significantly detracting from the effect of the invention, the amount of the repeating structure of formula (1) that the polyarylate resin (1) has may be any arbitrary one. However, the ratio by weight of the repeating structure moiety is preferably larger from the viewpoint of the electric properties and the abrasion resistance. Concretely, the ratio of the repeating structure of formula (1) to the polyarylate resin (1) is preferably 50% or more by weight, more preferably 70% or more by weight, even more preferably 80% or more by weight; and still more preferably, all the repeating structures that the polyarylate resin (1) has are the structures of formula (1).

Regarding specific examples of the acid component to form the polyarylate resin (1), preferably, a dicarboxylic acid component having the following structure is used.

[Formula 7]

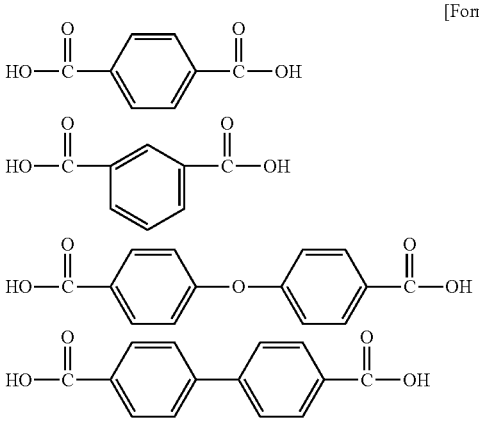

Of the above, more preferred is an acid component having the following structure from the viewpoint of the electric properties and the abrasion resistance.

[Formula 8]

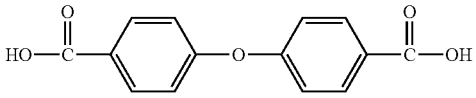

On the other hand, the diol component to form the polyarylate resin (1) includes, for example, bisphenol compounds, biphenol compounds, etc. One or more different types of such diol components may be used here either singly or as combined in any desired manner and in any desired ratio.

Specific examples of the components are biphenol compounds such as 4,4'-biphenol, 3,3'-dimethyl-4,4'-dihydroxy-1,1'-biphenyl, 3,3'-di(t-butyl)-4,4'-dihydroxy-1,1'-biphenyl, 3,3',5,5'-tetramethyl-4,4'-dihydroxy-1,1'-biphenyl, 3,3',5,5'-tetra(t-butyl)-4,4'-dihydroxy-1,1'-biphenyl, 2,2',3,3',5,5'-hexamethyl-4,4'-dihydroxy-1,1'-biphenyl, 2,4'-biphenol, 3,3'-dimethyl-2,4'-dihydroxy-1,1'-biphenyl, 3,3'-di(t-butyl)-2,4'-dihydroxy-1,1'-biphenyl, 2,2'-biphenol, 3,3'-dimethyl-2,2'-dihydroxy-1,1'-biphenyl, 3,3'-di(t-butyl)-2,2'-dihydroxy-1,1'-biphenyl, etc.;

bisphenol compounds not having a substituent on the aromatic ring, such as bis(4-hydroxyphenyl)methane, 1,1-bis(4-hydroxyphenyl)ethane, 1,1-bis(4-hydroxyphenyl)propane, 2,2-bis(4-hydroxyphenyl)propane, 1,1-bis(4-hydroxyphenyl)butane, 2,2-bis(4-hydroxyphenyl)butane, 1,1-bis(4-hydroxyphenyl)pentane, 2,2-bis(4-hydroxyphenyl)pentane, 3,3-bis(4-hydroxyphenyl)pentane, 2,2-bis(4-hydroxyphenyl)-3-methylbutane, 1,1-bis(4-hydroxyphenyl)hexane, 2,2-bis(4-hydroxyphenyl)hexane, 3,3-bis(4-hydroxyphenyl)hexane, 2,2-bis(4-hydroxyphenyl)-4-methylpentane, 1,1-bis(4-hydroxyphenyl)cyclopentane, 1,1-bis(4-hydroxyphenyl)cyclohexane, etc.;

bisphenol compounds having an aryl group as the substituent on the aromatic ring, such as bis(3-phenyl-4-hydroxyphenyl)methane, 1,1-bis(3-phenyl-4-hydroxyphenyl)ethane, 1,1-bis(3-phenyl-4-hydroxyphenyl)propane, 2,2-bis(3-phenyl-4-hydroxyphenyl)propane, etc.;

bisphenol compounds having an alkyl group as the substituent on the aromatic group, for example, bis(4-hydroxy-3-methylphenyl)methane, 1,1-bis(4-hydroxy-3-methylphenyl)ethane, 1,1-bis(4-hydroxy-3-methylphenyl)propane, 2,2-bis(4-hydroxy-3-methylphenyl)propane, 1,1-bis(4-hydroxy-3-methylphenyl)cyclohexane, etc.;

bis(4-hydroxy-3-ethylphenyl)methane, 1,1-bis(4-hydroxy-3-ethylphenyl)ethane, 1,1-bis(4-hydroxy-3-ethylphenyl)propane, 2,2-bis(4-hydroxy-3-ethylphenyl)propane, 1,1-bis(4-hydroxy-3-ethylphenyl)cyclohexane, etc.;

2,2-bis(4-hydroxy-3-isopropylphenyl)propane, 2,2-bis(4-hydroxy-3-(sec-butyl)phenyl)propane, bis(4-hydroxy-3,5-dimethylphenyl)methane, 1,1-bis(4-hydroxy-3,5-dimethylphenyl)ethane, 2,2-bis(4-hydroxy-3,5-dimethylphenyl)propane, 1,1-bis(4-hydroxy-3,5-dimethylphenyl)cyclohexane, bis(4-hydroxy-3,6-dimethylphenyl)methane, 1,1-bis(4-hydroxy-3,6-dimethylphenyl)ethane, 2,2-bis(4-hydroxy-3,6-dimethylphenyl)propane, bis(4-hydroxy-2,3,5-trimethylphenyl)methane, 1,1-bis(4-hydroxy-2,3,5-trimethylphenyl)ethane, 2,2-bis(4-hydroxy-2,3,5-trimethylphenyl) propane, bis(4-hydroxy-2,3,5-trimethylphenyl) phenylmethane, 1,1-bis(4-hydroxy-2,3,5-trimethylphenyl) phenylethane, 1,1-bis(4-hydroxy-2,3,5-trimethylphenyl) cyclohexane, etc.;

bisphenol compounds where the divalent group linking the aromatic groups has an aryl group as the substituent, such as bis(4-hydroxyphenyl)(phenyl)methane, 1,1-bis(4-hydroxyphenyl)-1-phenylethane, 1,1-bis(4-hydroxyphenyl)-1-phenylpropane, bis(4-hydroxyphenyl)(diphenyl)methane, bis(4-hydroxyphenyl)(dibenzyl)methane, etc.

Of the above, those having the following structure are preferred for the diol component.

[Formula 9]

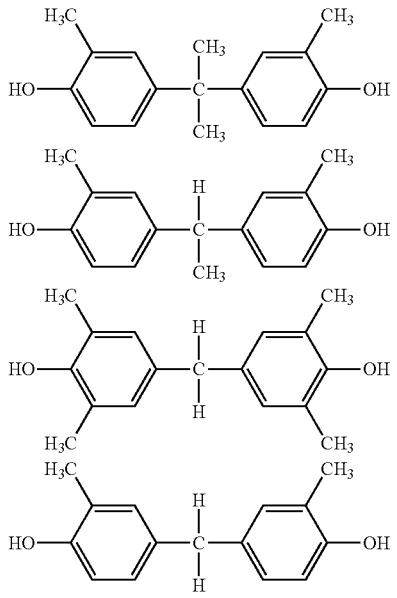

<B. Physical Properties>

Not significantly detracting from the effect of the invention, the viscosity-average molecular weight of the polyarylate resin may be any arbitrary one, and is preferably 10000 or more, more preferably 20000 or more, and its uppermost limit is preferably 70000 or less, more preferably 50000 or less. In case where the viscosity-average molecular weight of the polyarylate resin is too small, the mechanical strength thereof may be insufficient; but when too large, the viscosity of the coating liquid for forming the photosensitive layer would be too high and the producibility may lower. The viscosity-average molecular weight may be measured, for example, according to the method described in the section of Examples and using an Ubbelohde capillary viscometer.

Not significantly detracting from the effect of the invention, the amount of the carboxyl group existing at the terminal of the polyarylate resin may be any arbitrary one, and may be generally 30 μeq/g or less of the polyarylate resin, preferably 15 μeq/g or less, more preferably 10 μeq/g or less, even more preferably 5 μeq/g or less. When the amount of the terminal carboxyl group is too much, the electric properties may worsen, for example, the surface potential may increase. The polyarylate resin having a smaller terminal carboxyl group amount would be more effective for preventing decomposition of charge-transporting substances.

The terminal carboxyl group amount may be quantified, for example, by heating and dissolving an accurately-weighed polyarylate resin in benzyl alcohol followed by titrating it with a 0.01 N sodium hydroxide/benzyl alcohol solution.

The nitrogen amount in the molecular chain of the polyarylate resin may be generally 100 ppm or less of the polyarylate resin, preferably 50 ppm or less, more preferably 20 ppm or less. When the nitrogen amount is too much, the electric properties may worsen, for example, the surface potential may increase.

The nitrogen amount in the polyarylate resin may be measured, for example, with Mitsubishi Chemical's total nitrogen analyzer (TN-10).

The amount of the acid chloride group (—COCl) remaining at the terminal of the polyarylate resin may be generally 1 μeq/g or less of the polyarylate resin, preferably 0.3 μeq/g or less, more preferably 0.1 μeq/g or less. When the acid chloride group amount is too much, the storage stability may lower.

The terminal acid chloride group amount may be determined, for example, as follows. An accurately-weighed polyarylate resin is dissolved in methylene chloride, then 1 wt. % 4-(p-nitrobenzyl)pyridine/methylene chloride solution is added thereto for coloration, and the absorbance of the system is measured at a wavelength of 440 nm. Separately, the absorbance coefficient is determined using a methylene chloride solution of benzoyl chloride, and the acid chloride group amount in the polyarylate resin is thereby quantified.

Not significantly detracting from the effect of the invention, the amount of the hydroxyl group existing at the terminal of the polyarylate resin may be any arbitrary one, but is preferably 50 μeq/g or less, more preferably 20 μeq/g or less. When the hydroxyl group amount is too much, the electric properties may worsen, for example, the surface potential may increase.

The terminal hydroxyl group amount may be quantified, for example, through acetic acid acidification followed by coloration with titanium chloride and further followed by absorbance measurement at a wavelength of 480 nm.

[1-3-2. Charge-Transporting Substance]

In the invention, the charge-transporting substance is not specifically defined. The molecular weight of the charge-transporting substance may be generally 250 or more, preferably 300 or more, more preferably 320 or more, even more preferably 350 or more, and its uppermost limit may be generally 460 or less, preferably 450 or less, more preferably 430 or less, even more preferably 410 or less. When the molecular weight is too small, the charge-transporting substance may sublime in drying after coating, and the content of the charge-transporting substance in the photosensitive layer would be difficult to control; but when too large, there may occur noise owing to sliding friction against cleaning blade.

In the invention, usable is a charge-transporting substance having a specific HOMO energy level E_homo as obtained as a result of geometry optimization calculation with B3LYP/6-31G(d,p) of charge-transporting substance. Concretely, the HOMO energy level E_homo is generally −4.67 eV or more, preferably −4.65 eV or more, more preferably −4.63 eV or more, even more preferably −4.61 eV or more.

Having a higher E_homo, the substance may give a more excellent electrophotographic photoreceptor having a lower potential after exposure. In particular, when a polyarylate resin is used as the binder resin, the potential after exposure tends to increase as compared with the case of using a polycarbonate resin; and therefore in the invention, it is important that the E_homo is defined to fall within the above range. However, when E_homo is too high, then there may occur some inconvenience such as vapor resistance reduction, ghost generation, etc. Therefore, the uppermost limit is preferably −4.30 eV or less, more preferably −4.50 eV or less, even more preferably −4.56 eV or less.

In the electrophotographic photoreceptor in the invention, E_homo may be determined by obtaining the stable structure through geometry optimization calculation using B3LYP as a type of density functional calculation (see A. D. Becke, J. Chem. Phys., 98, 5648 (1993); C. Lee, W. Yang, and R. G. Parr, Phys. Rev. B37, 785 (1988); and B. Miehlich, A. Savin, H. Stoll, and H. Preuss, Chem. Phys. Lett., 157, 200 (1989)). In this, as the basis function system, used was 6-31G with a polarization function added thereto, 6-31G(d,p) (see R. Ditchfield, W. L. Hehre, and J. A. Pople, J. Chem. Phys., 54, 724 (1971); W. J. Hehre, R. Ditchfield, and J. A. Pople, J. Chem. Phys., 56, 2257 (1972); P. C. Hariharan and J. A. Pople, Mol. Phys., 27, 209 (1974); M. S. Gordon, Chem. Phys. Lett., 76, 163 (1980); P. C. Hariharan and J. A. Pople, Theo. Chim. Acta 28, 213 (1973); J.-P. Blaudeau, M. P. McGrat, L. A. Curtiss, and L. Radom, J. Chem. Phys., 107, 5016 (1997); M. M. Francl, W. J. Pietro, W. L, Hehre, J. S. Binkley, D. J. Defrees, J. A. Pople, and M. S. Gordon, J. Chem. Phys., 77, 3654 (1982); R. C. Binning Jr., and L. A. Curtiss, J. Comp. Chem., 11, 1206 (1990); V. A. Rassolov, J. A. Pople, M. A. Ratner, and T. L. Windus, J. Chem. Phys., 109, 1223 (1998); and V. A. Rassolov, M. A. Ratner, J. A. Pople, P. C. Redfern, and L. A. Curtiss, J. Comp. Chem., 22, 976 (2001)).

In the invention, the B3LYP calculation with 6-31G(d,p) is referred to as "B3LYP/6-31G(d,p)".

The program used in the B3LYP/6-31G(d,p) calculation is Gaussian 03, Revision D.01 (M. J. Frisch, G. W. Trucks, H. B. Schlegel, G. E. Scuseria, M. A Robb, J. R Cheeseman, J. A. Montgomery, J R., T. Vreven, K. N. Kudin, J. C. Burant, J. M. Millam, S. S. Lyengar, J. Tomasi, V. Barone, B. Mennucci, M. Cossi, G. Scalmani, N. Rega, G. A. Petersson, H. Nakatsuji, M. Hada, M. Ehara, K. Toyota, R. Fukuda, J. Hasegawa, M. Ishida, T. Hakajima, Y. Honda, O. Kitao, H. Nakai, M. Klene, X. Li, J. F. Knox, H. P. Hratchian, J. B. Cross, V. Bakken, C. Adamo, J. Jaramillo, R. Gomperts, R. E. Startmann, O. Yazyev, A. J. Austin, R. Cammi, C. Pomelli, J. W. Ochterski, P. Y. Ayala, K. Morokuma, G. A. Voth, P. Salvador, J. J. Dennenberg, V. G. Zakrzewski, S. Dapprich, A. D. Daniels, M. C. Strain, O. Farkas, D. K. Malick, A. D. Rabuck, K. Raghavachari, J. B. Foresman, J. V. Ortiz, Q. Cui, A. G. Baboul, S. Clifford, J. Cioslowski, B. B. Stefanov, G. Liu, A. Liashenko, P. Piskorz, I. Komaromi, R. L. Martin, D. J. Fox, T. Keith, M. A. Al-Laham, C. Y. Peng, A. Nanayakkara, M. Challacombe, P. M. W. Gill, B. Johnson, W. Chen, M. W. Wong, C. Gonzalez, and J. A. Pople, Gaussian Inc., Wallingford Conn., 2004).

In case where a polyarylate resin is used as the binder resin, and when the molecular weight of CTM is defined low, then the effect of preventing noise may be more remarkably attained. Specifically, combining a polyarylate resin and a charge-transporting substance having the above-mentioned molecular weight and E_homo gives an electrophotographic photoreceptor excellent in abrasion resistance and free from cleaning failure, filming, soiling, residual images (ghosts), density reduction, noise and the like troubles. Though not clear, the reason would be because the charge-transporting substance having a smaller molecular weight could be more effective for improving the slidability of the surface of a photoreceptor when combined with a polyarylate resin, and in addition, since the charge-transporting substance having a high E_homo is used, the potential after exposure could be held on a practical level.

Having the above-mentioned molecular weight and E_homo, the charge-transporting substance may be any compound. Specific examples of the charge-transporting substance include enamine derivatives, carbazole derivatives, aniline derivatives, hydrazone derivatives, aromatic amine derivatives, stilbene derivatives, butadiene derivatives, and combinations of plural types of those compounds, etc. One or more such charge-transporting substances may be used here either singly or as combined in any desired manner and in any desired ratio.

As the charge-transporting substance having the above-mentioned molecular weight and E_homo, preferred are stilbene derivatives. Typical examples of the stilbene derivatives are the following compounds. However, the stilbene derivatives for use in the invention are not limited to these compounds. One or more different types of such stilbene derivatives may be used here either singly or as combined in any desired manner and in any desired ratio.

[Formula 10]

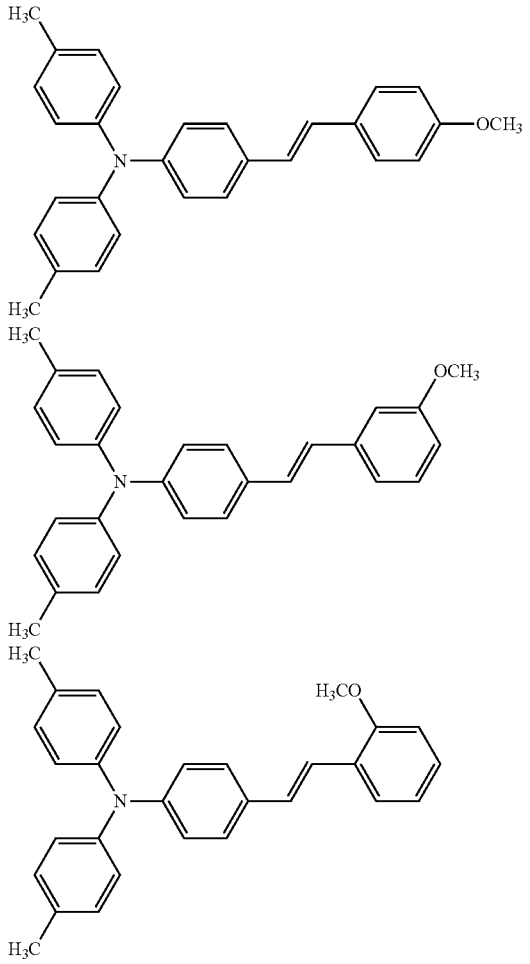

-continued

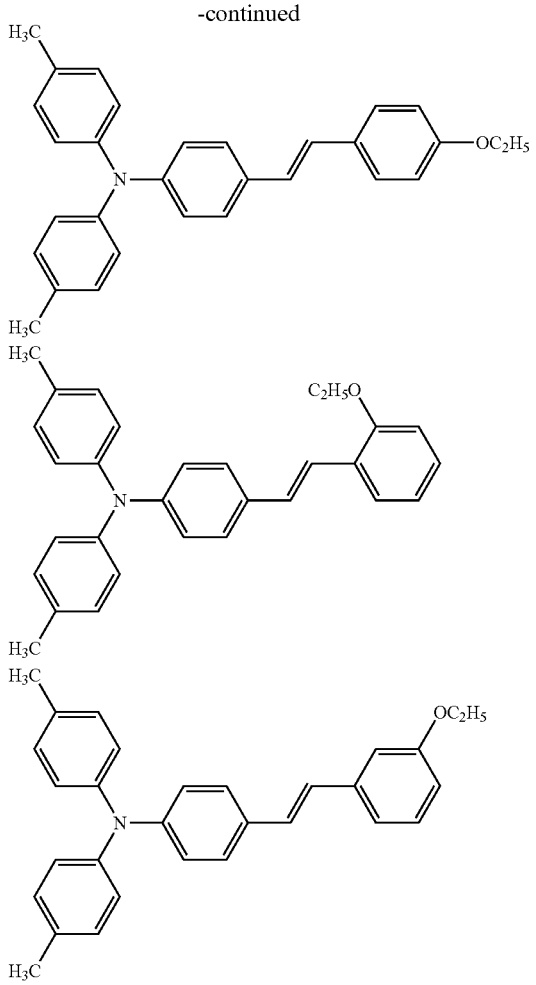

From the viewpoint of readily exhibiting the effect of the invention, charge-transporting substances represented by the following formula (A) are especially preferred as the charge-transporting substance having the above-mentioned molecular weight and E_homo.

[Formula 11]

(A)

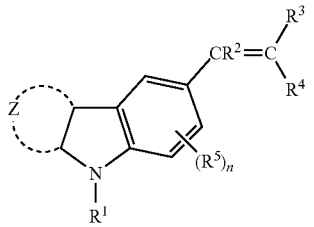

In formula (A), $R^1$ to $R^4$ each independently represent a hydrogen atom, an alkyl group optionally having a substituent, or an aryl group optionally having a substituent; $R^5$ represents an alkyl group optionally having a substituent, or an aryl group optionally having a substituent; n indicates an integer of from 0 to 3; the ring Z represents a saturated 5- to 8-membered ring to be formed along with the two carbon atoms of the indoline ring, in which the two hydrogen atoms existing on the two carbon atoms are in a cis-configuration.

$R^1$ to $R^4$ each independently represent a hydrogen atom, an alkyl group optionally having a substituent, or an aryl group optionally having a substituent, and $R^5$ represents an alkyl group optionally having a substituent, or an aryl group optionally having a substituent.

In case where $R^1$ to $R^5$ each are an alkyl group, the carbon number of the alkyl group may be any arbitrary one not significantly detracting from the effect of the invention, and may be generally 1 or more, and its uppermost limit may be generally 10 or less, preferably 6 or less, more preferably 3 or less. When the carbon number is too large, then the electric properties may worsen.

Specific examples of the alkyl group includes a methyl group, an ethyl group, a propyl group, etc.

In case where $R^1$ to $R^5$ each are an aryl group, the carbon number of the aryl group may be any arbitrary one not significantly detracting from the effect of the invention, and may be generally 6 or more, and its uppermost limit may be generally 14 or less, preferably 13 or less, more preferably 10 or less. When the carbon number is too large, then the electric properties may worsen.

Specific examples of the aryl group includes a phenyl group, a naphthyl group, an anthryl group, a phenanthryl group, a fluorenyl group, etc. Of those, preferred are a phenyl group and a naphthyl group in consideration of the properties of the electrophotographic photoreceptor, and more preferred is a phenyl group.

The substituent that the alkyl group and the aryl group may have may be any arbitrary one not significantly detracting from the effect of the invention, and includes, for example, an alkyl group, an aryl group, an alkoxy group, an aryloxy group, etc. The group may be substituted with one or more such substituents either singly or as combined in any desired manner and in any desired ratio.

Above all, $R^1$ is preferably an aryl group optionally having a substituent, more preferably an aryl group having a substituent.

The substituent that the aryl group may have is preferably an alkyl group such as a methyl group, an ethyl group, a propyl group, or an alkoxy group such as a methoxy group, an ethoxy group, a propoxy group; more preferred are an alkyl group and a methoxy group, and even more preferred is a methyl group. Specifically, $R^1$ is especially preferably a p-tolyl group as capable of securing well-balanced electric properties. Having a p-tolyl group, the compound secures an increased E_homo and readily attains good electric properties.

$R^2$ is preferably a hydrogen atom, or an alkyl group optionally having a substituent, and more preferably a hydrogen atom in view of the easiness in producing the compounds.

$R^3$ and $R^4$ each are preferably an alkyl group optionally having a substituent, or an aryl group optionally having a substituent, and more preferably an aryl group optionally having a substituent from the viewpoint of the electric properties.

The aryl group is preferably a phenyl group. The substituent that the aryl group may have is preferably an alkyl group such as a methyl group, an ethyl group, a propyl group, or an alkoxy group such as a methoxy group, an ethoxy group, a propoxy group; more preferred are an alkyl group and a methoxy group, and even more preferred is a methyl group.

Of those mentioned above, especially preferred is an unsubstituted phenyl group.

Preferably, $R^5$ is absent (that is, n=0), or an alkyl group optionally having a substituent; and from the viewpoint of producibility, $R^5$ is absent.

n is an integer of from 0 to 3, and especially preferably n=0.

The ring Z represents a saturated 5- to 8-membered ring to be formed along with the two carbon atoms of the indoline ring.

Above all, in view of the easiness in production of the compounds, the ring Z is preferably a 5- or 6-membered ring, more preferably a 5-membered ring. Two hydrogen atoms existing on the two carbon atoms that are common to the ring Z and the indoline ring may have cis-configuration or trans-configuration. The present inventors' investigations have revealed that the trans-configuration produces strain in the 5-membered ring therefore lowering E_homo, but the cis-configuration secures high E_homo and provides good electric properties.

One example of the data of E_homo of cis-configuration and trans-configuration. However, the compounds shown below are examples of charge-transporting substance, and the charge-transporting substance in the electrophotographic photoreceptor in the invention is not limited to the compounds described below.

TABLE 1

| Structural Formula | E_homo (eV) |
|---|---|
| 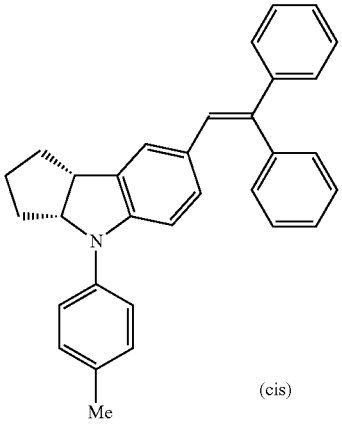 (cis) | −4.61 |
| 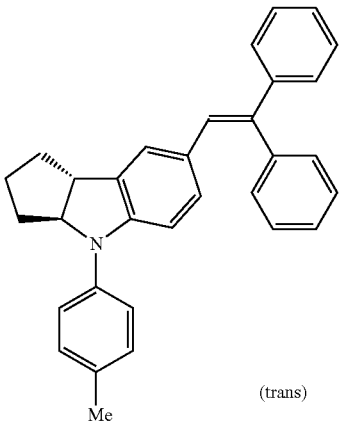 (trans) | −4.73 |

Specific examples of the compounds of formula (A) are shown below.

[Formula 12]

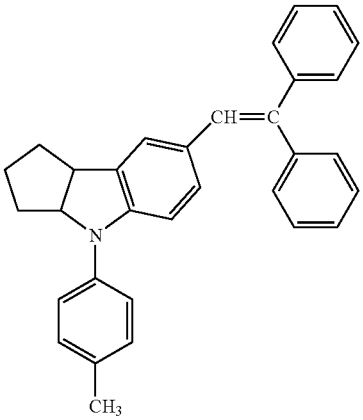

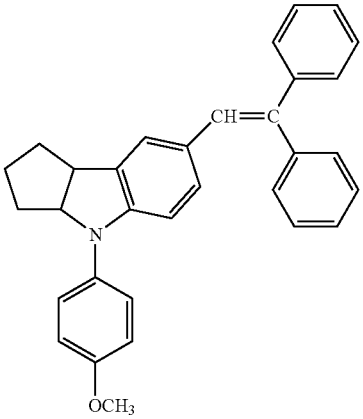

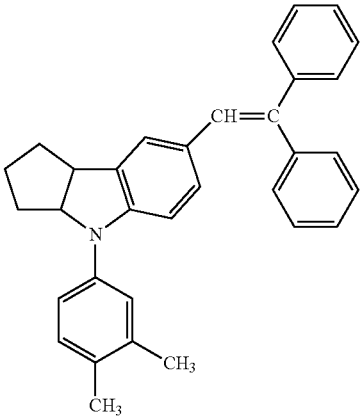

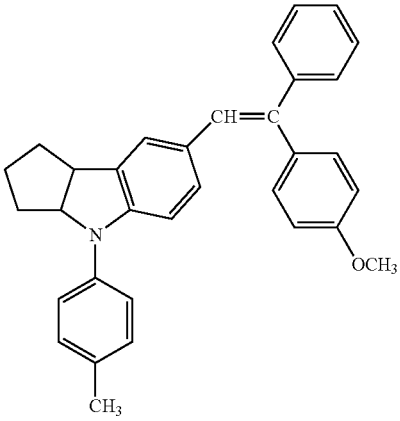

-continued
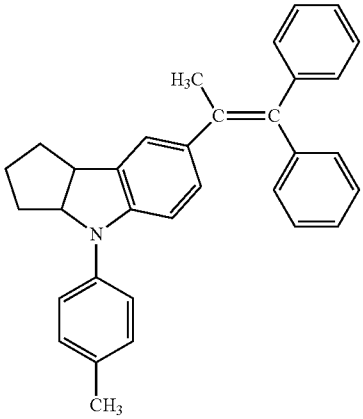
-continued
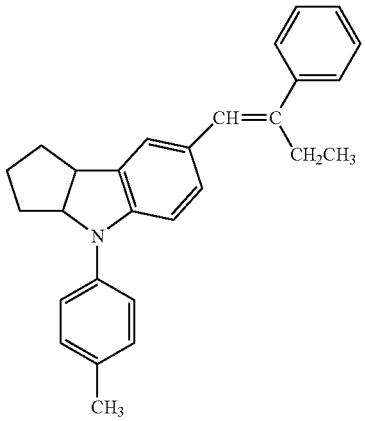
[Formula 13]
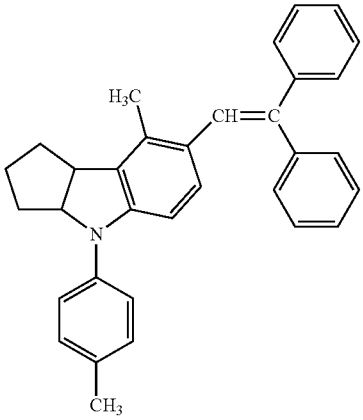
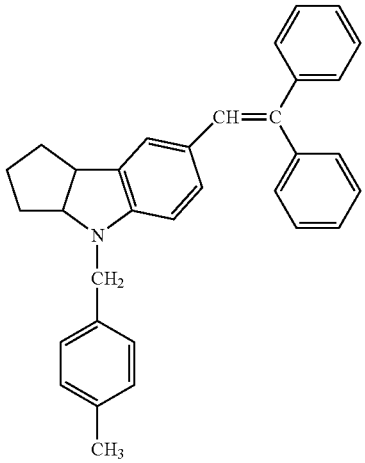
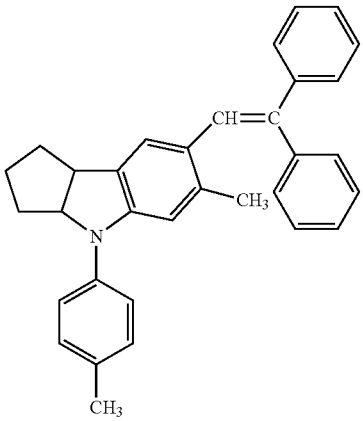
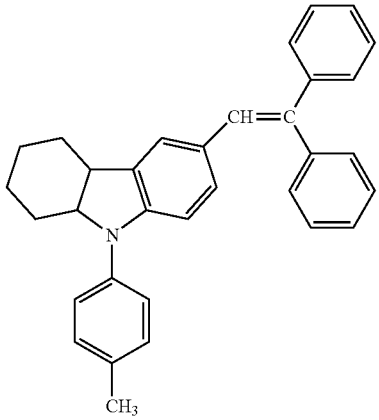
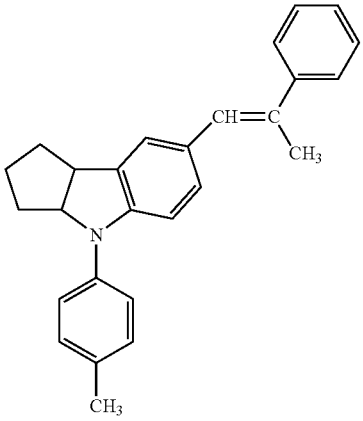
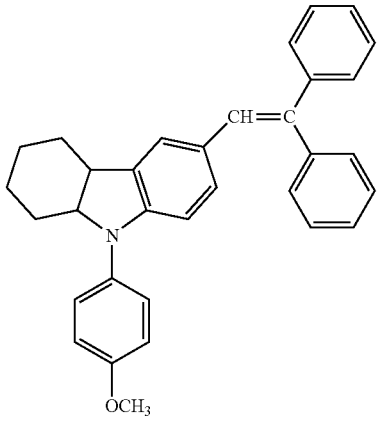

-continued

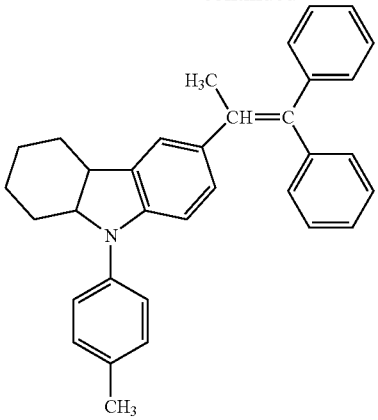

The charge-transporting substance having the above-mentioned molecular weight and E_homo for use in the invention may be combined with any other charge-transporting substance not satisfying the range of the above-mentioned molecular weight and E_homo; but for fully exhibiting the effect of the invention, the amount of the charge-transporting substance falling within the range specifically defined in the invention is generally 30% or more by weight of all the charge-transporting substances contained in the photosensitive layer, more preferably, 50% or more by weight, even more preferably 80% or more by weight, especially preferably 100% by weight.

The amount of the charge-transporting substance having the above-mentioned molecular weight and E_homo may be generally 30 parts or more by weight relative to 100 parts by weight of the binder resin for fully exhibiting the effect of the invention, preferably 40 parts or more by weight, more preferably 50 parts or more by weight, and its uppermost limit is preferably 120 parts or less by weight, more preferably 100 parts or less by weight, even more preferably 80 parts or less by weight.

When the charge-transporting substance having the above-mentioned molecular weight and E_homo is incorporated in the photosensitive layer along with the above-mentioned polyarylate resin, then the combination could exhibit especially excellent abrasion resistance and electric properties.

Specific examples of the charge-transporting substance preferred for use in the invention are described below along with the data of the molecular weight and E_homo thereof. "Me" means a methyl group.

TABLE 2

| Compound | Structural Formula | Molecular Weight | E_homo (eV) |
|---|---|---|---|
| 1 | 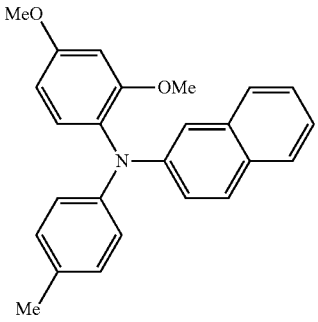 | 369.5 | −4.61 |

TABLE 2-continued

| Compound | Structural Formula | Molecular Weight | E_homo (eV) |
|---|---|---|---|
| 2 | 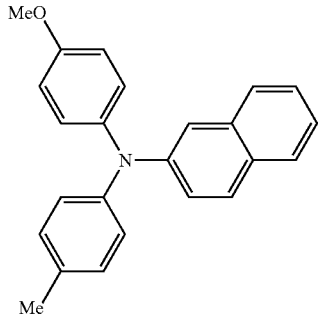 | 355.4 | −4.61 |
| 3 | 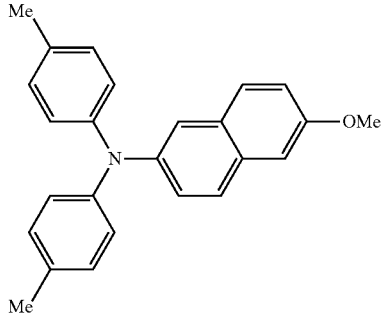 | 353.5 | −4.65 |
| 4 | 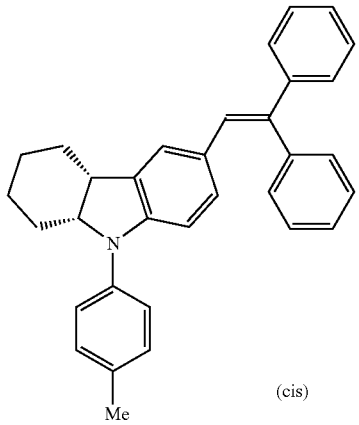 (cis) | 441.6 | −4.60 |
| 5 | 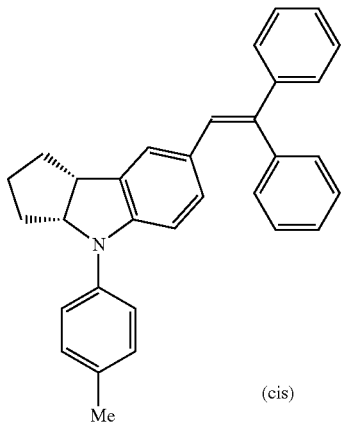 (cis) | 427.6 | −4.61 |

<Other Charge-Transporting Substances>

In the invention, any other charge-transporting substance not falling within the range of the above-mentioned molecular weight and E_homo may be used as combined with the charge-transporting substance having the above-mentioned molecular weight and E_homo, or may be used singly by itself.

Examples of the other charge-transporting substance not falling within the range of the above-mentioned molecular weight and E_homo include electron-attracting substances, for example, aromatic nitro compounds such as 2,4,7-trinitrofluorenone, etc.; cyano compounds such as tetracyanoquinodimethane, etc.; quinone compounds such as diphenoquinone, etc.; and electron-donating substances, for example, heterocyclic compounds such as carbazole derivatives, indole derivatives, imidazole derivatives, oxazole derivatives, pyrazole derivatives, thiadiazole derivatives, benzofuran derivatives, etc.; aniline derivatives, hydrazone derivatives, aromatic amine derivatives, stilbene derivatives, butadiene derivatives, enamine derivatives, and complexes of plural types of those compounds bound with each other, as well as polymers having a group of those compounds in the main chain or in the side chain thereof, etc. Of those, preferred are carbazole derivatives, aromatic amine derivatives, stilbene derivatives, butadiene derivatives, hydrazone derivatives, enamine derivatives, and complexes of plural types of those compounds bound with each other. One or more such charge-transporting substances may be used here either singly or as combined in any desired manner and in any desired ratio.

Preferred examples of the charge-transporting substances not falling within the range of the above-mentioned molecular weight and E_homo are shown below. In the following compounds, R's may be the same or different. Concretely, R is preferably a hydrogen atom, an alkyl group, an alkoxy group, a phenyl group, an arylalkyl group or the like. More preferably, R is a methyl group, an ethyl group or a benzyl group. n is an integer of from 0 to 2.

The compounds shown below are examples of charge-transporting substances; and the charge-transporting substances not falling within the range of the above-mentioned molecular weight and E_homo for use herein are not limited to the compounds shown below.

[Formula 14]

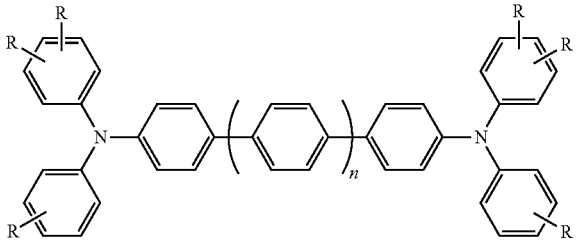

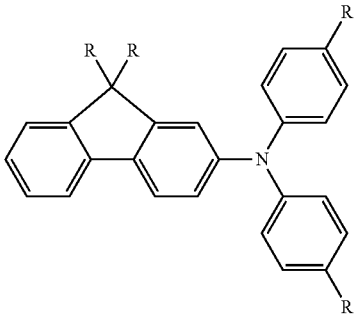

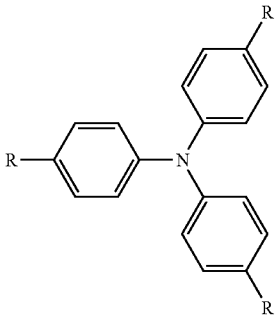

-continued
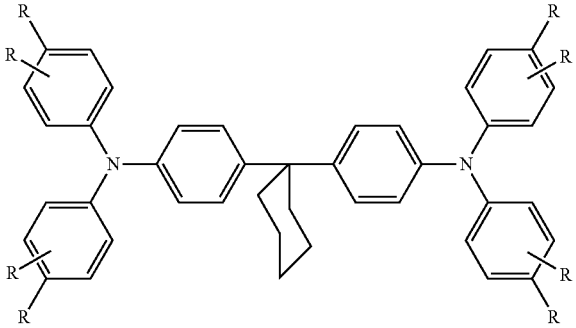
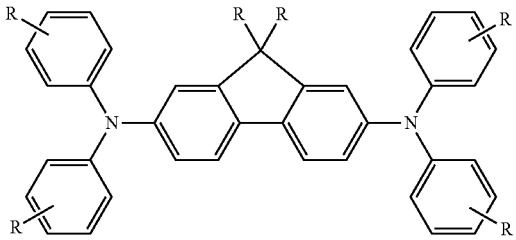
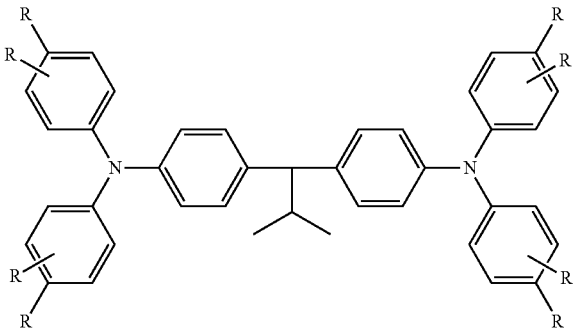
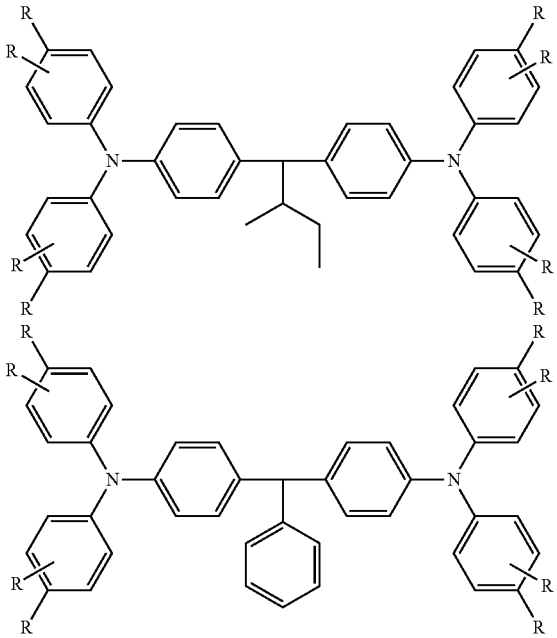

-continued
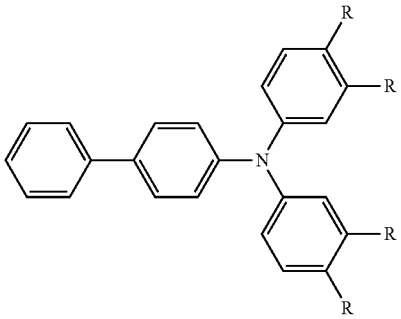
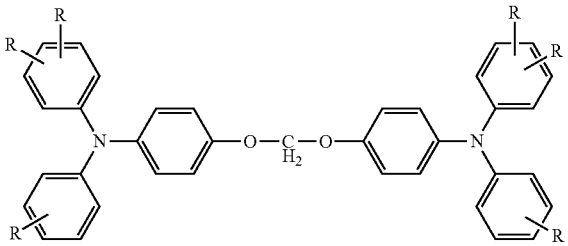
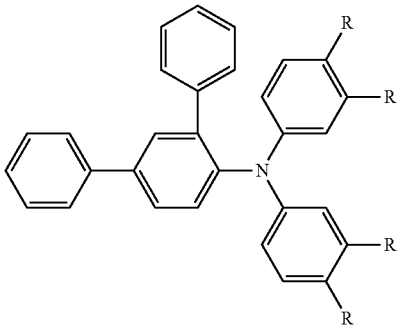
[Formula 15]
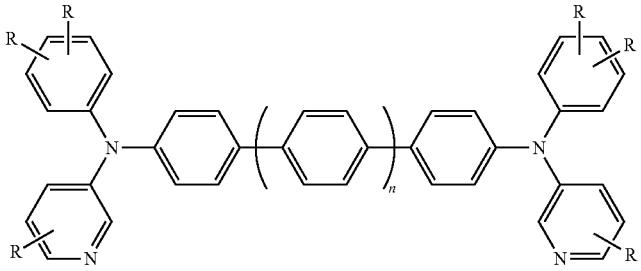
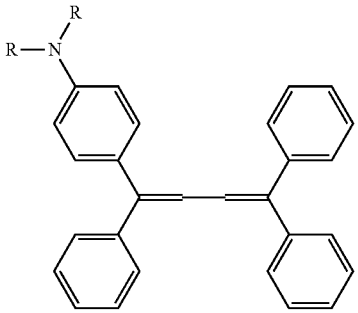

-continued
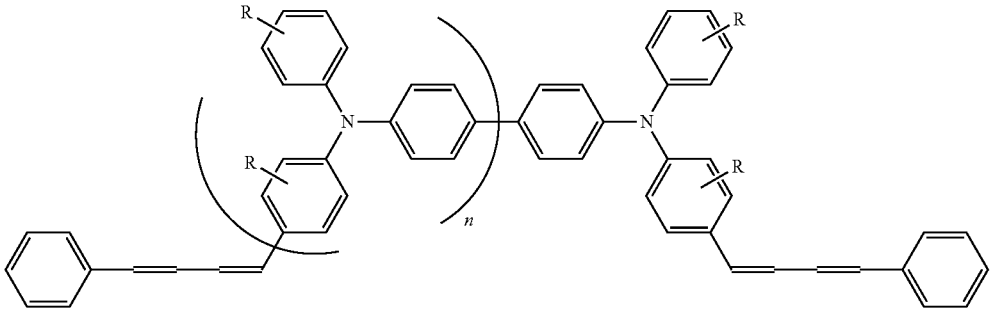
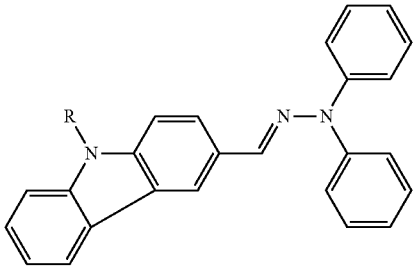
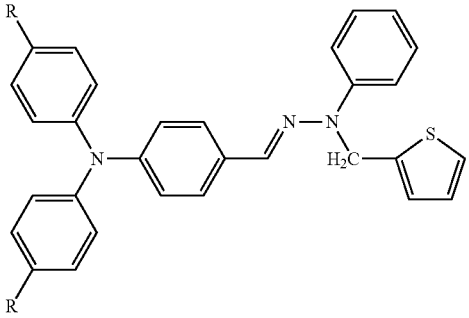
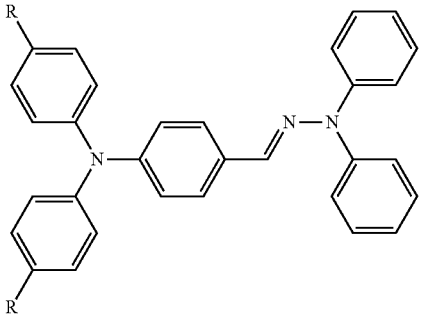
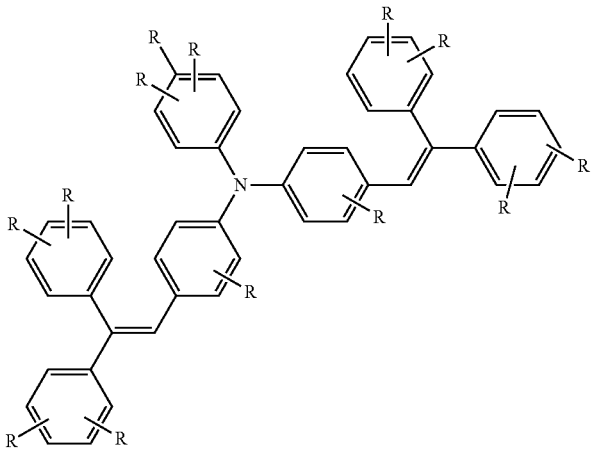

-continued
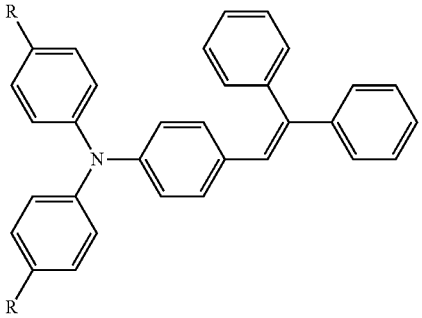
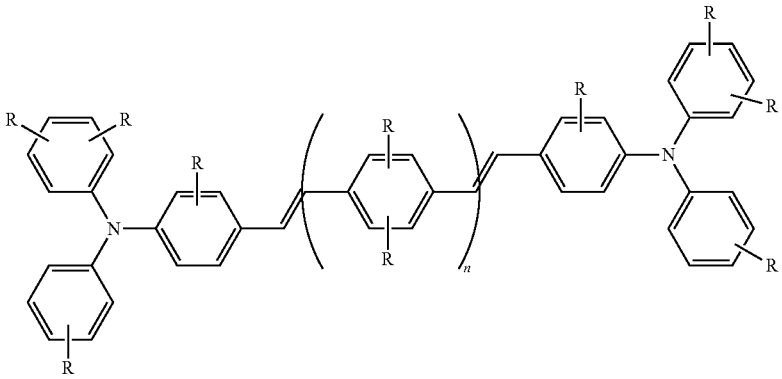
[Formula 16]
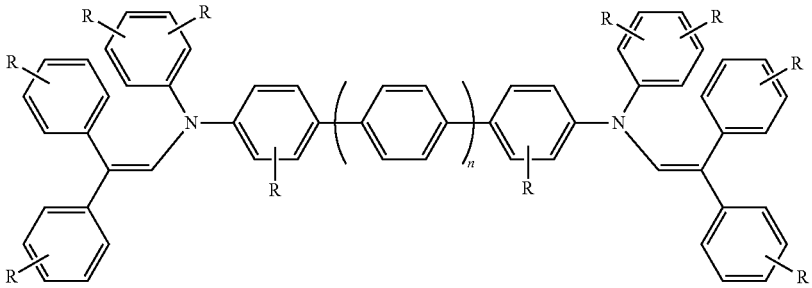
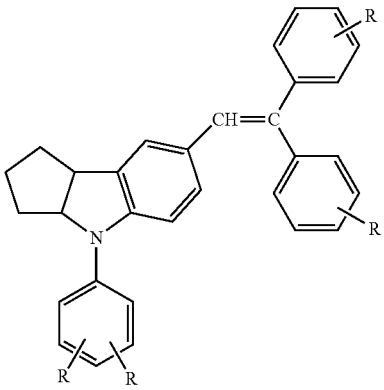

As the charge-transporting substance for use in the invention, preferred are the following compounds of those mentioned above.

[Formula 17]

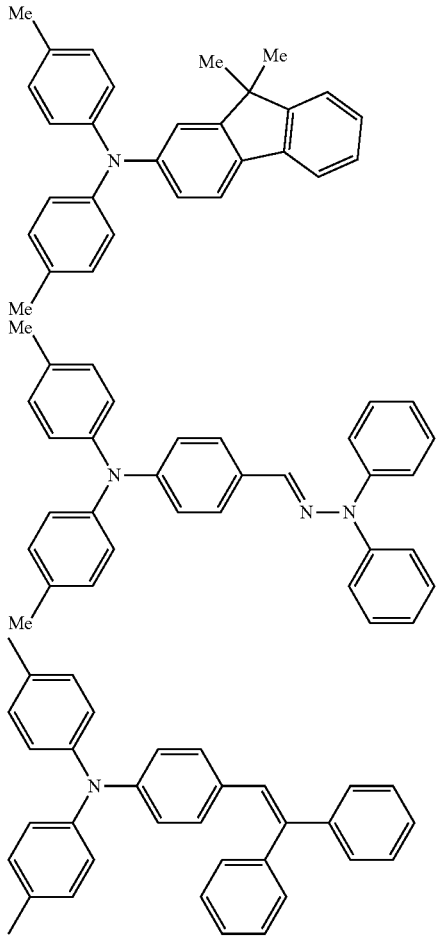

[1-3-3. Other Components]

<Other Binder Resin than Polyarylate Resin>

The photosensitive layer of the electrophotographic photoreceptor in the invention contains at least a polyarylate resin and a specific charge-transporting substance. However, the layer may additionally contain, as a binder resin, any other resin than the polyarylate resin. In this case, it is desirable that the polyarylate resin accounts for generally 30% or more by weight of all the binder resins in the charge transport layer of the multilayer photoreceptor or in the photosensitive layer of the single-layer photoreceptor, preferably 50% or more by weight, more preferably 80% or more by weight, even more preferably 100% by weight.

In forming the charge transport layer of the function-separated photoreceptor (that is, multilayer photoreceptor) having a charge generation layer and a charge transport layer, or forming the photosensitive layer of the single-layer photoreceptor, in general, a binder resin for dispersing compounds is used for the purpose of securing the layer strength. The charge transport layer of the multilayer photoreceptor may be formed by dissolving or dispersing a charge-transporting substance and various binder resins in a solvent, and applying the resulting coating liquid onto a support and drying it. The single-layer photoreceptor may be formed by dissolving or dispersing a charge-generating substance, a charge-transporting substance and various binder resins in a solvent, and applying the resulting coating liquid onto a support and drying it.

The binder resin usable here as combined with the polyarylate resin includes, for example, butadiene resins, styrene resins, vinyl acetate resins, vinyl chloride resins, acrylate resins, methacrylate resins, vinyl alcohol resins, polymers and copolymers of a vinyl compound such as ethyl vinyl ether or the like, polyvinylbutyral resins, polyvinyl formal resins, partially-modified polyvinyl acetals, polycarbonate resins, polyester resins, polyamide resins, polyurethane resins, cellulose ester resins, phenoxy resins, silicone resins, silicone-alkyd resins, poly-N-vinylcarbazole resins, etc. These resins may be modified with a silicon reagent or the like. Of the above-mentioned binder resins, preferred are polycarbonate resins. One or more such binder resins may be used here either singly or as combined in any desired manner and in any desired ratio.

The polycarbonate resin that may be used here as combined with the polyarylate resin is preferably a polycarbonate resin having a repeating structure of the following formula (2):

[Formula 18]

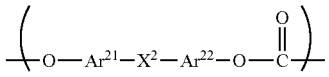

(2)

(In formula (2), $Ar^{21}$ and $Ar^{22}$ each independently represent an arylene group optionally having a substituent. $X^2$ represents single bond or divalent linking group.)

In the above formula (2), $Ar^{21}$ and $Ar^{22}$ each independently represent an arylene group optionally having a substituent. The arylene group includes, for example, a 1,2-phenylene group, a 1,3-phenylene group, a 1,4-phenylene group, a naphthylene group, an anthrylene group, a phenanthrylene group. From the viewpoint of the electric properties, preferred is a 1,4-phenylene group.

Optionally, $Ar^{21}$ and $Ar^{22}$ each independently may have a substituent. Specific examples of the substituent include an alkyl group, an aryl group, a halogen atom, an alkoxy group, etc. Of those, the alkyl group is preferably a methyl group, an ethyl group, propyl group or an isopropyl group, the aryl group is preferably a phenyl group, or a naphthyl group, the halogen atom is preferably a fluorine atom, a chlorine atom, a bromine atom, or an iodine atom, and the alkoxy group is preferably a methoxy group, an ethoxy group, a propoxy group, or a butoxy group, in view of the mechanical properties of the binder resin for the photosensitive layer and of the solubility thereof in the photosensitive layer-forming coating liquid.

In case where the substituent is an alkyl group, the alkyl group generally has a carbon number of 1 or more, and generally 10 or less, preferably 8 or less, more preferably 2 or less.

Preferably, $Ar^{21}$ and $Ar^{22}$ are each independently unsubstituted or have one or two substituents. From the viewpoint of the contact efficiency, preferably, they each have one or two substituents; and from the viewpoint of the slidability, more preferably, they each have one substituent. The substituent is preferably an alkyl group, more preferably a methyl group.

In formula (2), $X^2$ is a single bond or a divalent linking group. Preferred examples of $X^2$ include a sulfur atom, an oxygen atom, a sulfonyl group, a carbonyl group, a cycloalkylidene group such as cyclopentylidene, cyclohexylidene, and —$CR^cR^d$—.

$R^c$ and $R^d$ each independently represent a hydrogen atom, an alkyl group, an aryl group, a halogen atom, or an alkoxy group. For $R^c$ and $R^d$, in consideration of the mechanical properties of the binder resin for the photosensitive layer and of the solubility thereof in a photosensitive layer-forming coating liquid, the alkyl group is preferably a methyl group, an ethyl group, a propyl group or an isopropyl group, the aryl group is preferably a phenyl group or a naphthyl group, the halogen atom is preferably a fluorine atom, a chlorine atom, a bromine atom or an iodine atom, and the alkoxy group is preferably a methoxy group, an ethoxy group, a propoxy group or a butoxy group.

When $R^c$ and $R^d$ each are an alkyl group, the carbon number of the alkyl group is generally 1 or more, and is generally 10 or less, but is preferably 8 or less, more preferably 2 or less.

In consideration of the convenience in producing the dihydroxy compound generally used in producing the polycarbonate resin, $X^2$ is preferably a sulfur atom, an oxygen atom, cyclohexylidene or —$CR^cR^d$—. More preferably, $X^2$ is —$CR^cR^d$—, in which, even more preferably, $R^c$ and $R^d$ each are a hydrogen atom or an alkyl group such as a methyl group. From the viewpoint of the abrasion resistance, especially preferably, at least one of $R^c$ and $R^d$ is a hydrogen atom.

The diol component to form the structure includes bisphenol compounds, biphenol compounds, etc.

Their specific examples include biphenol compounds such as 4,4'-biphenol, 3,3'-dimethyl-4,4'-dihydroxy-1,1'-biphenyl, 3,3'-di(t-butyl)-4,4'-dihydroxy-1,1'-biphenyl, 3,3',5,5'-tetramethyl-4,4'-dihydroxy-1,1'-biphenyl, 3,3',5,5'-tetra(t-butyl)-4,4'-dihydroxy-1,1'-biphenyl, 2,2',3,3',5,5'-hexamethyl-4,4'-dihydroxy-1,1'-biphenyl, 2,4'-biphenol, 3,3'-dimethyl-2,4'-dihydroxy-1,1'-biphenyl, 3,3'-di(t-butyl)-2,4'-dihydroxy-1,1'-biphenyl, 2,2'-biphenol, 3,3'-dimethyl-2,2'-dihydroxy-1,1'-biphenyl, 3,3'-di(t-butyl)-2,2'-dihydroxy-1,1'-biphenyl, etc.;

bisphenol compounds not having a substituent on the aromatic ring, such as bis(4-hydroxyphenyl)methane, 1,1-bis(4-hydroxyphenyl)ethane, 1,1-bis(4-hydroxyphenyl)propane, 2,2-bis(4-hydroxyphenyl)propane, 1,1-bis(4-hydroxyphenyl)butane, 2,2-bis(4-hydroxyphenyl)butane, 1,1-bis(4-hydroxyphenyl)pentane, 2,2-bis(4-hydroxyphenyl)pentane, 3,3-bis(4-hydroxyphenyl)pentane, 2,2-bis(4-hydroxyphenyl)-3-methylbutane, 1,1-bis(4-hydroxyphenyl)hexane, 2,2-bis(4-hydroxyphenyl)hexane, 3,3-bis(4-hydroxyphenyl)hexane, 2,2-bis(4-hydroxyphenyl)-4-methylpentane, 1,1-bis(4-hydroxyphenyl)cyclopentane, 1,1-bis(4-hydroxyphenyl)cyclohexane, etc.;

bisphenol compounds having an aryl group as the substituent on the aromatic ring, such as bis(3-phenyl-4-hydroxyphenyl)methane, 1,1-bis(3-phenyl-4-hydroxyphenyl)ethane, 1,1-bis(3-phenyl-4-hydroxyphenyl)propane, 2,2-bis(3-phenyl-4-hydroxyphenyl)propane, etc.;

bisphenol compounds having an alkyl group as the substituent on the aromatic group, for example, bis(4-hydroxy-3-methylphenyl)methane, 1,1-bis(4-hydroxy-3-methylphenyl)ethane, 1,1-bis(4-hydroxy-3-methylphenyl)propane, 2,2-bis(4-hydroxy-3-methylphenyl)propane, 1,1-bis(4-hydroxy-3-methylphenyl)cyclohexane, etc.;

bis(4-hydroxy-3-ethylphenyl)methane, 1,1-bis(4-hydroxy-3-ethylphenyl)ethane, 1,1-bis(4-hydroxy-3-ethylphenyl)propane, 2,2-bis(4-hydroxy-3-ethylphenyl)propane, 1,1-bis(4-hydroxy-3-ethylphenyl)cyclohexane, etc.;

2,2-bis(4-hydroxy-3-isopropylphenyl)propane, 2,2-bis(4-hydroxy-3-(sec-butyl)phenyl)propane, bis(4-hydroxy-3,5-dimethylphenyl)methane, 1,1-bis(4-hydroxy-3,5-dimethylphenyl)ethane, 2,2-bis(4-hydroxy-3,5-dimethylphenyl)propane, 1,1-bis(4-hydroxy-3,5-dimethylphenyl)cyclohexane, bis(4-hydroxy-3,6-dimethylphenyl)methane, 1,1-bis(4-hydroxy-3,6-dimethylphenyl)ethane, 2,2-bis(4-hydroxy-3,6-dimethylphenyl)propane, bis(4-hydroxy-2,3,5-trimethylphenyl)methane, 1,1-bis(4-hydroxy-2,3,5-trimethylphenyl)ethane, 2,2-bis(4-hydroxy-2,3,5-trimethylphenyl)propane, bis(4-hydroxy-2,3,5-trimethylphenyl)phenylmethane, 1,1-bis(4-hydroxy-2,3,5-trimethylphenyl)phenylethane, 1,1-bis(4-hydroxy-2,3,5-trimethylphenyl)cyclohexane, etc.;

bisphenol compounds where the divalent group linking the aromatic groups has an aryl group as the substituent, such as bis(4-hydroxyphenyl)(phenyl)methane, 1,1-bis(4-hydroxyphenyl)-1-phenylethane, 1,1-bis(4-hydroxyphenyl)-1-phenylpropane, bis(4-hydroxyphenyl)(diphenyl)methane, bis(4-hydroxyphenyl)(dibenzyl)methane, etc.

One or more such diol components may be used here either singly or as combined in any desired manner and in any desired ratio.

Above all, polycarbonate resins formed from a bisphenol or a biphenol shown below are preferred for use here.

[Formula 19]

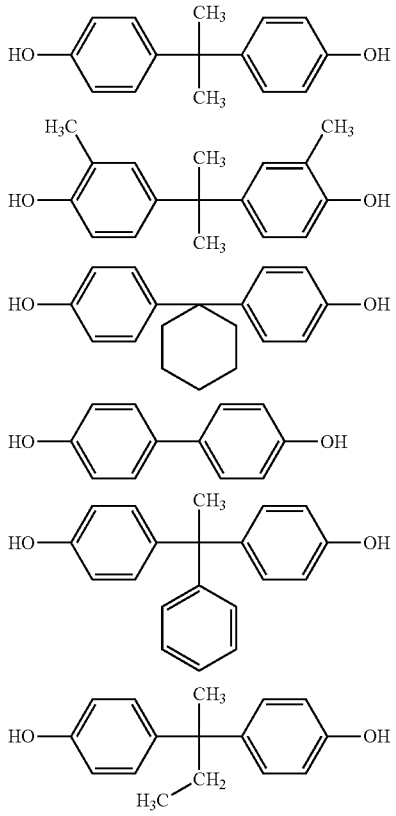

-continued

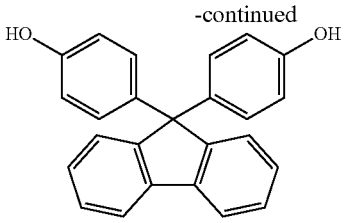

In particular, more preferred are polycarbonate resins formed from a bisphenol having the following structure:

[Formula 20]

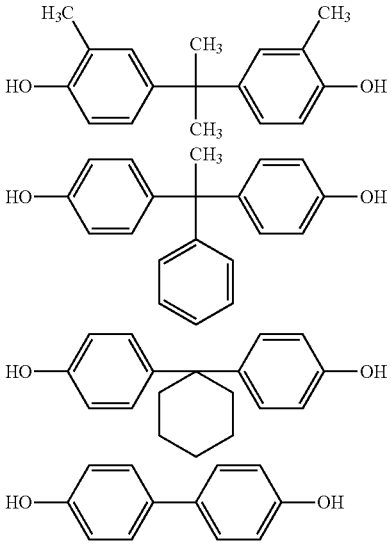

The polycarbonate resin for use herein may have any other polycarbonate structure than that of formula (2) as the partial structure thereof. Further, the resin may also have any other structure than polycarbonate resin as the partial structure thereof.

In the polycarbonate resin for use herein, the ratio by weight of the partial structure of formula (2) is preferably larger from the viewpoint of the electric properties and the abrasion resistance. Concretely, the partial structure of formula (2) preferably accounts for 50% or more by weight of the entire polycarbonate resin, more preferably 70% or more by weight, even more preferably 80% or more by weight, still more preferably 100% by weight.

The viscosity-average molecular weight of the binder resin that may be used here as combined with the polyarylate resin may be any arbitrary one not significantly detracting from the effect of the invention, but is preferably 10000 or more, more preferably 20000 or more, and its uppermost limit is preferably 70000 or less, more preferably 50000 or less. In case where the viscosity-average molecular weight thereof is too small, the mechanical strength of the binder resin may be insufficient; but when too large, the viscosity of the coating liquid for forming the photosensitive layer would be too high and the producibility may lower. The viscosity-average molecular weight may be measured in the same manner as that for the polyarylate resin (1).

Regarding the ratio of the charge-transporting substance to the binder resin for use in the charge transport layer of the multilayer photoreceptor and in the photosensitive layer of the single-layer photoreceptor, the amount of the charge-transporting substance may be generally 20 parts or more by weight relative to 100 parts by weight of the binder resin both in the single-layer photoreceptor and in the multilayer photoreceptor, but is preferably 30 parts or more by weight from the viewpoint of reducing the residual potential, even more preferably 40 parts or more by weight from the viewpoint of the stability in repeated use and the viewpoint of he charge mobility, and may be generally 150 parts or less by weight from the viewpoint of the thermal stability of the photosensitive layer, preferably 120 parts or less by weight from the viewpoint of the miscibility between the charge-transporting substance and the binder resin, more preferably 100 parts or less by weight from the viewpoint of the plate life, even more preferably 80 parts or less by weight from the viewpoint of the scratch resistance.

In the photosensitive layer of the single-layer photoreceptor, a charge-generating substance to be mentioned below is additionally dispersed. In this case, it is important that the particle size of the charge-generating substance is sufficiently small, and is preferably 1 μm or less, more preferably 0.5 μm or less.

The amount of the charge-generating substance to be in the layer is preferably 0.1% or more by weight, more preferably 1% or more by weight, and its uppermost limit is preferably 50% or less by weight, more preferably 20% or less by weight. When the amount of the charge-generating substance is too small, then a sufficient sensitivity could not be attained; but when too large, there may occur some problems of chargeability reduction, sensitivity reduction, etc.

<Charge-Generating Substance>

In the invention, if desired and preferably, the charge-generating substance is used. The charge-generating substance is generally incorporated in the single-layer photosensitive layer in the single-layer photoreceptor, and in the charge generation layer in the multilayer photoreceptor.

Regarding specific examples of the charge-generating substance, various photoconductive materials described in US 2009/0053634 A1, paragraphs [0224] to [0240] can be used here; and especially preferred are organic pigments, and more preferred are phthalocyanine pigments and azo pigments. One or more such charge-generating substances may be used here either singly or as combined in any desired manner and in any desired ratio.

Combined use of a phthalocyanine dye and an azo dye makes it possible to produce a high-density and ghost-free electrophotographic photoreceptor.

Regarding examples of the binder resin generally used in the charge generation layer of the multilayer photoreceptor, the binder resins described in US 2009/0053634 A1, paragraph [0241] can be used here; however, the binder resin for use in the invention is not limited to these polymers. One or more such binder resins may be used here either singly or as combined in any desired manner and in any desired ratio.

Regarding the charge generation layer of the multilayer photoreceptor, the preparation method for the charge generation layer-forming coating liquid and the thickness of the charge generation layer are the same as those described in US 2009/0053634 A1, paragraphs [0242] to [0244].

The method for forming the charge generation layer may be any arbitrary one not significantly detracting from the effect of the invention. In the multilayer photoreceptor, the charge generation layer may be formed by applying a charge generation layer-forming coating liquid of a dispersion of a charge-generating substance onto a support and drying it.

<Other Components>

The photosensitive layer may contain various additives of antioxidant, plasticizer, UV absorbent, electron-attracting compound, leveling agent, visible light-blocking agent, sensitizer and the like, for the purpose of improving the film formability, the flexibility, the coatability, the soiling resistance, the vapor resistance and the lightfastness of the layer. One or more such additives may be used here either singly or as combined in any desired manner and in any desired ratio.

Regarding examples of the antioxidant, those described in US 2009/0053634 A1, paragraphs [0287] to [0295] can be used here.

For improving the acidic vapor resistance of the layer, any known alkylamine compound having a substituent may be used. For example, preferred are the compounds described in JP-A 3-172852, 2007-52408, etc. Of those, for example, more preferred is tribenzylamine.

<Protective Layer, etc.>

A protective layer may be formed as the outermost surface layer of the photoreceptor for the purpose of preventing the photosensitive layer from being worn away and for preventing it from being degraded by discharged substances from charger, etc. The protective layer may be formed, for example, by incorporating a conductive material in a suitable binder resin, or by using a copolymer produced from a compound having charge transporting capability such as a triphenylamine skeleton or the like described in JP-A 9-190004. The conductive material usable here includes aromatic amino compounds such as TPD (N,N'-diphenyl-N, N'-bis(m-tolyl)benzidine), etc.; metal oxides such as antimony oxide, indium oxide, tin oxide, titanium oxide, tin oxide-antimony oxide, aluminium oxide, zinc oxide, etc.; however, the material is not limited to these. One or more such conductive materials may be used here either singly or as combined in any desired manner and in any desired ratio.

The binder resin for use in the protective layer may be any known resin including, for example, polyamide resins, polyurethane resins, polyester resins, epoxy resins, polyketone resins, polycarbonate resins, polyvinyl ketone resins, polystyrene resins, polyacrylamide resins, cyclohexane resins, etc. In addition, also usable are copolymers of a compound having a charge transporting capability such as a triphenylamine skeleton or the like and the above-mentioned resin as described in JP-A-9-190004. One or more such binder resins may be used for the protective layer either singly or as combined in any desired manner and in any desired ratio.

Preferably, the protective layer is so formed as to have an electric resistance of generally from $10^9$ Ω·cm to $10^{14}$ Ω·cm. When the electric resistance is too small, the formed images may be blurred and the resolution may lower; but when too large, the residual potential may increase and the formed images may be much fogged. Preferably, the protective layer is so formed that it does not substantially interfere with the transmission of light to be radiated for imagewise exposure.

In addition, for the purpose of reducing the abrasion resistance and the friction of the photoreceptor surface, and for enhancing the transfer efficiency of toner from the photoreceptor to the transfer belt or paper, the surface layer may contain a fluororesin, a silicone resin, a polyethylene resin, a polystyrene resin, etc.

[1-4. Layer Formation Method]

The layers constituting the photoreceptor may be formed, in general, by successively applying the coating liquid that contains the materials to constitute each layer onto a conductive support according to a known coating method, and individually drying the coating layer. Briefly, the coating step followed by the drying step is repeated to thereby successively form the constitutive layers on the support.

The solvent and the dispersion medium to be used for dissolving the binder resin in preparing the coating liquid include, for example, saturated aliphatic solvents such as pentane, hexane, octane, nonane, etc.; aromatic solvents such as toluene, xylene, anisole, etc.; halogenoaromatic hydrocarbons such as chlorobenzene, dichlorobenzene, chloronaphthalene, etc.; amide solvents such as dimethylformamide, N-methyl-2-pyrrolidone, etc.; alcohol solvents such as methanol, ethanol, isopropanol, n-butanol, benzyl alcohol, etc.; aliphatic polyalcohols such as glycerin, polyethylene glycol, etc.; linear, branched and cyclic ketone solvents such as acetone, cyclohexanone, methyl ethyl ketone, 4-methoxy-4-methyl-2-pentanone, etc.; ester solvents such as methyl formate, ethyl formate, n-butyl formate, etc.; halogenohydrocarbon solvents such as methylene chloride, chloroform, 1,2-dichloroethane, etc.; linear and cyclic ether solvents such as diethyl ether, dimethoxyethane, tetrahydrofuran (hereinafter this may be referred to as "THF"), 1,4-dioxane, methyl cellosolve, ethyl cellosolve, etc.; aprotic polar solvents such as acetonitrile, dimethyl sulfoxide, sulforane, hexamethylphosphortriamide, etc.; nitrogen-containing compounds such as n-butylamine, isopropanolamine, diethylamine, triethanolamine, ethylenediamine, triethylenediamine, triethylamine, etc.; mineral oils such as ligroin, etc.; water, etc. Preferred are those not dissolving the above-mentioned undercoat layer. One or more of these may be used here either singly or as combined in any desired manner and in any desired ratio.

In the coating liquid for layer formation for the charge transport layer of the single-layer photoreceptor and the multilayer photoreceptor, the solid concentration may be generally 5% or more by weight, preferably 10% or more by weight, and its uppermost limit may be generally 40% or less by weight, preferably 35% or less by weight.

The viscosity of the coating liquid may be generally 10 mPa·s or more, preferably 50 mPa·s or more, and its uppermost limit may be generally 500 ma·s or less, preferably 400 mPa·s or less.

The solid concentration in the coating liquid for the charge generation layer of the multilayer photoreceptor may be generally 0.1% or more by weight, preferably 1% or more by weight, and its uppermost limit may be generally 15% or less by weight, preferably 10% or less by weight.

The viscosity of the coating liquid may be generally 0.01 mPa·s or more, preferably 0.1 mPa·s or more, and its uppermost limit may be generally 20 ma·s or less, preferably 10 mPa·s or less.

The coating method with the coating liquid includes, for example, a dip coating method, a spray coating method, a spinner coating method, a bead coating method, a wire bar coating method, a blade coating method, a roller coating method, an air knife coating method, a curtain coating method, etc.; however, any other coating method may also be employable here. One or more such coating methods may be combined in any desired matter for use herein.

Preferably, the coating liquid is dried by heating generally at a temperature falling within a range of from 30° C. to 200° C. and generally for 1 minute to 2 hours with or without air circulation, after tack-free drying at room temperature (generally at 25° C.). The heating temperature may be kept constant, or may be varied during drying.

The thickness of the photosensitive layer of the single-layer photoreceptor may be generally 5 μm or more, preferably 10 μm or more, and its uppermost limit may be generally 100 μm or less, preferably 50 μm or less.

The thickness of the charge transport layer of the regular multilayer photoreceptor may be generally from 5 μm to 50 μm, but is preferably from 10 μm to 45 μm for long life and image stability, more preferably from 10 μm to 30 μm for high resolution.

[1-5. Physical Properties]

<Elastic Deformation Rate and Universal Hardness>

The elastic deformation rate of the surface of the electrophotographic photoreceptor in the invention may be generally 44.0% or more, preferably 45.0% or more, more preferably 46.0% or more, and its uppermost limit may be generally 60.0% or less, preferably 50.0% or less. Having a higher elastic deformation rate, the scratch resistance of the photosensitive layer could be higher, and therefore the layer may be free from the trouble of filming to be caused by silica and the like in the external additive in the toner, as pressed against the layer by cleaning blade. However, when the elastic deformation rate is too high, there may occur noise owing to sliding friction against cleaning blade.

In the invention, the universal hardness may be generally 180 N/mm$^2$ or more, preferably 200 N/mm$^2$ or more, more preferably 210 N/mm$^2$ or more, and its uppermost limit may be generally 300 N/mm$^2$ or less, preferably 270 N/mm$^2$ or less, more preferably 240 N/mm$^2$ or less.

In the invention, the elastic deformation rate and the universal hardness are measured, using a Fischer's microhardness gauge, FISHERSCOPE H100C, in the environment at a temperature of 25° C. and a relative humidity of 50%. In the measurement, a Vickers square pyramid diamond indenter having a face angle of 136° is used. The measurement condition is mentioned below. The load given to the indenter and the indentation depth under the load are continuously read, and plotted on the Y-axis and the X-axis to give a profile as in FIG. 4.

Measurement Condition:

| | |
|---|---|
| Maximum Pressing Load | 5 mN |
| Loading Time | 10 seconds |
| Unloading Time | 10 seconds |

The elastic deformation rate is defined by the following formula, and means the ratio of the work attained by the film owing to its elasticity in unloading, to the total workload needed for pressing.

$$\text{Elastic Deformation Rate (\%)}=(We/Wt)\times 100$$

Figure 4:
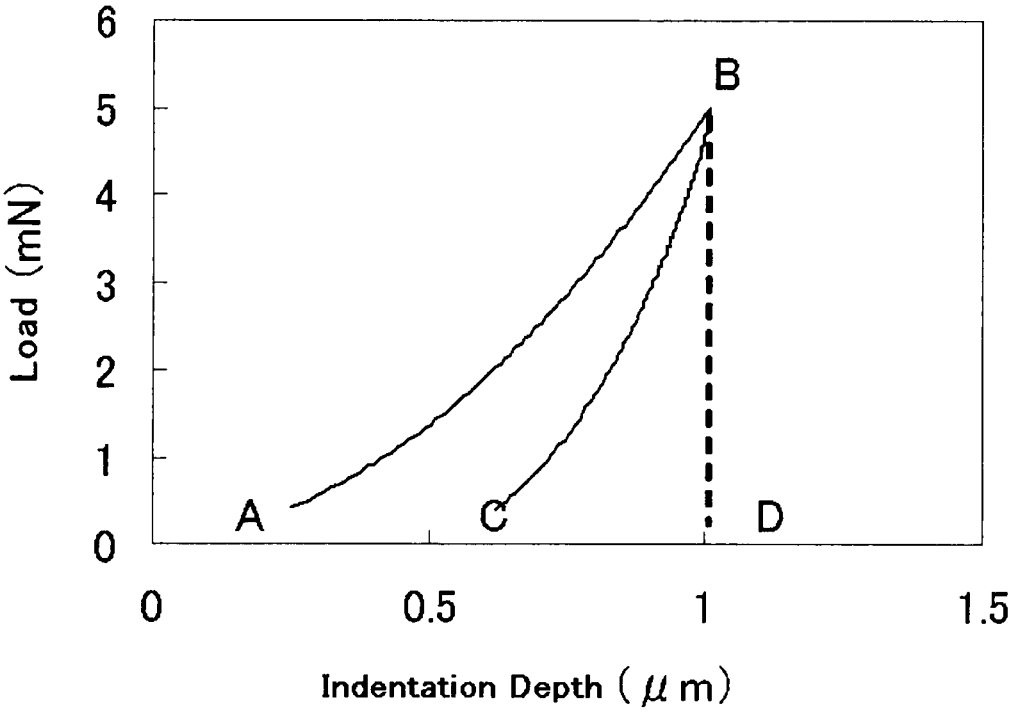
FIG. 4 is a profile of graph for the measurements of elastic deformation rate and universal hardness, where the load and indentation depth are plotted.

In the above formula, the total workload Wt (nJ) indicates the area surrounded by A-B-D-A in FIG. 4, and the elastic deformation workload We (nJ) indicates the area surrounded by C-B-D-C. A higher elastic deformation rate means that the deformation to load remains less; and the elastic deformation rate of 100 means that no deformation remains.

The universal hardness is a value under the pressing load of 5 mN, and is defined from the indentation depth according to the following formula:

$$\text{Universal Hardness (N/mm}^2\text{)}=\text{given load (N)/surface area of Vickers indenter under given load (mm}^2\text{)}$$

Using the polyarylate resin (1) makes it easy for the photosensitive layer have the above elasticity and universal hardness. In particular, use of the polyarylate resin (1) of formula (1) where $Y^1$ is an oxygen atom and k=1 is especially favorable as securing an especially excellent elastic deformation rate.

<Outer Diameter of Electrophotographic Photoreceptor>

Recently, printers and MFP are being much down-sized. Accordingly, it is effective to reduce the outer diameter of the electrophotographic photoreceptor, and the outer diameter thereof is preferably 20 mm or less, more preferably 16 mm or less. On the other hand, the outer diameter is generally 10 mm or more.

<Image Forming Apparatus and Electrophotographic Cartridge>

An embodiment of the image forming apparatus using the electrophotographic photoreceptor of the invention (image forming apparatus of the invention) is descried below with reference to FIG. 1 showing the essential constitution of the apparatus. However, the invention is not limited to the embodiment described below; and not overstepping the sprit and the scope thereof, the invention may be changed and modified in any desired manner.

As shown in FIG. 1, the image forming apparatus 100 comprises an electrophotographic photoreceptor 1, a charging device 2, an exposure device 3, a development device 4, and a transfer device 5, and optionally comprises a cleaning device 6 and a fixation device 7.

The devices are described below.

The electrophotographic photoreceptor 1 is not specifically defined so far as it is the above-mentioned electrophotographic photoreceptor for use in the invention. FIG. 1 shows one example of the photoreceptor, a drum having the above-mentioned photosensitive layer formed on the surface of a cylindrical conductive support. Along the outer peripheral surface of the electrophotographic photoreceptor 1, the charging device 2, the exposure device 3, the development device 4, the transfer device 5 and the cleaning device 6 are arranged.

The charging device 2 is for charging the electrophotographic photoreceptor 1, and uniformly charges the surface of the electrophotographic photoreceptor 1 at a predetermined potential. As the charging device, well used are a corona charging device such as corotron, scorotron, etc.; and a contact charging device such as a direct charging device where the voltage-applied direct charging member is kept in contact with the surface of the photoreceptor for charging, a charging brush, etc. Examples of the direct charging device include contact chargers such as a charging roller, a charging brush, etc. In FIG. 1, a roller-type charging device (charging roller) is shown as one example of the charging device 2. For the direct charging device, any of charging with aerial discharging or injection charging without aerial discharging is possible. The voltage to be applied in charging may be direct current voltage alone or direct current/alternate current superimposed voltage.

Not specifically defined in point of the type thereof, the exposure device 3 may be any one capable of photoexposing the electrophotographic photoreceptor 1 to thereby form an electrostatic latent image on the photosensitive surface of the electrophotographic photoreceptor 1. Specific examples of the device include halogen lamp, fluorescent lamp, laser such as semiconductor laser, He—Ne laser, etc.; LED, etc. The photoreceptor may be photoexposed in a mode of internal exposure.

In photoexposure, any light is employable. For example, the photoexposure may be attained with monochromatic light at a wavelength of 780 nm, monochromatic light near to a short wavelength of from 600 nm to 700 nm, or monochromatic light at a short wavelength of from 380 nm to 500 nm. Of those, preferred is short wavelength light of from 380 to 500 nm as securing high resolution. Above all, more preferred is monochromatic light at 405 nm. At present, the mainstream of the writing resolution is 600 dpi or more; however, some high-performance models may attain 1200 dpi. The electrostatic latent image and toner image resolution is determined by the writing resolution, and a higher resolution gives a sharper image. Therefore, the resolution of 1200 dpi or more is preferred. For example, in writing with LED having a resolution of 600 dpi or 1200 dpi, the minimum dot formation distance could be 42 μm or 21 μm, respectively.

The development device 4 is not specifically defined in point of the type thereof, and may be any arbitrary device of a dry development system or a wet development system of cascade development, one-component insulating toner development, one-component conductive toner development, two-component magnetic brush development of the like. In FIG. 1, the development device 4 comprises a development tank 41, an agitator 42, a feed roller 43, a development roller 44 and a control member 45, in which a toner T is stored inside the development tank 41. If desired, the development device 4 is equipped with a replenisher device (not shown) for replenishing the toner T. The replenisher device is so designed that the toner T may be replenished from a container such as a bottle, a cartridge or the like. In this embodiment, preferably, the above-mentioned toner for use in the invention is used as the toner T.

The feed roller 43 is formed of conductive sponge or the like. The development roller 44 may be a metal roller of iron, stainless steel, aluminium, nickel or the like, or a resin roll produced by coating such a metal roll with a silicone resin, an urethane resin, a fluororesin or the like. If desired, the surface of the development roller 44 may be leveled or roughened.

The development roller 44 is arranged between the electrophotographic photoreceptor 1 and the feed roller 43 and is kept in contact with both the electrophotographic photoreceptor 1 and the feed roller 43. The feed roller 43 and the development roller 44 are rotated each by a revolution drive (not shown). The feed roller 43 carries the stored toner T and feeds it to the development roller 44. The development roller 44 carries the toner fed from the feed roller 43, and brings it into contact with the surface of the electrophotographic photoreceptor 1.

The control member 45 is formed of a resin blade of a silicone resin, an urethane resin or the like, or a metal blade of stainless steel, aluminium, copper, brass, phosphor bronze or the like, or a blade produced by coating such a metal blade with a resin. The control member 45 is kept in contact with the development roller 44 and is pushed toward the development roller 44 by a spring or the like under a predetermined pressure (the blade linear pressure is generally from 5 to 500 g/cm). If desired, the control member 45 may be so designed as to have the function of charging the toner T by frictional charging with the toner T.

The agitator 42 is rotated by a revolution drive, and this agitates the toner T and carries the toner T toward the side of the feed roller 43. Plural agitators 42 may be arranged, differing in the blade shape and the size thereof.

The transfer device 5 is not specifically defined in point of the type thereof, and may be a device using any arbitrary system of an electrostatic transfer method, a pressure transfer method, an adhesive transfer method or the like of corona transfer, roller transfer, belt transfer, etc. In this, the transfer device 5 comprises a transfer charger, a transfer roller, a transfer belt or the like as arranged to face the electrophotographic photoreceptor 1. The transfer device 5 is given a predetermined voltage (transfer voltage) of polarity opposite to that of the charge potential of the toner T, and transfers the toner image formed on the electrophotographic photoreceptor 1 onto the recording paper (transfer paper, medium) P.

Not specifically defined, the cleaning device 6 may be any cleaning device such as a brush cleaner, a magnetic brush cleaner, an electrostatic brush cleaner, a magnetic roller cleaner, a blade cleaner or the like. The cleaning device 6 is so designed that its cleaning member scrapes away the residual toner adhering to the electrophotographic photoreceptor 1 to collect the residual toner. In case where no or little toner remains on the surface of the photoreceptor, the cleaning device 6 may be omitted.

Above all, preferred is the blade cleaning system as having a simple and small-sized structure, inexpensive and excellent in the cleaning capability and the reliability. The blade cleaning system may be grouped into a contact method and a pressure method (Preprint in 57th Technical Training Session of the Imaging Society of Japan, pp. 196-211). The contact method is grouped into a counter-abutting mode and a regular contact mode; and the pressure method is grouped into a low displacement system and a low load system.

In the invention, preferred is the blade cleaning system for effectively removing toner. In particular, when a toner having a high degree of circularity is used, the toner may readily pass through between the blade and the photoreceptor, and therefore the counter-abutting system is preferred. Preferably, the linear pressure of the blade to the photoreceptor is set to fall from 20 to 60 g/cm.

When the blade is set under the above-mentioned condition, then there may occur noise owing to sliding friction between the photoreceptor and the blade; however, using the specific photoreceptor for use in the invention can evade the problem.

In case where the electrophotographic photoreceptor having an outer diameter of 20 mm or less is used, in particular, the linear pressure of the cleaning blade may be often set strong; and in this case, therefore, for evading blade reversal, a lubricant is preferably applied to the site of the cleaning blade to be in contact with the electrophotographic photoreceptor. The lubricant includes toner, polytetrafluoroethylene, polypropylene, silicone resin, etc.

The fixation device 7 comprises an upper fixation member (fixation roller) 71 and a lower fixation member (fixation roller) 72, in which a heating device 73 is arranged inside the fixation member 71 or 72. In the embodiment of FIG. 1, the heating device 73 is arranged inside the upper fixation member 71. For each of the upper and lower fixation members 71 and 72, usable is any known thermal fixation member such as a fixation roll of a metal tube of stainless, aluminium or the like coated with a silicone rubber, a fixation roll further coated with Teflon® resin, a fixation sheet, etc. Further, the fixation members 71 and 72 may be so designed that they can supply a lubricant such as a silicone oil or the like for enhancing the lubricity thereof, or may be so designed that they can forcedly give pressure by spring or the like.

The toner transferred onto the recording paper P is heated to a molten state while passing through the upper fixation member 71 and the lower fixation member 72 heated at a predetermined temperature, and after having passed through them, the toner is cooled and fixed on the recording paper P.

The fixation device is not also specifically defined in point of the type thereof, and any one disclosed herein as well as any other fixation device to be driven by any desired system of thermal roller fixation, flash fixation, oven fixation, pressure fixation or the like is employable.

Using the electrophotographic apparatus 100 having the constitution as above, images may be formed, for example, as follows. Specifically, first the surface (photosensitive surface) of the electrophotographic photoreceptor 1 is charged up to a predetermined potential (for example, at −600 V) by the charging device 2. In this step, the surface may be charged by a direct current voltage or may be charged by a direct current voltage/alternate current superimposed voltage.

Subsequently, the photosensitive surface of the charged electrophotographic photoreceptor 1 is exposed by the exposure device 3 in accordance with the image to be recorded, thereby forming an electrostatic latent image on the photosensitive surface. With that, the electrostatic latent image formed on the photosensitive surface of the electrophotographic photoreceptor 1 is developed by the development device 4.

In the development device 4, the toner T fed by the feed roller 43 is layered thin by the control member (development blade) 45 and is friction-charged in a predetermined polarity (in this, in the same polarity as the charging potential of the photoreceptor 1, negative polarity), and while held by the development roller 44, this is transferred to be in contact with the surface of the electrophotographic photoreceptor 1.

When the charged toner T carried by the development roller 44 is brought into contact with the surface of the electrophotographic photoreceptor 1, then a toner image corresponding to the electrostatic latent image is formed on the photosensitive surface of the electrophotographic photoreceptor 1. With that, the toner image is transferred onto the recording paper P by the transfer device 5. After this, the toner remaining on the photosensitive surface of the electrophotographic photoreceptor 1, without being transferred, is removed by the cleaning device 6.

After transfer of the toner image onto the recording paper P, the paper is led to pass through the fixation device 7 in which the toner image is thermally fixed on the recording paper P to give a final image.

The image forming apparatus 100 may be so designed that, in addition to the above-mentioned constitution, it may attain a neutralization step therein. The neutralization step is a step of neutralizing the electrophotographic photoreceptor by exposing it to light, in which a fluorescent lamp, LED or the like may be used as the neutralization device. In many cases, the light for neutralization has, as the intensity thereof, an exposure energy of about 3 times or more that of the light for photoexposure.

The constitution of the image forming apparatus may be modified, and for example, the apparatus may be designed to attain additional steps of a pre-exposure step, an auxiliary charging step, etc., or may be designed to attain offset printing, or as the case may be, the apparatus may be designed to have a full-color tandem system of using plural types of toners.

The electrophotographic photoreceptor 1 may be combined with one or more of the charging device 2, the exposure device 3, the development device 4, the transfer device 5, the cleaning device 6 and the fixation device 7 to construct an integrated cartridge (hereinafter this may be referred to as "electrophotographic cartridge"); and the electrophotographic cartridge may be so designed as to be detachable to the electrophotographic device body such as a copying machine, a laser beam printer, etc. In this case, for example, when the electrophotographic photoreceptor 1 or other members are degraded, then the electrophotographic cartridge may be removed from the image forming apparatus body, and a different new electrophotographic cartridge may be installed in the image forming apparatus body, thereby facilitating the maintenance of the image forming apparatus.

EXAMPLES

Now, the invention will be described in further detail with reference to Examples. However, it should be understood that the invention is by no means restricted to the following Examples. In the following Examples, "part" means "part by weight".

The particle size, the average degree of circularity, the electroconductivity and the thermal properties were measured as follows.

<Measuring Method and Definition of Volume-Average Diameter (Mv)>

The volume-average diameter (Mv) of particles having a volume-average diameter (Mv) of less than 1 μm was measured by means of Model: Microtrac Nanotrac 150 (hereinafter abbreviated as "Nanotrac"), manufactured by Nikkiso, in accordance with the Instruction Manual of Nanotrac, using Microtrac Particle Analyzer Ver. 10.1.2.-019EE, analysis software by Nikkiso, using, as a dispersion medium, ion-exchanged water having an electroconductivity of 0.5 μS/cm, under the following conditions or by inputting the following conditions according to the method described in the Instruction Manual.

The measurement condition for the wax dispersion and the polymer primary particle dispersion is as follows.

Refractive index of solvent: 1.333
Time for measurement: 100 seconds
Number of measurement times: Once
Refractive index of particles: 1.59
Transmissiveness: transmissive
Shape: true spherical
Density: 1.04

The measurement condition for the pigment premix liquid and the colorant dispersion is as follows.

Refractive index of solvent: 1.333
Time for measurement: 100 seconds
Number of measurement times: Once
Refractive index of particles: 1.59
Transmissiveness: absorptive
Shape: non-spherical
Density: 1.00

<Measurement Method and Definition of Volume Median Diameter (Dv50)>

A toner finally obtained after the external addition step was pre-treated before measurement, as follows. 0.100 g of the toner was put into a cylindrical polyethylene (PE) beaker having an inner diameter of 47 mm and a height of 51 mm, using a spatula, and 0.15 g of an aqueous 20 mas. % DBS solution (NEOGEN S-20A, by Daiichi Kogyo Seiyaku) was thereinto using a dropper. At that time, in order to avoid scattering of the toner to e.g. the brim of the beaker, the toner and the aqueous 20% DBS solution were put only at the bottom of the beaker. Then, using a spatula, the toner and the aqueous 20% DBS solution were stirred for 3 minutes until they became pasty. Also at that time, due care was taken so as not to scatter the toner to e.g., the brim of the beaker.

Subsequently, 30 g of a dispersion medium Isoton II was added and stirred for 2 minutes using a spatula to give an entirely uniform solution as visually observed. Then, a fluororesin-coated rotor having a length of 31 mm and a diameter of 6 mm was put into the beaker, followed by stirring at 400 rpm for 20 minutes using a stirrer. At that time, at a rate of once for every three minutes, using a spatula, macroscopic particles as visually observed at the air-liquid interface and at the brim of the beaker were permitted to fall inside the beaker and stirred to form a uniform dispersion. Subsequently, the dispersion was filtered through a filter having a sieve mesh size of 63 μm and the resulting filtrate was taken as "the toner dispersion".

Further, in the measurement of the particle diameter in the step of producing the toner matrix particles, the filtrate obtained by filtering the slurry during the aggregation through a mesh of 63 μm was taken as "the slurry liquid".

The volume median diameter (Dv50) of the particles was measured with Multisizer III (by Beckman Coulter, aperture diameter 100 μm) (hereinafter abbreviated as "Multisizer"), using Isoton II as a dispersion medium. The above "toner dispersion" or "slurry liquid" was diluted so that the dispersoid concentration therein could be 0.03% by mass. Using the Multisizer III analysis software, the KD value was set to be 118.5. The particle diameter range of the particles to be measured is from 2.00 to 64.00 μm, and this range was discretized in 256 divisions at equal intervals by logarithmic scale, and one calculated based on the volume-based statistical values was taken as the volume median diameter (Dv50).

<Measurement Method and Definition of Percentage by Number (Dns) of Toner Particles Having a Particle Diameter of from 2.00 μm to 3.56 μm>

A toner finally obtained after the external addition step was pre-treated before measurement, as follows. 0.100 g of the toner was put into a cylindrical polyethylene (PE) beaker having an inner diameter of 47 mm and a height of 51 mm, using a spatula, and 0.15 g of an aqueous 20 mas. % DBS solution (NEOGEN S-20A, by Daiichi Kogyo Seiyaku) was thereinto using a dropper. At that time, in order to avoid scattering of the toner to e.g. the brim of the beaker, the toner and the aqueous 20% DBS solution were put only at the bottom of the beaker. Then, using a spatula, the toner and the aqueous 20% DBS solution were stirred for 3 minutes until they became pasty. Also at that time, due care was taken so as not to scatter the toner to e.g., the brim of the beaker.

Subsequently, 30 g of a dispersion medium Isoton II was added and stirred for 2 minutes using a spatula to give an entirely uniform solution as visually observed. Then, a fluororesin-coated rotor having a length of 31 mm and a diameter of 6 mm was put into the beaker, followed by stirring at 400 rpm for 20 minutes using a stirrer. At that time, at a rate of once for every three minutes, using a spatula, macroscopic particles as visually observed at the air-liquid interface and at the brim of the beaker were permitted to fall inside the beaker and stirred to form a uniform dispersion. Subsequently, the dispersion was filtered through a filter having a sieve mesh size of 63 μm and the resulting filtrate was taken as "the toner dispersion".

The percentage by number (Dns) of the toner particles having a particle diameter of from 2.00 μm to 3.56 μm was measured, using Multisizer III (aperture diameter 100 μm) and using Isoton II as a dispersion medium. The above "toner dispersion" or "slurry liquid" was diluted so that the dispersoid concentration therein could be 0.03% by mass. Using the Multisizer III analysis software, the KD value was set to be 118.5.

The lowermost particle diameter 2.00 μm is the detection limit of the measuring device used here, Multisizer, and the uppermost particle diameter 3.56 μm is the prescribed value of the channels in the measuring device Multisizer. In the invention, the particle diameter falling within the region of from 2.00 μm to 3.56 μm was taken as the fine powder region.

The particle diameter range of the particles to be measured is from 2.00 to 64.00 μm, and this range was discretized in 256 divisions at equal intervals by logarithmic scale, and on the basis of the number-based statistical values, the proportion of the particle diameter component of from 2.00 to 3.56 μm was calculated on the number base to give "Dns".

<Measurement Method and Definition of Average Degree of Circularity>

In the invention, "average degree of circularity" is measured as follows and defined as follows. Briefly, toner matrix particles were dispersed in a dispersion medium (Isoton II, by Beckman Coulter) so that they could be within a range of from 5,720 to 7,140 particles/μL, and using a flow particle sizer (SYSMEX's FPIA2100), the dispersion was analyzed under the apparatus condition mentioned below. The found value is defined as the "average degree of circularity". In the invention, the same measurement is carried out three times, and the arithmetic average value of the three data of "average degree of circularity" is adopted as the "average degree of circularity".

Mode: HPF

Amount for HPF analysis: 0.354 μL

Number of HPF detection: 2,000 to 2,500 particles

The following is measured with the above apparatus, and automatically calculated by the above apparatus and shown, and the "degree of circularity" is defined by the following formula:

Degree of Circularity=[circumferential length of circle having the same area as the protected area of particle/circumferential length of the projected image of particle]

From 2,000 to 2,500 particles as the number of HPF detection are measured, and the arithmetic average (arithmetical mean) of the found data of the degree of circularity of those individual particles is shown by the apparatus as the "average circularity".

<Measurement Method and Definition of Number Variation Coefficient>

"Number variation coefficient" in the invention is defined as follows.

Number Variation Coefficient=100×[standard deviation of number-based particle distribution]/[number-average particle diameter]

In the invention, the standard deviation of number-based particle distribution and the number-average particle diameter were measured using Multisizer III, according to the method of measuring the volume median diameter (Dv50). The particle diameter range of the particles to be measured is from 2.00 to 64.00 μm. This range was discretized in 256 divisions at equal intervals by logarithmic scale, and on the basis of the number-based statistical values, the standard deviation of number-based particle distribution and the number-average particle diameter were measured, and the number variation coefficient was calculated from the above formula.

<Measurement Method of Electroconductivity>

The electroconductivity was measured using a conductivity gauge (Yokogawa Electric's personal SC meter Model SC72 and detector SC72SN-11) in accordance with an ordinary method as in the Instruction Manual.

<Measurement Method of Melting Peak Temperature, Melting Peak Half Value Width, Crystallization Temperature and Crystallization Peak Half Value Width>

Using Seiko Instruments' Model: SSC5200 and according to the method shown in the Instruction Manual by Seiko Instruments, a sample was heated from 10° C. up to 110° C. at a rate of 10° C./min, and on the endothermic curve during that period, the melting peak temperature and the melting peak half value width were read, and subsequently, the sample was cooled from 110° C. down to 10° C. at a rate of 10° C./min, and on the exothermic curve during that period, the crystallization temperature and the crystallization peak half value width were read.

<Measurement Method of Solid Concentration>

Using Kett Electric Laboratory's solid concentration gauge, INFRARED MOISTURE DETERMINATION BALANCE Model FD-100, 1.00 g of a solid-containing sample was accurately weighed on a balance, and its solid concentration was measured at a heater temperature of 300° C. for a heating time of 90 minutes.

<Measurement Method of Electrostatic Charge Distribution (Standard Deviation of Electrostatic Charge)>0.8 g of a toner and 19.2 g of a carrier (Powdertech's ferrite carrier, F150) were put into a sample bottle of glass and stirred at 250 rpm for 30 minutes using a Recipro Shaker NR-1 (by TAITEC). The stirred toner/carrier mixture was analyzed for the electrostatic charge distribution thereof using E-Spart electrostatic charge distribution analyzer (by Hosokawa Micron). The found data of the individual particles were divided by the particle diameter thereof (the range of from −16.197 C/μm to +16.197 C/μm was discretized in 128 divisions at every 0.2551 C/μm), and the standard deviation of the calculated data of 3000 particles was taken as the standard deviation of electrostatic charge of the toner.

<Toner Production Example 1>

<Preparation of Wax/Long Chain Polymerizing Monomer Dispersion A1>

27 parts (540 g) of paraffin wax (HNP-9, by Nippon Seiro; surface tension, 23.5 mN/m; thermal characteristics: melting point peak temperature 82° C., heat of fusion 220 J/g, melting peak half value width 8.2° C., crystallization temperature 66° C., crystallization peak half value width 13.0° C.), 2.8 parts of stearyl acrylate (by Tokyo Kasei), 1.9 parts of an aqueous 20 mas. % sodium dodecylbenzenesulfonate solution (NEOGEN S20A, by Daiichi Kogyo Seiyaku) (hereinafter this may be abbreviated as "aqueous 20% DBS solution") and 68.3 parts of desalted water were heated up to 90° C., and stirred for 10 minutes using a homomixer (Mark II f Model, by Tokushu Kikai Kogyo).

Subsequently, the dispersion was heated up to 90° C., and using a homogenizer (Gaulin's 15-M-8PA Model), circulation emulsification thereof was initiated under a pressure condition of 25 MPa. Using Nanotrac, the particle size was measured, and dispersion was carried out until the volume-average diameter (Mv) became 250 nm to prepare a wax/long chain polymerizing monomer dispersion A1 (emulsion solid concentration=30.2% by mass).

<Preparation of Polymer Primary Particle Dispersion A1>

Into a reactor (inner capacity, 21 L; inner diameter, 250 mm; height, 420 mm) equipped with an agitation device (three vanes), a heating/cooling device, a condensation device and material/additive feeding devices, 35.6 parts (712.12 g) of the above wax/long chain polymerizing monomer dispersion A1 and 259 parts of desalted water were charged and heated up to 90° C. in a nitrogen current with stirring.

Subsequently, while stirring the above liquid was continued, a mixture of the following "polymerizing monomers" and "aqueous emulsifier solution" was added thereto taking 5 hours. The time when dropwise addition of this mixture was started is taken as "start of polymerization", and in 30 minutes after the start of polymerization, the following "aqueous initiator solution" was added to the system taking 4.5 hours. Further in 5 hours after the start of polymerization, the following "additional aqueous initiator solution" was added thereto, taking 2 hours. With still kept stirring, this was held at an internal temperature of 90° C. for 1 hour.

| [Polymerizing Monomers] | |
|---|---|
| Styrene | 76.8 parts (1535.0 g) |
| Butyl acrylate | 23.2 parts |
| Acrylic acid | 1.5 parts |
| Hexanediol diacrylate | 0.7 parts |
| Trichlorobromomethane | 1.0 part |
| [Aqueous Emulsifier Solution] | |
| Aqueous 20% DBS solution | 1.0 part |
| Desalted water | 67.1 parts |
| [Aqueous Initiator Solution] | |
| Aqueous 8 mas. % hydrogen peroxide solution | 15.5 parts |
| Aqueous 8 mas. % L(+)-ascorbic acid solution | 15.5 parts |
| [Additional Aqueous Initiator Solution] | |
| Aqueous 8 mas. % L(+)-ascorbic acid solution | 14.2 parts |

After the polymerization reaction, the system was cooled to give a milky white polymer primary particle dispersion A1. The volume-average diameter (Mv) thereof, as measured with Nanotrac, was 280 nm; and the solid concentration thereof was 21.1% by mass.

<Preparation of Polymer Primary Particle Dispersion A2>

Into a reactor (inner capacity, 21 L; inner diameter, 250 mm; height, 420 mm) equipped with an agitation device (three vanes), a heating/cooling device, a condensation device and material/additive feeding devices, 1.0 parts of aqueous 20 mas. % DBS solution and 312 parts of desalted water were charged and heated up to 90° C. in a nitrogen current with stirring. Then with still stirring, 3.2 parts of aqueous 8 mas. % hydrogen peroxide solution and 3.2 parts of aqueous 8 mas. % L(+)-ascorbic acid solution were added thereto all at a time. At the time in 5 minutes after the addition of all at a time is taken as "polymerization start".

A mixture of the following "polymerizing monomers" and "aqueous emulsifier solution" was added to the system, taking 5 hours after the polymerization start. The following "aqueous initiator solution" was added thereto taking 6 hours after the polymerization start, and subsequently, this was kept at an internal temperature of 90° C. for 1 hour with stirring.

| [Polymerizing Monomers] | |
|---|---|
| Styrene | 92.5 parts (1850.0 g) |
| Butyl acrylate | 7.5 parts |
| Acrylic acid | 0.5 parts |
| Trichlorobromomethane | 0.5 parts |
| [Aqueous Emulsifier Solution] | |
| Aqueous 20% DBS solution | 1.5 parts |
| Desalted water | 66.0 parts |
| [Aqueous Initiator Solution] | |
| Aqueous 8 mas. % hydrogen peroxide solution | 18.9 parts |
| Aqueous 8 mas. % L(+)-ascorbic acid solution | 18.9 parts |

After the polymerization reaction, the system was cooled to give a milky white polymer primary particle dispersion A2. The volume-average diameter (Mv) thereof, as measured with Nanotrac, was 290 nm; and the solid concentration thereof was 19.0% by mass.

<Preparation of Colorant Dispersion A>

In a container having an inner volume of 300 L and equipped with a stirrer (propeller vane), 20 parts (40 kg) of carbon black produced according to a furnace process, of which the UV absorbance of the toluene extract was 0.02 and which had a true density of 1.8 g/cm$^3$ (Mitsubishi Chemical's Mitsubishi Carbon Black MA100S), 1 part of aqueous 20% DBS solution, 4 parts of nonionic surfactant (Kao's EMULGEN 120) and 75 parts of ion-exchanged water having an electroconductivity of 2 μS/cm were pre-dispersed to prepare a pigment premix liquid. The volume-average diameter (Mv), as measured with Nanotrac, of the carbon black in the pigment premix dispersion was 90 nm.

As a starting material slurry, the above pigment premix liquid was charged in a wet bead mill, and subjected to one-pass dispersion therein. Here, the inner diameter of the stator was ϕ75 mm, the diameter of the separator was ϕ60 mm, and the distance between the separator and the disc was 15 mm. As dispersion media, used were zirconia beads having a diameter of 100 μm (true density, 6.0 g/cm$^3$). The effective inner volume of the stator was 0.5 L, and the packing volume of media was 0.35 L, and therefore the packing ratio of media was 70% by mass. The rotation speed of the rotor was kept constant (the circumferential speed of the forward end of the rotor was 11 m/sec), and the above pigment premix liquid was continuously fed into the mill from the feed port at a feeding speed of 50 L/hr by a non-pulsation metering pump, and was continuously discharged out through the discharge port to give a black colorant dispersion A.

The volume-average diameter (Mv) of the colorant dispersion A, as measured with Nanotrac, was 150 nm, and the solid concentration thereof was 24.2% by mass.

<Production of Toner Matrix Particles A>

Using the following ingredients, toner matrix particles A were produced according to the process of the following aggregation step (core aggregation step/shell coating step), rounding step (ripening step), washing step and drying step.

- Polymer primary particle dispersion A1: 95 parts as solid content (998.2 g as solid content)
- Polymer primary particle dispersion A2: 5 parts as solid content
- Colorant dispersion A: 6 parts as colorant solid content
- Aqueous 20% DBS solution: 0.2 parts as solid content in the core aggregation step
- Aqueous 20% DBS solution: 6 parts as solid content in the rounding step Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 7° C. Then, with continuous stirring at the internal temperature of 7° C. and at 250 rpm, an aqueous solution of 5 mas. % ferrous sulfate was added in an amount of 0.52 parts as $FeSO_4.7H_2O$, taking 5 minutes, and then the colorant dispersion A was added thereto taking 5 minutes, and these were mixed uniformly at an internal temperature of 7° C. Further, under the same condition, an aqueous 0.5 mas. % aluminium sulfate solution was drop-wise added taking 8 minutes (the solid content being 0.10 parts relative to the resin solid content). Then, while maintaining the rotation speed at 250 rpm, the internal temperature was elevated up to 54.0° C. Using Multisizer, the volume median diameter (Dv50) of the particles was measured, and the particles were grown up to 5.32 μm.

Shell Coating Step:

Then, at the internal temperature of 54.0° C. and at the rotation speed of 250 rpm, the polymer primary particle dispersion A2 was added to the system, taking 3 minutes, and then kept as such for 60 minutes.

Rounding Step (Ripening Step):

Subsequently, the rotation speed was lowered to 150 rpm (circumferential speed of the forward ends of stirring vanes, 1.56 m/sec; stirring speed reduction of 40% relative to the rotation speed in the aggregation step), and then the aqueous 20% DBS solution (6 parts as solid content) was added thereto taking 10 minutes, and thereafter the system was heated up to 81° C. taking 30 minutes, and the heating with stirring was continued under the condition until the average degree of circularity of the particles could reach 0.943. Then, this was cooled down to 30° C. taking 20 minutes, thereby to give a slurry.

Washing Step:

The resulting slurry was discharged out, and filtered under suction through a filter paper of grade 5C (No 5C, by Toyo Roshi) using an aspirator. The cake remaining on the filter paper was transferred into a stainless container having an inner volume of 10 L and equipped with a stirrer (propeller vane), and 8 kg of ion-exchanged water having an electroconductivity of 1 μS/cm was added thereto and stirred at 50 rpm to uniformly dispersing them, and then this was kept stirred for 30 minutes.

Next, this was again filtered under suction through a filter paper of grade 5C (No 5C, by Toyo Roshi) using an aspirator. The solid remaining on the filter paper was again transferred into a container having an inner volume of 10 L, equipped with a stirrer (propeller vane) and containing therein 8 kg of ion-exchanged water having an electroconductivity of 1 μS/cm, and uniformly dispersed with stirring at 50 rpm, and thereafter this was kept stirred for 30 minutes. This step was repeated five times, and the electroconductivity of the filtrate became 2 μS/cm.

Drying Step:

The solid obtained here was spread on a stainless steel vat so that the height thereof could be 20 mm, and dried for 48 hours in an air-circulating drier set at 40° C. to give toner matrix particles A.

<Production of Toner A>

External Addition Step:

250 g of the thus-obtained toner matrix particles were mixed with external additives, 1.55 g of silica H2000 (by Clariant) and 0.62 g of fine titania powder SMT150IB (by Tayca), then milled in a sample mill (by Kyoritsu Riko) at 6000 rpm for 1 minute, and sieved through a 150-mesh sieve to give a toner A.

Analytical Step:

The "volume median diameter (Dv50)" of the obtained toner A, as measured with Multisizer, was 5.54 μm; the "percentage by number (Dns) of toner particles having a particle diameter of from 2.00 μm to 3.56 μm" was 3.83%; the average degree of circularity was 0.943; and the number variation coefficient was 18.6%.

<Toner Production Example 2>

<Production of Toner Matrix Particles B>

Toner matrix particles B were produced in the same manner as in "Production of Toner Matrix Particles A" in Toner Production Example 1, except that, in the process of the aggregation step (core aggregation step, shell coating step), the rounding step, the washing step and the drying step in "Production of Toner Matrix Particles A", the "core aggregation step", the "shell coating step" and the "rounding step" were changed to the following.

Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 7° C. Then, with continuous stirring at the internal temperature of 7° C. and at 250 rpm, an aqueous solution of 5 mas. % ferrous sulfate was added in an amount of 0.52 parts as $FeSO_4.7H_2O$, taking 5 minutes, and then the colorant dispersion A was added thereto taking 5 minutes, and these were mixed uniformly at an internal temperature of 7° C. Further, under the same condition, an aqueous 0.5 mas. % aluminium sulfate solution was dropwise added taking 8 minutes (the solid content being 0.10 parts relative to the resin solid content). Then, while maintaining the rotation speed at 250 rpm, the internal temperature was elevated up to 55.0° C. Using Multisizer, the volume median diameter (Dv50) of the particles was measured, and the particles were grown up to 5.86 μm.

Shell Coating Step:

Then, at the internal temperature of 55.0° C. and at the rotation speed of 250 rpm, the polymer primary particle dispersion A2 was added to the system, taking 3 minutes, and then kept as such for 60 minutes.

Rounding Step:

Subsequently, the rotation speed was lowered to 150 rpm (circumferential speed of the forward ends of stirring vanes, 1.56 m/sec; stirring speed reduction of 40% relative to the rotation speed in the aggregation step), and then the aqueous 20% DBS solution (6 parts as solid content) was added thereto taking 10 minutes, and thereafter the system was heated up to 84° C. taking 30 minutes, and the heating with stirring was continued until the average degree of circularity of the particles could reach 0.942. Then, this was cooled down to 30° C. taking 20 minutes, thereby to give a slurry.

<Production of Toner B>

Subsequently, a toner B was produced according to the same external addition step as in "Production of Toner A", except that, as the external additives, the amount of silica H2000 was changed to 1.41 g and the amount of titania fine powder SMT150IB was changed to 0.56 g.

Analytical Step:

The volume median diameter (Dv50) of the obtained toner B, as measured with Multisizer, was 5.97 μm; the "percentage by number (Dns) of toner particles having a particle diameter of from 2.00 μm to 3.56 μm" was 2.53%; the average degree of circularity was 0.943; and the number variation coefficient was 18.4%.

<Toner Production Example 3>

<Production of Toner Matrix Particles C>

Toner matrix particles C were produced in the same manner as in "Production of Toner Matrix Particles A" in Toner Production Example 1, except that, in the process of the aggregation step (core aggregation step, shell coating step), the rounding step, the washing step and the drying step in "Production of Toner Matrix Particles A", the "core aggregation step", the "shell coating step" and the "rounding step" were changed to the following.

Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 7° C. Then, with continuous stirring at the internal temperature of 7° C. and at 250 rpm, an aqueous solution of 5 mas. % ferrous sulfate was added in an amount of 0.52 parts as $FeSO_4.7H_2O$, taking 5 minutes, and then the colorant dispersion A was added thereto taking 5 minutes, and these were mixed uniformly at an internal temperature of 7° C. Further, under the same condition, an aqueous 0.5 mas. % aluminium sulfate solution was dropwise added taking 8 minutes (the solid content being 0.10 parts relative to the resin solid content). Then, while maintaining the rotation speed at 250 rpm, the internal temperature was elevated up to 57.0° C. Using Multisizer, the volume median diameter (Dv50) of the particles was measured, and the particles were grown up to 6.72 μm.

Shell Coating Step:

Then, at the internal temperature of 57.0° C. and at the rotation speed of 250 rpm, the polymer primary particle dispersion A2 was added to the system, taking 3 minutes, and then kept as such for 60 minutes.

Rounding Step:

Subsequently, the rotation speed was lowered to 150 rpm (circumferential speed of the forward ends of stirring vanes, 1.56 m/sec; stirring speed reduction of 40% relative to the rotation speed in the aggregation step), and then the aqueous 20% DBS solution (6 parts as solid content) was added thereto taking 10 minutes, and thereafter the system was heated up to 87° C. taking 30 minutes, and the heating with stirring was continued until the average degree of circularity of the particles could reach 0.941. Then, this was cooled down to 30° C. taking 20 minutes, thereby to give a slurry.

<Production of Toner C>

Subsequently, a toner C was produced according to the same external addition step as in "Production of Toner A", except that, as the external additives, the amount of silica H2000 was changed to 1.25 g and the amount of titania fine powder SMT150IB was changed to 0.50 g.

Analytical Step:

The volume median diameter (Dv50) of the obtained toner C, as measured with Multisizer, was 6.75 μm; the "percentage by number (Dns) of toner particles having a particle diameter of from 2.00 μm to 3.56 μm" was 1.83%; the average degree of circularity was 0.942; and the number variation coefficient was 18.7%.

<Toner Production Example 4>

<Production of Toner Matrix Particles D>

Toner matrix particles D were produced in the same manner as in "Production of Toner Matrix Particles A" in Toner Production Example 1, except that, in the process of the aggregation step (core aggregation step, shell coating step), the rounding step, the washing step and the drying step in "Production of Toner Matrix Particles A", the "core aggregation step", the "shell coating step" and the "rounding step" were changed to the following.

Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 21° C. Then, with continuous stirring at an internal temperature of 21° C. and at 250 rpm, an aqueous solution of 5 mas. % ferrous sulfate was added in an amount of 0.52 parts as $FeSO_4.7H_2O$, taking 5 minutes, and then the colorant dispersion A was added thereto taking 5 minutes, and these were mixed uniformly at an internal temperature of 7° C. Further, under the same condition, an aqueous 0.5 mas. % aluminium sulfate solution was dropwise added taking 8 minutes (the solid content being 0.10 parts relative to the resin solid content). Then, while maintaining the rotation speed at 250 rpm, the internal temperature was elevated up to 54.0° C. Using Multisizer, the volume median diameter (Dv50) of the particles was measured, and the particles were grown up to 5.34 μm.

Shell Coating Step:

Then, at the internal temperature of 54.0° C. and at the rotation speed of 250 rpm, the polymer primary particle dispersion A2 was added to the system, taking 3 minutes, and then kept as such for 60 minutes.

Rounding Step:

Subsequently, the rotation speed was lowered to 220 rpm (circumferential speed of the forward ends of stirring vanes, 2.28 m/sec; stirring speed reduction of 12% relative to the rotation speed in the aggregation step), and then the aqueous 20% DBS solution (6 parts as solid content) was added thereto taking 10 minutes, and thereafter the system was heated up to 81° C. taking 30 minutes, and the heating with stirring was continued until the average degree of circularity of the particles could reach 0.942. Then, this was cooled down to 30° C. taking 20 minutes, thereby to give a slurry.

<Production of Toner D>

Subsequently, a toner D was produced according to the same external addition step as in "Production of Toner A" in the toner Production Example 1.

Analytical Step:

The volume median diameter (Dv50) of the obtained toner D, as measured with Multisizer, was 5.48 μm; the "percentage by number (Dns) of toner particles having a particle diameter of from 2.00 μm to 3.56 μm" was 4.51%; the average degree of circularity was 0.943; and the number variation coefficient was 20.4%.

<Toner Production Example 5>

<Production of Toner Matrix Particles E>

Toner matrix particles E were produced in the same manner as in "Production of Toner Matrix Particles A" in Toner Production Example 1, except that, in the process of the aggregation step (core aggregation step, shell coating step), the rounding step, the washing step and the drying step in "Production of Toner Matrix Particles A", the "core aggregation step", the "shell coating step" and the "rounding step" were changed to the following.

Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 7° C. Then, with continuous stirring at an internal temperature of 21° C. and at 250 rpm, an aqueous solution of 5 mas. % ferrous sulfate was added in an amount of 0.52 parts as $FeSO_4.7H_2O$, taking 5 minutes, and then the colorant dispersion A was added thereto taking 5 minutes, and these were mixed uniformly at an internal temperature of 7° C. Further, under the same condition, an aqueous 0.5 mas. % aluminium sulfate solution was dropwise added taking 8 minutes (the solid content being 0.10 parts relative to the resin solid content). Then, while maintaining the rotation speed at 250 rpm, the internal temperature was elevated up to 55.0° C. Using Multisizer, the volume median diameter (Dv50) of the particles was measured, and the particles were grown up to 5.86 μm.

Shell Coating Step:

Then, at the internal temperature of 55.0° C. and at the rotation speed of 250 rpm, the polymer primary particle dispersion A2 was added to the system, taking 3 minutes, and then kept as such for 60 minutes.

Rounding Step:

Subsequently, the rotation speed was lowered to 220 rpm (circumferential speed of the forward ends of stirring vanes, 2.28 m/sec; stirring speed reduction of 12% relative to the rotation speed in the aggregation step), and then the aqueous 20% DBS solution (6 parts as solid content) was added thereto taking 10 minutes, and thereafter the system was heated up to 84° C. taking 30 minutes, and the heating with stirring was continued until the average degree of circularity of the particles could reach 0.941. Then, this was cooled down to 30° C. taking 20 minutes, thereby to give a slurry.

<Production of Toner E>

Subsequently, a toner E was produced according to the same external addition step as in "Production of Toner A", except that, as the external additives, the amount of silica H2000 was changed to 1.41 g and the amount of titania fine powder SMT150IB was changed to 0.56 g.

Analytical Step:

The volume median diameter (Dv50) of the obtained toner E for development, as measured with Multisizer, was 5.93 μm; the "percentage by number (Dns) of toner particles having a particle diameter of from 2.00 μm to 3.56 μm" was 3.62%; the average degree of circularity was 0.942; and the number variation coefficient was 20.1%.

<Toner Production Example 6>

<Production of Toner Matrix Particles F>

Toner matrix particles F were produced in the same manner as in "Production of Toner Matrix Particles A" in Toner Production Example 1, except that, in the process of the aggregation step (core aggregation step, shell coating step), the rounding step, the washing step and the drying step in "Production of Toner Matrix Particles A", the "core aggregation step", the "shell coating step" and the "rounding step" were changed to the following.

Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 7° C. Then, with continuous stirring at an internal temperature of 21° C. and at 250 rpm, an aqueous solution of 5 mas. % ferrous sulfate was added in an amount of 0.52 parts as $FeSO_4.7H_2O$, taking 5 minutes, and then the colorant dispersion A was added thereto taking 5 minutes, and these were mixed uniformly at an internal temperature of 7° C. Further, under the same condition, an aqueous 0.5 mas. % aluminium sulfate solution was dropwise added taking 8 minutes (the solid content being 0.10 parts relative to the resin solid content). Then, while maintaining the rotation speed at 250 rpm, the internal temperature was elevated up to 57.0° C. Using Multisizer, the volume median diameter (Dv50) of the particles was measured, and the particles were grown up to 6.76 μm.

Shell Coating Step:

Then, at the internal temperature of 57.0° C. and at the rotation speed of 250 rpm, the polymer primary particle dispersion A2 was added to the system, taking 3 minutes, and then kept as such for 60 minutes.

Rounding Step:

Subsequently, the rotation speed was lowered to 220 rpm (circumferential speed of the forward ends of stirring vanes, 2.28 m/sec; stirring speed reduction of 12% relative to the rotation speed in the aggregation step), and then the aqueous 20% DBS solution (6 parts as solid content) was added thereto taking 10 minutes, and thereafter the system was heated up to 87° C. taking 30 minutes, and the heating with stirring was continued until the average degree of circularity of the particles could reach 0.941. Then, this was cooled down to 30° C. taking 20 minutes, thereby to give a slurry.

<Production of Toner F>

Subsequently, a toner F was produced according to the same external addition step as in "Production of Toner A", except that, as the external additives, the amount of silica H2000 was changed to 1.25 g and the amount of titania fine powder SMT150IB was changed to 0.50 g.

Analytical Step:

The volume median diameter (Dv50) of the obtained toner F, as measured with Multisizer, was 6.77 μm; the "percentage by number (Dns) of toner particles having a particle diameter of from 2.00 μm to 3.56 μm" was 2.48%; the average degree of circularity was 0.942; and the number variation coefficient was 21.1%.

<Comparative Toner Production Example 1>

<Production of Toner Matrix Particles G>

Toner matrix particles G were produced in the same manner as in "Production of Toner Matrix Particles A" in Toner Production Example 1, except that, in the process of the aggregation step (core aggregation step, shell coating step), the rounding step, the washing step and the drying step in "Production of Toner Matrix Particles A", the "core aggregation step", the "shell coating step" and the "rounding step" were changed to the following.

Core Aggregation Step:

Into a mixer (capacity, 12 L; inner diameter, 208 mm; height, 355 mm) equipped with an agitation device (double helical vanes), a heating/cooling device, a condensation device and material/additive feeding devices, the polymer primary particle dispersion A1 and the aqueous 20% DBS solution were charged and uniformly mixed for 5 minutes at an internal temperature of 7° C. Then, with continuous stirring at an internal temperature of 21° C. and at 250 rpm, an aqueous solution of 5 mas. % ferrous sulfate was added all at a time in an amount of 0.52 parts as $FeSO_4.7H_2O$, taking 5 minutes, and then the colorant dispersion A was added thereto all at a time taking 5 minutes, and these were mixed uniformly at an internal temperature of 7° C. Further, under the same condition, an aqueous 0.5 mas. % aluminium sulfate solution was added all at a time taking 8 seconds (the solid content being 0.10 parts relative to the resin solid content). Then, while maintaining the rotation speed at 250 rpm, the internal temperature was elevated up to 57.0° C. Using Multisizer, the volume median diameter (Dv50) of the particles was measured, and the particles were grown up to 6.85 μm.

Shell Coating Step:

Then, at the internal temperature of 57.0° C. and at the rotation speed of 250 rpm, the polymer primary particle dispersion A2 was added to the system all at a time, taking 3 minutes, and then kept as such for 60 minutes.

Rounding Step:

Subsequently, at the rotation speed of 250 rpm (circumferential speed of the forward ends of stirring vanes, 2.59 m/sec; the same stirring speed as in the aggregation step), the aqueous 20% DBS solution (6 parts as solid content) was added thereto taking 10 minutes, and thereafter the system was heated up to 87° C. taking 30 minutes, and the heating with stirring was continued until the average degree of circularity of the particles could reach 0.942. Then, this was cooled down to 30° C. taking 20 minutes, thereby to give a slurry.

<Production of Toner G>

Subsequently, a toner G was produced according to the same external addition step as in "Production of Toner A", except that, as the external additives, the amount of silica H2000 was changed to 1.25 g and the amount of titania fine powder SMT150IB was changed to 0.50 g.

Analytical Step:

The volume median diameter (Dv50) of the obtained toner G for development, as measured with Multisizer, was 6.79 μm; the "percentage by number (Dns) of toner particles having a particle diameter of from 2.00 μm to 3.56 μm" was 4.52%; the average degree of circularity was 0.943; and the number variation coefficient was 24.5%.

The physical data and the electrostatic charge distribution data of the toners A to G are shown in the following Table 3.

TABLE 3

| Toner | Rotation Speed in Rounding Step (circumferential speed of forward ends of stirring vanes) | Volume Median Diameter (Dv50) (μm) | Average Degree of circularity | 0.233EXP (17.3/Dv50) | Dns (%) | Number Variation Coefficient (%) | Electrostatic Charge Distribution (standard deviation of electrostatic charge) |
|---|---|---|---|---|---|---|---|
| A | 150 rpm | 5.54 | 0.943 | 5.29 | 3.83 | 18.6 | 1.64 |
| B | (1.56 m/sec) | 5.97 | 0.943 | 4.23 | 2.53 | 18.4 | 1.66 |
| C | | 6.75 | 0.942 | 3.02 | 1.83 | 18.7 | 1.68 |
| D | 220 rpm | 5.48 | 0.943 | 5.48 | 4.51 | 20.4 | 1.94 |
| E | (2.28 m/sec) | 5.93 | 0.942 | 4.31 | 3.62 | 20.1 | 1.91 |
| F | | 6.77 | 0.942 | 3.00 | 2.48 | 21.1 | 1.92 |
| G | 250 rpm (2.59 m/sec) | 6.79 | 0.943 | 2.98 | 4.52 | 24.5 | 2.60 |

<Production of Coating Liquid for Formation of Charge Transport Layer>

Production Example 1

100 parts of a polyarylate resin having the following repeating structure (resin 1, viscosity-average molecular weight 40,000), 80 parts of a charge-transporting substance, CTM1 of the following formula (mixture of two types of cis forms, blend ratio 1/1) and 8 parts of an antioxidant, compound of the following formula (AOX1), and 0.10 parts of dimethylpolysiloxane (Shin-etsu Chemical's KF96-10CS) were dissolved in 640 parts of a mixed solvent of tetrahydrofuran/toluene (8/2 by weight) to prepare a charge transport layer-forming coating liquid.

[Formula 24]

Resin 1

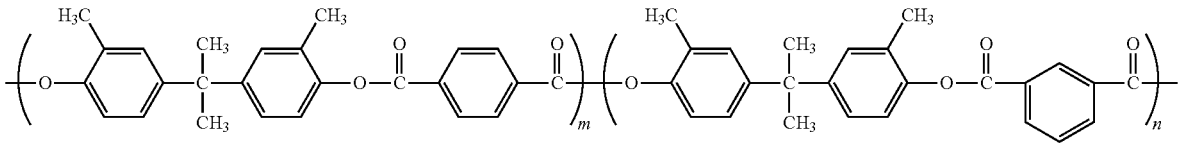

m:n = 5:5

CTM1

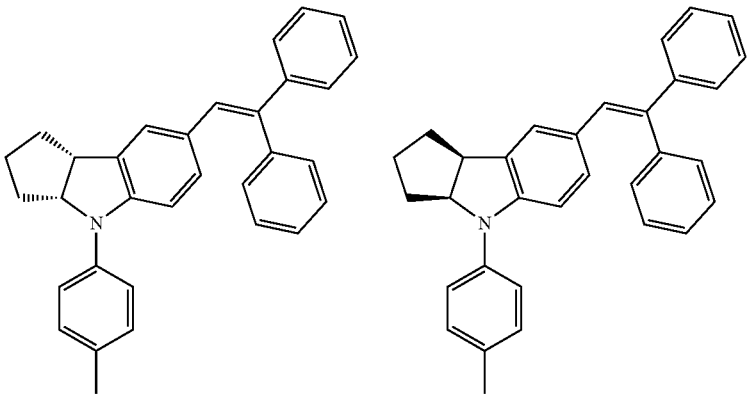

AOX1

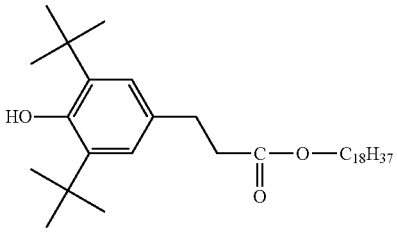

Production Example 2

A charge transport layer-forming coating liquid was prepared in the same manner as in Production Example 1, except that the amount of the resin 1 used in the charge transport layer-forming coating liquid in Production Example 1 was changed to 50 parts and 50 parts of a polycarbonate resin having the following repeating structure (resin 2, viscosity-average molecular weight 40,000) was additionally used.

[Formula 25]

Resin 2:

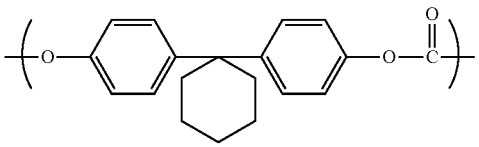

Production Example 3

A charge transport layer-forming coating liquid was prepared in the same manner as in Production Example 1, except that Unitika's U-Polymer (resin 3) was used in place of the polyarylate resin (resin 1) used in the charge transport layer-forming coating liquid in Production Example 1 and, as the solvent, chlorobenzene was used in place of the mixed solvent of tetrahydrofuran/toluene.

Production Example 4

A charge transport layer-forming coating liquid was prepared in the same manner as in Production Example 1, except that a polyarylate resin having the following repeating structure (resin 4, viscosity-average molecular weight 43,000) was used in place of the polyarylate resin (resin 1) used in the charge transport layer-forming coating liquid in Production Example 1.

[Formula 26]

Resin 4:

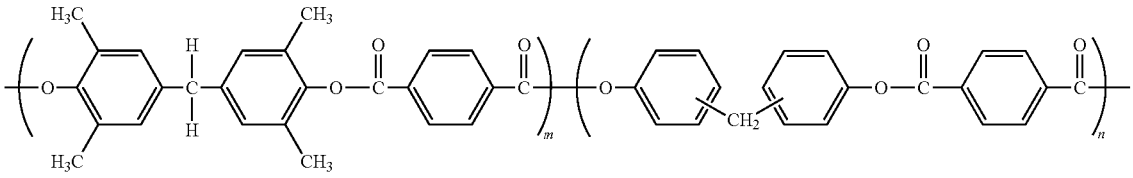

m:n = 7:3

Production Example 5

A charge transport layer-forming coating liquid was prepared in the same manner as in Production Example 1, except that a polyarylate resin having the following repeating structure (resin 5, viscosity-average molecular weight 41,000) was used in place of the polyarylate resin (resin 1) used in the charge transport layer-forming coating liquid in Production Example 1.

[Formula 27]

Resin 5:

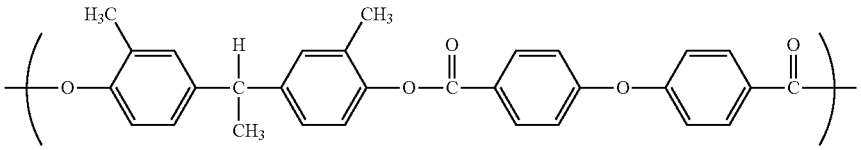

Production Example 6

A charge transport layer-forming coating liquid was prepared in the same manner as in Production Example 1, except that the polyarylate resin 5 was used in place of the polyarylate resin (resin 1) used in the charge transport layer-forming coating liquid in Production Example 1 and 80 parts of a charge-transporting substance CTM2 of the following formula was used in place of CTM1.

[Formula 28]

CTM2

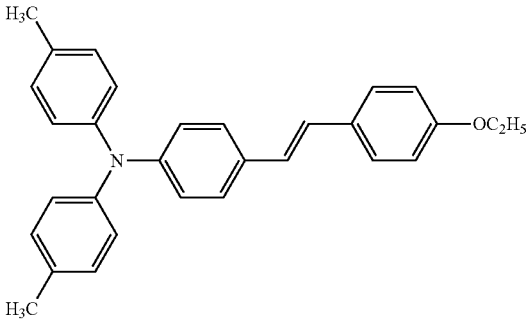

Production Example 7

A charge transport layer-forming coating liquid was prepared in the same manner as in Production Example 1, except that the polyarylate resin 5 was used in place of the polyarylate resin (resin 1) used in the charge transport layer-forming coating liquid in Production Example 1 and 80 parts of a charge-transporting substance CTM3 of the following formula was used in place of CTM1.

[Formula 29]

CTM3

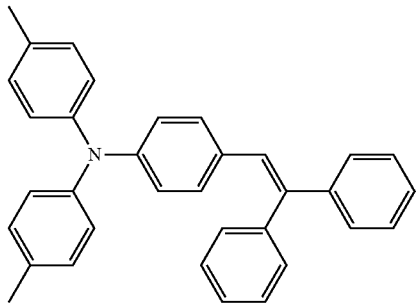

Production Example 8

A charge transport layer-forming coating liquid was prepared in the same manner as in Production Example 1, except that the polyarylate resin 5 was used in place of the polyarylate resin (resin 1) used in the charge transport layer-forming coating liquid in Production Example 1 and 80 parts of a charge-transporting substance CTM4 of the following formula was used in place of CTM1.

[Formula 30]

CTM4

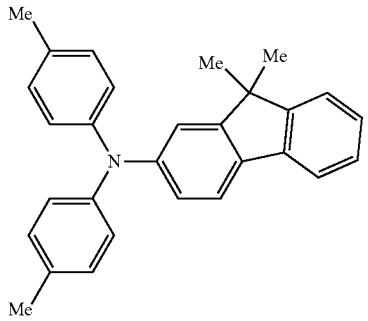

Production Example 9

A charge transport layer-forming coating liquid was prepared in the same manner as in Production Example 1, except that the polyarylate resin 5 was used in place of the polyarylate resin (resin 1) used in the charge transport layer-forming coating liquid in Production Example 1 and 80 parts of a charge-transporting substance CTM5 of the following formula was used in place of CTM1.

[Formula 31]

CTM5

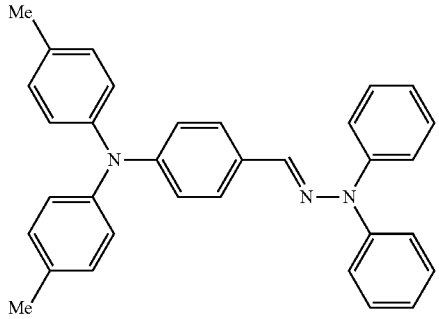

Production Example 10

A charge transport layer-forming coating liquid was prepared in the same manner as in Production Example 1, except that the resin 2 was used in place of the polyarylate resin (resin 1) used in the charge transport layer-forming coating liquid in Production Example 1.

Production Example 11

A charge transport layer-forming coating liquid was prepared in the same manner as in Production Example 1, except that the resin 2 was used in place of the polyarylate resin (resin 1) used in the charge transport layer-forming coating liquid in Production Example 1 and the charge-transporting substance CTM4 was used in place of CTM1.

Example 1

The following undercoat layer-forming coating liquid, charge generation layer-forming coating liquid and charge transport layer-forming coating liquid were applied in order onto an aluminium-made cylinder having an outer diameter of 20 mm, a length of 246 mm and a wall thickness of 0.80 mm according to a dip coating method, thereby forming thereon an undercoat layer, a charge generation layer and a charge transport layer having a dry thickness of 2.0 μm, 0.4 μm and 17 μm, respectively, to construct a photoreceptor drum.

(Undercoat Layer-Forming Coating Liquid)

The undercoat layer-forming coating liquid was prepared as follows. Rutile-type titanium oxide having a mean primary particle diameter of 40 nm (Ishihara Sangyo's "TTO55N") and methyldimethoxysilane (Toshiba Silicone's "TSL8117") in an amount of 3% by mass relative to the titanium oxide were mixed in a Henschel mixer, and the resulting surface-treated titanium oxide was dispersed in a mixed solvent of methanol/1-propanol of 7/3 by weight in a ball mill, thereby giving a dispersion slurry of surface-treated titanium oxide. The dispersion slurry, a mixed solvent of methanol/1-propanol/toluene, and pellets of a copolymer polyamide of ϵ-caprolactam (compound of the following formula (A)]/bis(4-amino-3-methylcyclohexyl) methane [compound of the following formula (B)]/hexamethylenediamine [compound of the following formula (C)]/decamethylenedicarboxylic acid [compound of the following formula (D)]/octadecamethylenedicarboxylic acid [compound of the following formula (E)] in a compositional molar ratio of 60%/15%/5%/15%/5% were stirred and mixed with heating to dissolve the polyamide pellets. Subsequently, this was ultrasonically dispersed to give an undercoat layer-forming coating liquid containing surface-treated titanium oxide/copolyamide in a ratio by weight of 3/1 in methanol/1-propanol/toluene in a ratio by weight of 7/1/2 and having a solid concentration of 18.0%.

[Formula 32]

A

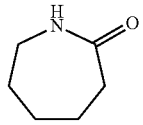

B

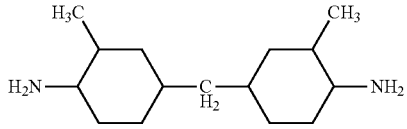

C

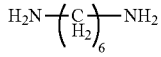

D

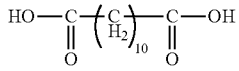

E

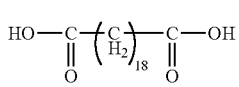

(Charge Generation Layer-Forming Coating Liquid)

Figure 2:
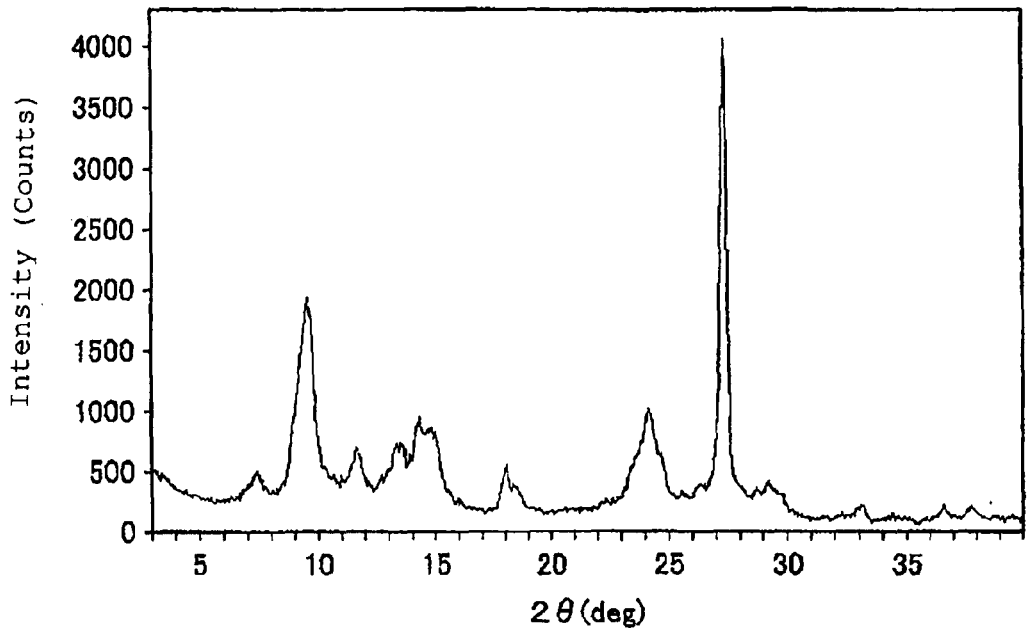
FIG. 2 is an X-ray diffraction pattern showing the powdery X-ray diffraction spectrum of oxytitanium phthalocyanine used in Examples and Comparative Examples in the invention.

The charge generation layer-forming coating liquid was prepared as follows. 20 parts of a charge-generating substance, oxytitanium phthalocyanine having an X-ray diffractiometric spectrum shown in FIG. 2, and 280 parts of 1,2-dimethoxyethane were mixed, and pulverized in a sand grind mill for 1 hour for microsizing dispersion treatment. Subsequently, the microsizing-treated liquid was mixed with a binder liquid prepared by dissolving 10 parts of polyvinylbutyral (Denki Kagaku Kogyo's trade name, "Denkabutyral" #6000C) in a mixture of 255 parts of 1,2-dimethoxyethane and 85 parts of 4-methoxy-4-methyl-2-pentanone, and 230 parts of 1,2-dimethoxyethane to prepare a charge generation layer-forming coating liquid A.

Figure 3:
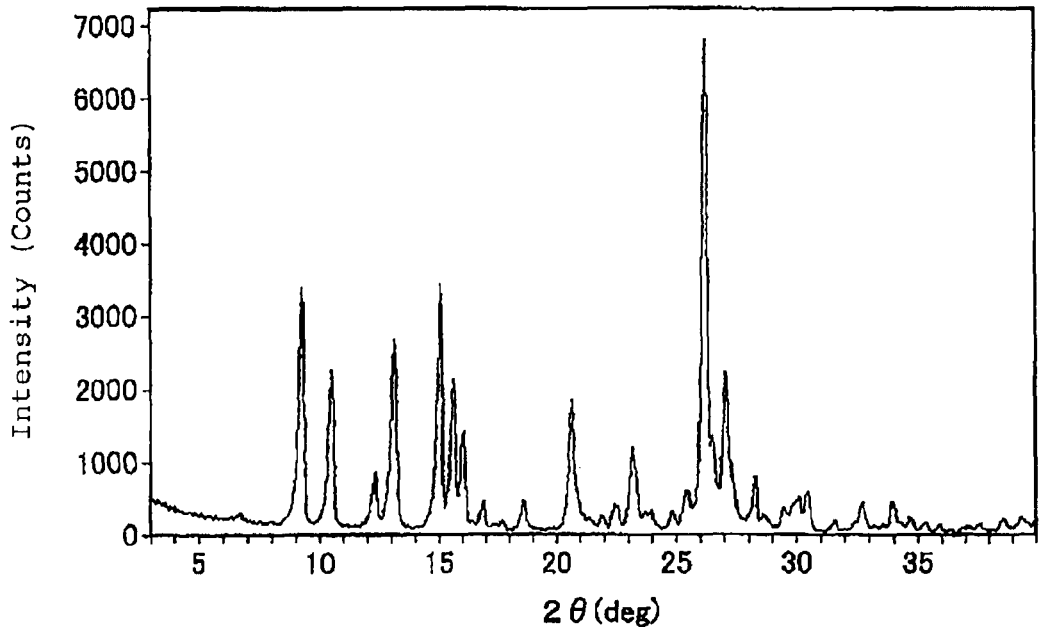
FIG. 3 is an X-ray diffraction pattern showing the powdery X-ray diffraction spectrum of oxytitanium phthalocyanine used in Examples and Comparative Examples in the invention.

20 parts of a charge-generating substance, oxytitanium phthalocyanine having an X-ray diffractiometric spectrum shown in FIG. 3, and 280 parts of 1,2-dimethoxyethane were mixed, and pulverized in a sand grind mill for 4 hours for microsizing dispersion treatment. Subsequently, the microsizing-treated liquid was mixed with a binder liquid prepared by dissolving 10 parts of polyvinylbutyral (Denki Kagaku Kogyo's trade name, "Denkabutyral" #6000C) in a mixture of 255 parts of 1,2-dimethoxyethane and 85 parts of 4-methoxy-4-methyl-2-pentanone, and 230 parts of 1,2-dimethoxyethane to prepare a charge generation layer-forming coating liquid B.

The charge generation layer-forming coating liquid A and the charge generation layer-forming coating liquid B were mixed in a ratio of 1/1 to prepare the charge generation layer-forming coating liquid for use in this Example.

The charge transport layer-forming coating liquid prepared in Production Example 1 was used here.

The toner A produced in Toner Production Example 1 was applied to the photoreceptor drum produced here and tested according to the <Image Quality Test 1> mentioned below.

In constructing the cartridge in the image quality test, the toner A was applied, as a lubricant, to the site of the cleaning blade to be in contact with the photoreceptor.

In the early stage and even after image formation on 1000 sheets, good images with no image degradation owing to ghosts, fogging, density reduction, filming, cleaning failure or the like were formed. In addition, no noise occurred during printing. The results are shown in Table 4.

<Image Quality Test 1>

The image quality test was carried out using Samsung's monochroprinter ML-1630 (with counter-abutting cleaning blade).

The produced photoreceptor drum and toner were loaded in a process cartridge, and the cartridge was fitted in the printer. At a temperature of 25° C. and a humidity of 50%, 1,000 prints were formed and checked for ghosts, fogging, density reduction, filming and cleaning failure. In addition, the system was checked for noise during image formation.

Regarding filming, noise and image quality, the samples were ranked as follows. The samples were visually checked for fogging.

"Cleaning Failure"

O: No cleaning failure occurred at all.

Δ: Some slight cleaning failure occurred, but on a practicable level.

x: Cleaning failure occurred on the entire surface on an impracticable level.

"Noise"

O: No noise occurred at all.

Δ: Some noise occurred, but on a practicable level.

x: Noise occurred on an impracticable level.

"Image Quality"

Θ: No image failure seen, and good.

O: Some and slight ghosts, density insufficiency and background soiling seen, but good with no practical problem.

Δ: Some ghosts, density insufficiency and background soiling seen, but on a practicable level.

x: Remarkable ghosts, density insufficiency and background soiling seen on an impracticable level.

Examples 2 to 15 and Comparative Examples 1 to 2

Photoreceptor drums were produced in the same mariner as in Example 1 except that the charge transport layer-forming coating liquid of Production Example shown in Table 4 was used, and the image forming apparatus was tested and evaluated also in the same manner as in Example 1 except that the toner shown in Table 4 was used. The results are shown in Table 2.

Example 16

The image forming apparatus was tested and evaluated in the same manner as in Example 1 except that a mixture of polytetrafluoroethylene and polypropylene was used as the lubricant to be applied to the cleaning blade in place of the toner A.

Example 17

The image forming apparatus was tested and evaluated in the same manner as in Example 1 except that no lubricant was applied to the cleaning blade. In four of ten and the same trials, the cleaning blade turned over and the trial was failed.

In Table 4, the result in the trial where the cleaning blade did not turn over is shown.

Comparative Example 3

The image forming apparatus was tested and evaluated in the same manner as in Example 1 except that a commercially-available toner H (average degree of circularity, 0.925; volume median diameter, 6.85) was used in place of the toner A.

Comparative Example 4

The image forming apparatus was tested and evaluated in the same manner as in Example 1 except that a commercially-available toner I (average degree of circularity, 0.963; volume median diameter, 7.25) was used in place of the toner A.

TABLE 4

| Example | Production Example | Resin | CTM | Molecular Weight of CTM | E_homo (eV) | Toner | Cleaning Failure | Noise | Image Quality | Note |
|---|---|---|---|---|---|---|---|---|---|---|
| Example 1 | Production Example 1 | 1 | 1 | 427.6 | −4.61 | A | ○ | ○ | Θ | |
| Example 2 | Production Example 2 | 1/2 | 1 | 427.6 | −4.61 | A | Δ | ○ | ○ | |

TABLE 4-continued

| Example | Production Example | Resin | CTM | Molecular Weight of CTM | E_homo (eV) | Toner | Cleaning Failure | Noise | Image Quality | Note |
|---|---|---|---|---|---|---|---|---|---|---|
| Example 3 | Production Example 3 | 3 | 1 | 427.6 | −4.61 | A | Δ | ○ | ○ | |
| Example 4 | Production Example 4 | 4 | 1 | 427.6 | −4.61 | A | ○ | ○ | Θ | |
| Example 5 | Production Example 5 | 5 | 1 | 427.6 | −4.61 | A | ○ | ○ | Θ | |
| Example 6 | Production Example 6 | 5 | 2 | 419.6 | −4.57 | A | ○ | ○ | Θ | |
| Example 7 | Production Example 7 | 5 | 3 | 451.6 | −4.68 | A | ○ | Δ | Δ | |
| Example 8 | Production Example 8 | 5 | 4 | 389.5 | −4.70 | A | ○ | ○ | ○ | |
| Example 9 | Production Example 9 | 5 | 5 | 467.6 | −4.56 | A | Δ | Δ | ○ | |
| Example 10 | Production Example 5 | 5 | 1 | 427.6 | −4.61 | B | ○ | ○ | Θ | |
| Example 11 | Production Example 5 | 5 | 1 | 427.6 | −4.61 | C | ○ | ○ | ○ | |
| Example 12 | Production Example 5 | 5 | 1 | 427.6 | −4.61 | D | ○ | ○ | Θ | |
| Example 13 | Production Example 5 | 5 | 1 | 427.6 | −4.61 | E | ○ | ○ | Θ | |
| Example 14 | Production Example 5 | 5 | 1 | 427.6 | −4.61 | F | ○ | ○ | ○ | |
| Example 15 | Production Example 5 | 5 | 1 | 427.6 | −4.61 | G | ○ | ○ | ○ | |
| Example 16 | Production Example 5 | 5 | 1 | 427.6 | −4.61 | A | ○ | ○ | Θ | |
| Example 17 | Production Example 5 | 5 | 1 | 427.6 | −4.61 | A | ○ | ○ | Θ | Blade turned over in 40%. |
| Comparative Example 1 | Production Example 10 | 2 | 1 | 427.6 | −4.61 | A | x | ○ | x | |
| Comparative Example 2 | Production Example 11 | 2 | 4 | 389.5 | −4.70 | A | x | ○ | x | |
| Comparative Example 3 | Production Example 5 | 1 | 1 | 427.6 | −4.61 | H | ○ | ○ | x | |
| Comparative Example 4 | Production Example 5 | 1 | 1 | 427.6 | −4.61 | I | ○ | ○ | x | |

As in Table 4, the electrophotographic photoreceptor containing a polyarylate resin in the photosensitive layer thereof and combined with the toner specifically defined in the invention produces high-quality images with no problem. In particular, in case of using CTM having a molecular weight of not more than 460, a cleaning failure is not provided (The other Examples are better than Example 9), which is preferred, and in case of using CTM having a molecular weight of not more than 450, a noise is not also provided (The other Examples are better than Examples 7 and 9.), which is especially preferred.

From Example 17, it is known that, in the invention, coating the cleaning blade with lubricant is favorable from the practical viewpoint.

Use of the toner specifically defined in the invention provided good image quality. Above all, Examples 1 to 10, 12 to 13 and 16 to 17 where the toner A, B, D or E having a small volume median diameter was used were better than the other Examples in point of the reproducibility of fine lines. In particular, Examples 1 to 10 and 16 to 17 where the toner A or B having a small number variation coefficient was used were excellent in point of the uniformity of halftone density. On the other hand, Comparative Examples 3 and 4 where the toner H or I falling outside the invention was used failed in fine line reproduction.

It is known that combined use of the electrophotographic photoreceptor and the toner both specifically defined in the invention provides high-definition images with no problem of image quality and apparatus.

Reference Example 1

The same underlayer-forming coating liquid, charge generation layer-forming coating liquid and charge transport layer-forming coating liquid as in Example 1 were applied in series onto an anodically-oxidized aluminium cylinder having an outer diameter of 24 mm, a length of 248 mm and a wall thickness of 0.75 mm according to a dip coating method to form an underlayer, a charge generation layer and a charge transport layer having a dry thickness of 1.5 μm, 0.4 μm and 17 μm, respectively, thereby constructing a photoreceptor drum.

The toner A produced in Toner Production Example 1 was applied to the photoreceptor drum produced here and tested according to the <Image Quality Test 2> mentioned below.

In constructing the cartridge in the image quality test, the toner A was applied, as a lubricant, to the site of the cleaning blade to be in contact with the photoreceptor.

In the early stage and even after image formation on 1000 sheets, good images with no image degradation owing to ghosts, fogging, density reduction, filming, cleaning failure or the like were formed. In addition, no noise occurred during printing.

<Image Quality Test 2>

The image quality test was carried out using Samsung's monochroprinter ML-1610 (with counter-abutting cleaning blade).

The produced photoreceptor drum and toner were loaded in a process cartridge, and the cartridge was fitted in the printer. At a temperature of 25° C. and a humidity of 50%, 1,000 prints were formed and checked for ghosts, fogging, density reduction, filming and cleaning failure according to the same evaluation criteria as in <Image Quality Test 1>. In addition, the system was checked for noise during image formation. The results are shown in Table 5 below.

Reference Example 2

A photoreceptor drum was produced and evaluated in the same manner as in Example 1 except that the charge transport layer-forming coating liquid produced in Production Example 10 was used in place of the charge transport layer-forming coating liquid used in Example 1. The results are shown in Table 5 below.

TABLE 5

| Outer Diameter of Drum 24 mmφ | Resin | CTM | Toner | Cleaning Failure | Noise | Image Quality | Note |
|---|---|---|---|---|---|---|---|
| Reference Example 1 | 1 | 1 | A | ○ | ○ | Θ | — |
| Reference Example 2 | 2 | 1 | A | ○ | ○ | Θ | — |

Like in Reference Example 1, in the early stage and even after image formation on 1000 sheets, good images with no image degradation owing to ghosts, fogging, density reduction, filming, cleaning failure or the like were formed. In addition, no noise occurred during printing.

As in Reference Example 2, in case where the drum having an outer diameter than that in the invention was used and even when a polycarbonate resin was used, cleaning failure did not occur. From the results in the above Reference Examples, it is known that the technique of the invention is one necessary for photoreceptors having a small outer diameter.

Cleaning of drums having an outer diameter of 20 mm or less with a cleaning blade is difficult, and therefore it is difficult to design the combination of such a small-diameter drum with a cleaning blade and a toner to be applied thereto. The invention provides an important technique for a small-diameter electrophotographic photoreceptor that has become used in recent downsized printers.

INDUSTRIAL APPLICABILITY

The invention is applicable to any technical field using en electrophotographic photoreceptor and is, in particular, favorable for image forming apparatus such as printers, copying machines, etc.

This application is based on Japanese patent application JP 2010-038121, filed on Feb. 24, 2010, the entire content of which is hereby incorporated by reference, the same as if set forth at length.

What is claimed is:

1. A method of forming an image comprising:

charging, via a charging unit, an electrophotographic photoreceptor containing a conductive support and a photosensitive layer on the conductive support, imagewise exposing, via an imagewise exposing unit, the charged electrophotogaraphic photoreceptor, thereby forming an electrostatic latent image thereon, developing, via a developing unit, the electrostatic latent image with a toner, and transferring, via a transferring unit, the toner from the electrophotographic photoreceptor to a receiving unit, wherein:

the outer diameter of the electrophotographic photoreceptor is 20 mm or less, the photosensitive layer comprises a polyarylate resin and charge transporting substance CTM1: a 1/1 ratio of

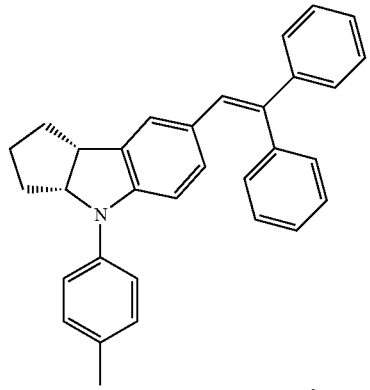

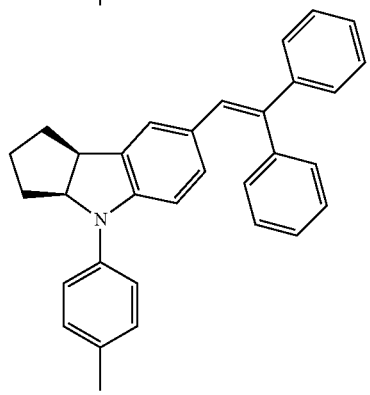

and the toner satisfies (1) and (2):

(1) the volume median diameter (Dv50) thereof is from 4.0 μm to 7.0 μm, and (2) the average degree of circularity thereof is 0.93 or more, and wherein the electrophotographic photoreceptor is brought into contact with a cleaning blade in a counter-abutting system, in which a lubricant is applied to the site of the cleaning blade to be brought into contact with the electrophotographic photoreceptor.

2. The method according to claim 1, wherein the polyarylate resin has a repeating structure of formula (1):

(1)

$$\left(-O-Ar^1-X-Ar^2-O-\overset{O}{\overset{\|}{C}}-Ar^3-(Y-Ar^4)_k-\overset{O}{\overset{\|}{C}}-\right)$$

wherein $Ar^1$ and $Ar^2$ each independently represent an arylene group optionally having a substituent;

$Ar^3$ and $Ar^4$ each independently represents an arylene group optional y having a substituent;

X and Y each independently represent a single bond or a divalent linking group; and k indicates an integer of 0 or more.

3. The method according to claim 2, wherein in the formula (1), Y is an oxygen atom and k=1.

4. The method according to claim 2, wherein the ratio of the repeating structure of formula (1) to the polyarylate resin is 50 % or more by weight.

5. The method according to claim 2, wherein the ratio of the repeating structure of formula (1) to the polyarylate resin is 80% or more by weight.

6. The method according to claim 2, wherein all the repeating structures in the polyarylate resin have the structure of formula (1).

7. The method according to claim 2, wherein the polyarylate resin has a viscosity-average molecular weight of 10,000 to 70,000.

8. The method according to claim 1, wherein the volume median diameter (Dv50) thereof is from 4.5 μm to 6.8 μm.

9. The method according to claim 1, wherein the volume median diameter (Dv50) thereof is from 4.5 μm to 7.0 μm.

10. The method according to claim 1, wherein the average degree of circularity thereof is 0.94 or more.

11. The method according to claim 1 , wherein the average degree of circularity thereof is 0.93 to 0.98.

* * * * *